US009334091B2

(12) United States Patent
Zantout et al.

(10) Patent No.: US 9,334,091 B2
(45) Date of Patent: May 10, 2016

(54) CABLE LACING TIE DEVICES AND METHODS OF USING THE SAME

(71) Applicant: IDEAL INDUSTRIES, INC., Sycamore, IL (US)

(72) Inventors: Alan Zantout, Sycamore, IL (US); Thomas Peterson, Algonquin, IL (US); Stephen Latham, Sun Prairie, WI (US); Dave Franchino, Madison, WI (US); Justen England, Madison, WI (US); Jesse Charles Darley, Madison, WI (US)

(73) Assignee: IDEAL Industries, Inc., Sycamore, IL (US)

( * ) Notice: Subject to any disclaimer, the term of this patent is extended or adjusted under 35 U.S.C. 154(b) by 218 days.

(21) Appl. No.: 13/838,390

(22) Filed: Mar. 15, 2013

(65) Prior Publication Data

US 2013/0205545 A1 Aug. 15, 2013

Related U.S. Application Data

(63) Continuation-in-part of application No. 13/269,828, filed on Oct. 10, 2011, now abandoned.

(60) Provisional application No. 61/391,851, filed on Oct. 11, 2010.

(51) Int. Cl.
*B65D 63/00* (2006.01)
*B65D 63/10* (2006.01)

(52) U.S. Cl.
CPC ..... *B65D 63/00* (2013.01); *B65D 63/1072* (2013.01); *Y10T 24/14* (2015.01)

(58) Field of Classification Search
CPC ..... Y10T 24/1498; Y10T 403/4345; Y10T 24/3969; Y10T 24/39; Y10T 403/76; Y10T 403/46; F16G 11/04; A61L 31/06; C08L 67/04
USPC ..... 24/16 R, 704.2, 703.5, 16 PB, 17 AP, 24/17 B, 17 R, 18, 28, 115 R, 122.6, 168; 292/307 R, 308, 314, 315, 319, 318, 292/321, 325, 326, 307 A; 70/14, 18, 30, 70/49, 58, 57.1, 53
See application file for complete search history.

(56) References Cited

U.S. PATENT DOCUMENTS 134,052 A * 12/1872 Gurley ..... 24/25
1,044,249 A * 11/1912 Ronfet ..... 403/211

(Continued)

OTHER PUBLICATIONS

ISA/US, International Search Report and Written Opinion issued on PCT Application No. PCT/US14/25284, mailed on Jul. 21, 2014, 9 pages.

(Continued)

*Primary Examiner* — Robert J Sandy
*Assistant Examiner* — Rowland Do
(74) *Attorney, Agent, or Firm* — Greenberg Traurig, LLP

(57) ABSTRACT

Cable lacing tie devices and methods of using the same are disclosed. The cable lacing tie devices include a head assembly and a cable lacing tape. The head assembly being configured to retain a first portion of the cable lacing tape within the head assembly and having a length of the cable lacing tape extending from the head assembly. The head assembly further adapted to retain a second portion of the cable lacing tape extending from the head assembly. The methods of using the cable lacing tie devices to hold together a plurality of objects with a cable lacing tie device include retaining a first portion of a cable lacing tape in a head assembly, looping the cable lacing tape around the plurality of objects and retaining a second portion of the cable lacing tape within the head assembly.

9 Claims, 35 Drawing Sheets

(56) References Cited

U.S. PATENT DOCUMENTS

| | | | | | |
|---|---|---|---|---|---|
| 3,186,047 | A | | 6/1965 | Schwester et al. | |
| 3,416,198 | A | | 12/1968 | Geisinger | |
| 3,488,813 | A | | 1/1970 | Kohke | |
| 3,660,869 | A | | 5/1972 | Caveney et al. | |
| 3,739,429 | A | | 6/1973 | Kohke | |
| 3,744,104 | A | | 7/1973 | Ford | |
| 3,766,610 | A | * | 10/1973 | Thorsbakken | 403/211 |
| 3,800,450 | A | | 4/1974 | Laugherty et al. | |
| 3,875,618 | A | | 4/1975 | Schuplin | |
| 3,875,771 | A | | 4/1975 | Reisner | |
| 3,886,630 | A | | 6/1975 | Emery | |
| 3,900,922 | A | * | 8/1975 | McCormick | 24/16 PB |
| 3,909,884 | A | * | 10/1975 | Weckesser | 24/16 PB |
| 4,008,512 | A | | 2/1977 | Prodel | |
| 4,038,726 | A | | 8/1977 | Takabayashi | |
| 4,422,217 | A | | 12/1983 | Barrette | |
| 4,498,507 | A | | 2/1985 | Thompson | |
| 4,514,882 | A | | 5/1985 | Lavielle | |
| 4,680,834 | A | | 7/1987 | Andre et al. | |
| 4,761,861 | A | * | 8/1988 | Peles | 24/196 |
| 4,765,032 | A | | 8/1988 | Fortsch | |
| 4,854,015 | A | | 8/1989 | Shaull | |
| 4,932,104 | A | | 6/1990 | Kowal | |
| 4,993,669 | A | | 2/1991 | Dyer | |
| 5,102,075 | A | | 4/1992 | Dyer | |
| 5,121,524 | A | | 6/1992 | Mortensen | |
| 5,193,251 | A | | 3/1993 | Fortsch | |
| 5,356,417 | A | * | 10/1994 | Golds | 606/151 |
| 5,544,391 | A | | 8/1996 | Hoffman | |
| 5,566,427 | A | | 10/1996 | Lathrop | |
| 5,577,395 | A | | 11/1996 | Kuykendall | |
| 5,669,253 | A | | 9/1997 | Higgins | |
| 5,802,888 | A | | 9/1998 | Parsons | |
| 5,979,095 | A | | 11/1999 | Schneider et al. | |
| 6,044,669 | A | | 4/2000 | Levi | |
| 6,076,234 | A | | 6/2000 | Khokhar et al. | |
| 6,128,809 | A | | 10/2000 | Khokhar | |
| 6,199,412 | B1 | | 3/2001 | Kennedy | |
| 6,230,369 | B1 | | 5/2001 | Steadman | |
| 6,510,717 | B1 | | 1/2003 | Levi | |
| 6,532,631 | B2 | | 3/2003 | Rohaly et al. | |
| 6,648,378 | B1 | | 11/2003 | Torres et al. | |
| 6,684,462 | B1 | | 2/2004 | Narula et al. | |
| 6,763,553 | B2 | | 7/2004 | Hatch | |
| 6,863,855 | B2 | | 3/2005 | Shilale | |
| 6,928,701 | B2 | | 8/2005 | Hutter, III | |
| 7,013,535 | B2 | | 3/2006 | Tracy | |
| 7,328,487 | B2 | | 2/2008 | Hoffman et al. | |
| 7,406,789 | B2 | | 8/2008 | Story | |
| 7,644,475 | B2 | | 1/2010 | Canady | |
| 7,832,693 | B2 | * | 11/2010 | Moerke et al. | 248/71 |
| 8,307,517 | B2 | | 11/2012 | Piermayr et al. | |
| 2002/0170151 | A1 | | 11/2002 | Caveney et al. | |
| 2003/0110596 | A1 | * | 6/2003 | Graham et al. | 24/16 R |
| 2005/0091801 | A1 | | 5/2005 | Feschuk | |
| 2010/0306967 | A1 | | 12/2010 | Geiger | |

OTHER PUBLICATIONS

International Search Report for related PCT/US2011/055613 dated Feb. 1, 2012.

Written Opinion of the International Searching Authority for related PCT/US2011/055613 dated Feb. 1, 2012.

* cited by examiner

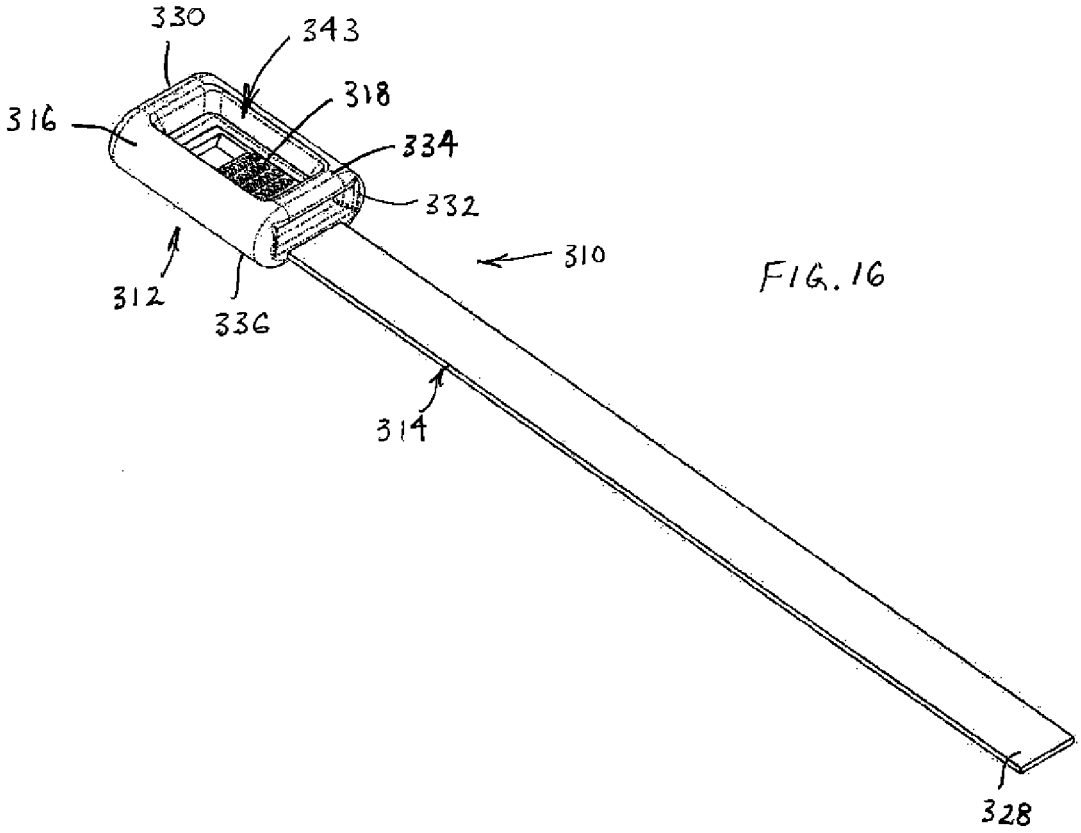
FIG. 16
FIG. 17
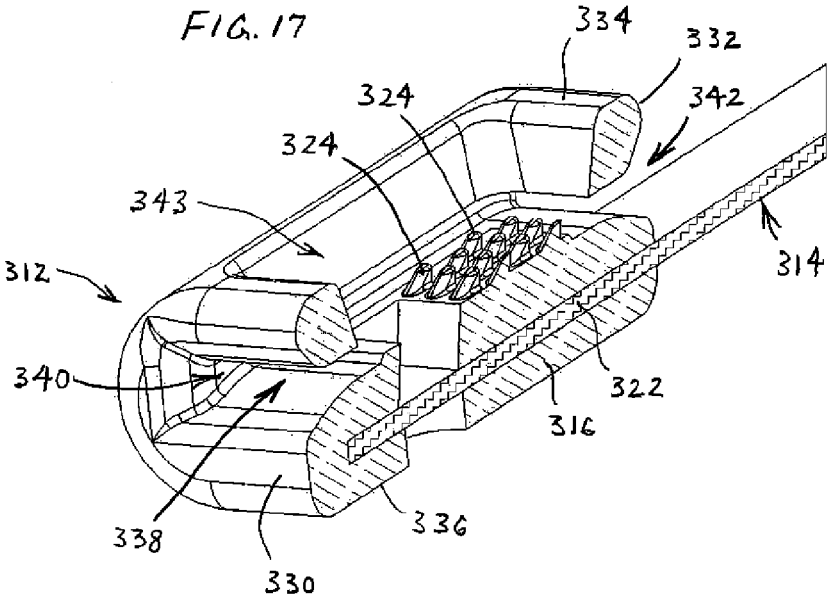

CABLE LACING TIE DEVICES AND METHODS OF USING THE SAME

CROSS-REFERENCE TO RELATED APPLICATION

This application is a continuation-in-part of and claims the benefit of co-pending U.S. Non-Provisional patent application Ser. No. 13/269,828, filed Oct. 10, 2011, which claims the benefit of U.S. Provisional Patent Application Ser. No. 61/391,851, filed Oct. 11, 2010, the disclosures of which are hereby incorporated by reference in their entirety.

BACKGROUND

This disclosure relates to devices and methods for holding together two or more wires, wire harnesses, cables or other objects, or for connecting such objects to other structures. More particularly, the disclosure relates to cable lacing tie assemblies for use in bundling a plurality of objects such as wires, wire harnesses, cables or other objects, and methods of using such cable lacing tie assemblies.

Individual wires, wire harnesses or cables having two or more wires or strands are customarily grouped and held adjacent to each other at various points along their lengths by use of cable ties or cable lacing tape. Strapping or tying together such groupings is intended to help ensure the safety and durability of the components.

Cable ties have become very common and typically are formed from an integrally molded piece of plastic that includes an elongated solid strap connected at one end to a buckle. The strap is intended to be looped around a bundle of wires and then fed through a passageway in the buckle. Corresponding surfaces on the strap and within the buckle commonly have complementary serrated patterns that can achieve a locking position. Thus, a cable tie buckle often includes an integrally molded locking element or pawl within the passageway to cooperate with integrally molded serrations or teeth along the strap. The buckle may include a separately provided metal pawl to engage the serrations on the strap. Alternatively, the strap may have flat surfaces and the buckle may include a separately provided metal barb or knife-like strap piercing element to cut or bite into the strap and prevent rearward withdrawal of the strap. However, such a barb or knife like strap piercing element is destructive to the strap when it cuts or bites into the strap, permanently reducing the strength of the strap and increasing the tendency for the strap to tear through.

Once a strap of a cable tie is passed through the buckle, it may be cut to remove the free end. However, the cut section of the molded plastic strap that protrudes from the buckle can present an undesirable, fairly sharp obstruction that may result in abrasion problems with respect to adjacent wire bundles, and may be problematic if one is attempting to pull the wire bundle through an aperture, such as a panel opening. This also can be true of the molded buckle itself, which can be relatively large and may have fairly sharp edges. It should be noted that another drawback of molded plastic cable ties is that, due to their relative rigidity, they generally are not capable of closely hugging irregular or rectangular shapes, as may occur when bundling wires, wire harnesses or cables, or connecting them to other structures.

In the aerospace environment, a cable tie can be subjected to elevated temperatures as high as 400 degrees F. This can cause a common cable tie, which is typically molded from thermoplastic material, such as Nylon, to creep or lose structural integrity. The integral locking element or pawl that engages the strap then may yield, allowing the wire bundle to separate or come loose. The locking element or pawl generally will be constructed to be deflectable, so as to reduce the strap insertion force, but this also compromises the ability to retain the strap, especially at high temperatures. Cable ties that have a separately provided metal locking element or pawl usually are intended to provide for increased retention, even at elevated temperatures, but these structures typically require higher insertion forces when passing over the metal element.

Because of many of the above drawbacks associated with plastic molded cable ties, in areas where elevated levels of safety are required, such as in the military and commercial aircraft industries, the aerospace industry, as well as in some marine environments, there is a preference to use a procedure known as "cable lacing" for securing or bundling wires, wiring harnesses or cables. Cable lacing includes looping a material commonly referred to as "cable lacing tape" around wires, wire harnesses or cables and tying knots in the cable lacing tape, either in discrete locations along the length of the bundle, referred to as spot ties, or in a running format with the cable lacing tape continuing along the bundle between knot locations.

Modern cable lacing tapes typically are a thin, relatively flat, woven or braided cord, often referred to as a "tape", having filaments that may be made of materials such as Nylon, polyester or Nomex, and which may be impregnated with coatings to enhance particular performance characteristics. Materials such as Nomex provide good tensile strength, while being non-flammable, highly resistant to fluids and lubricants, and able to perform in extreme temperature environments, such as from approximately −65 degrees F. to 500 degrees F. However, cable lacing has drawbacks in that the cable lacing tape typically is tied by hand in a costly, labor-intensive, and time-consuming process. Due to these problems, several attempts have been made to automate the cable lacing process. One such device for automated knot tying is described in U.S. Pat. No. 6,648,378.

Such knot tying devices have their own drawbacks and one still is faced with using cable lacing tape that must be cut. Indeed, after forming a spot tie, it is common to cut the ends of the cable lacing tape, so as not to leave them hanging or susceptible to being snagged by other objects. However, cutting the ends of the cable lacing tape may lead to the unraveling of the braided filaments. Therefore, in some installations, it has become common to attempt to fuse the filaments of a cut cable lacing tape end by applying a binding agent, such as a drop of adhesive or glue. The need to incorporate the use of adhesives or glues into the assembly method may present additional difficulties, such as for example cleanliness of the application, unintentional bonding of other objects or surfaces, and the introduction of potentially undesirable fumes, and/or flammable or incompatible fluids or materials.

SUMMARY

The present disclosure provides cable lacing tie devices for holding together a plurality of objects, such as where the plurality may be one or more similar or different objects that are to be gathered and held together at one or more predetermined locations, such as points along a group of wires, wiring harnesses or cables that are gathered together to form a bundle. The cable lacing tie devices are comprised of a low profile head assembly and a length of a braided filament element hereinafter referred to as a cable lacing tape. A first portion, such as a first end of the length of cable lacing tape, may be retained by the head assembly, for example by being routed through, or otherwise connected to or molded within a body of the head assembly through a process known as insert-molding. Insert-molding provides an extremely robust method of joining the braided cable lacing tape to the head assembly. The body of the head assemblies preferably is molded from a material that is adapted for use in a relatively high temperature environment, such as polyetheretherketone (PEEK) or polyetherimide (PEI), although other materials may be used in correspondence with their desired performance characteristics. The head assemblies also include a retainer which may have protrusions, such as in the form of a separate retainer plate that is engaged with the body, or as a compression member, or otherwise formed to have protrusions located on a surface of the body of the head assembly. The first portion of the cable lacing tape alternatively could be retained within a retainer of a head assembly.

In one form, the retainer may have protrusions configured to engage the cable lacing tape by spreading and becoming located between braided filaments. Such protrusions being designed to hook the filaments and resist movement of the cable lacing tape in one direction, which is associated withdrawal of the cable lacing tape from the head assembly. In another form, the retainer may have protrusions configured to increase or apply localized compression to the cable lacing tape to enhance the holding force applied to the tape. Alternatively, the retainer may be molded within the head assembly to provide protrusions along an internal surface. In all forms, the protrusions of the retainer that are configured to engage the cable lacing tape are not intended to be destructive elements, and therefore, they are not intended to pierce, cut or otherwise damage the individual filaments of the cable lacing tape.

As noted above, the head assemblies may include a compression member, and the compression member may include or be configured as the retainer. A compression member or retainer may be configured to urge the cable lacing tape into engagement with an opposed surface of the head assembly. Further, the head assemblies may include a retainer in the form of protrusions that are located on the compression member or on other opposed surfaces within the head assemblies. The compression member also may be a separate component that engages the body or may be integrally formed with or otherwise connected to the body of the head assembly.

Thus, in a first aspect, the disclosure provides a cable lacing tie device having a head assembly and a cable lacing tape, the cable lacing tape having braided or woven filaments, the head assembly retaining a first portion of the cable lacing tape and having a length of the cable lacing tape extending from the head assembly, and the head assembly including a retainer adapted to retain a portion of the length of cable lacing tape extending from the head assembly. In a second aspect, the disclosure provides a cable lacing tie device having a head assembly, a cable lacing tape, and a retainer adapted to urge a portion of the cable lacing tape into a retained position within the head assembly, and wherein the cable lacing tape includes braided or woven filaments. In a further aspect, the disclosure provides a method of holding together a plurality of objects with a cable lacing tie device, wherein the cable lacing tie device includes a head assembly and a cable lacing tape, the cable lacing tape including braided or woven filaments, wherein the head assembly and cable lacing tape are configured to have a first portion of the cable lacing tape retained within the head assembly and having a length of the cable lacing tape with a second portion extending from the head assembly, the method including the steps of locating the head assembly at or near the plurality of objects, moving the second portion of the cable lacing tape to a position looped around the plurality of objects, and moving the second portion of the cable lacing tape to a position wherein the second portion of the cable lacing tape engages and is retained within the head assembly.

In another aspect, the disclosure provides a cable lacing tie device is provided that includes a head assembly and a cable lacing tape, the cable lacing tape including braided or woven filaments, a first portion of the cable lacing tape retained within the head assembly, the head assembly including a body having a passageway therethrough, a retainer being movable from an unlocked position to a locked position, and a second portion of the cable lacing tape having an end and the end being routed through the passageway in the head assembly in a path wherein the retainer is moved from the unlocked position to the locked position when the end of the second portion of the cable lacing tape is pulled.

In a further aspect the disclosure provides a method of holding together a plurality of objects with a cable lacing tie device, wherein the cable lacing tie device comprises a head assembly having a passageway therethrough, a cable lacing tape and a retainer, the cable lacing tape comprising braided or woven filaments and being configured to have a first portion retained by the head assembly and a second portion having an end, the retainer being movable from an unlocked to a locked position to retain the second portion of the cable lacing tape within the head assembly. The method includes the steps of locating the head assembly at or near the plurality of objects, moving the second portion of the cable lacing tape to a position looped around the plurality of objects, routing the end of the second portion through the passageway in the head assembly while the retainer is in the unlocked position and in a path by which pulling the end of the second portion of the cable lacing tape will remove slack in the second portion of the cable lacing tape and will move the retainer from an unlocked position to a locked position, and pulling the end of the second portion of the cable lacing tape until the slack in the second portion of the cable lacing tape is removed and the retainer moves from an unlocked position to a locked position wherein the second portion of the cable lacing tape is retained within the head assembly.

In still another aspect, the disclosure provides a cable lacing tie device including a head assembly and a cable lacing tape, the cable lacing tape comprising braided or woven filaments, a first portion of the cable lacing tape retained within the head assembly, the head assembly comprising a body having a passageway therethrough, a retainer positioned within the head assembly and configured to permit a second portion of the cable lacing tape to be freely moved within the passageway until being crimped by a tool wherein the second portion of the cable lacing tape is compressed and retained within the head assembly.

In yet another aspect, the disclosure provides a cable lacing tie device including a head assembly, and a cable lacing tape, the cable lacing tape comprising braided or woven filaments and having a length and two ends, the head assembly including a body retaining a first portion of the cable lacing tape that is spaced from the two ends of the cable lacing tape, wherein a second portion of the cable lacing tape extends from the body and is routed through a passageway in the body, the head assembly further including a retainer that engages the body and is movable between an unlocked position and a locked position, and wherein when the second portion is positioned through the passageway in the body, the retainer may be moved from the unlocked position to the locked position to retain the second portion of the cable lacing tape within the head assembly.

In another aspect, the disclosure provides a cable lacing tie device including a head assembly and a cable lacing tape, the cable lacing tape comprising braided or woven filaments; a first portion of the cable lacing tape retained within the head assembly, the head assembly including a body having a passageway therethrough, a second portion of the cable lacing tape extending from the body, a retainer having a passageway therethrough and being positioned along the second portion of the cable lacing tape, and the retainer being slidable along the second portion of the cable lacing tape and movable from an unlocked position spaced apart along the length of the second portion of the cable lacing tape from the body to a locked position located within the body.

In a further aspect, the disclosure provides a cable lacing tie device including a head assembly, and a cable lacing tape, the head assembly including a body having a passageway, the cable lacing tape comprising braided or woven filaments, a first portion of the cable lacing tape retained within the body, a retainer positioned within the body and having a passageway, the retainer being movable between an unlocked position and a locked position, the passageway through the retainer being aligned with the passageway through the body when the retainer is in the locked position, a second portion of the cable lacing tape extending from the body, and the second portion of the cable lacing tape being routed through the passageways in the retainer and the body when the retainer is in the locked position, wherein the second portion of the cable lacing tape forms a stop that resists movement of the retainer from the locked position to the unlocked position.

In still a further aspect, the disclosure provides a cable lacing tie device including a head assembly, and a cable lacing tape, the head assembly including a body having a passageway that includes at least three openings, the cable lacing tape including braided or woven filaments, a first portion of the cable lacing tape retained within the body, a retainer being movable from an unlocked position to a locked position when slidably received through at least one of the at least three openings of the passageway, and a second portion of the cable lacing tape extending from the body and being routed through the at least three openings of the passageway when the retainer is moved to the locked position.

An advantage of the cable lacing tie devices of the present disclosure is that they may be configured to provide smooth and low profile head assemblies to prevent abrasion against adjacent wires, wire harnesses, cables or other objects. The cable lacing tie devices also may include head assemblies and cable lacing tapes that are constructed from one or more materials that are adapted for use in environments that involve relatively high temperatures or other extreme conditions. A weight savings also may be realized over plastic cable ties by using a light weight cable lacing tape that is of braided filament construction. The head assemblies further may be configured to provide near zero insertion force, thus permitting relatively easy insertion of the distal end of the cable lacing tape through the head assembly. The cable lacing tie devices also may be utilized in a method of cable lacing that provides very rapid and secure installation.

Some of the cable lacing tie devices of the present disclosure provide advantages with respect to ease of use, such as having all of the components connected together for convenient handling, and avoidance of loose parts. There are cable lacing tie devices disclosed herein that are configured to permit the device to be used in synching together a plurality of objects, eliminating slack in the cable lacing and then allowing a wedge-shaped element or other compression member or retainer to move into a position that retains the cable lacing tape within a head assembly, without the user having to do anything other than pull on a free end of the cable lacing tape. The movement effectively is automatic in that the user need not take any action other than to continue to pull on the end of the cable lacing tape until the force on the components that lock the cable lacing tape in its installed position release from an unlocked position and move to a locked position. In addition, some of the devices include routing of the cable lacing tape through a head assembly that causes the cable lacing tape to bend back on itself as it passes through the head assembly in a manner that would not be possible with prior art plastic zip ties, and keeps the cable lacing tape recessed from the surface of the head assembly to avoid incidental damage.

While discussed with respect to examples that may be used in particular industries, such as for example commercial or military aircraft, it will be appreciated that the disclosed cable lacing tie devices and methods of using the same may be utilized in other industries or applications, and may be incorporated into other electrical apparatus and systems for use with any objects requiring connection or bundling. Accordingly, while the present disclosure shows and demonstrates various example components, the examples are merely illustrative and are not to be considered limiting. It will be apparent to those of ordinary skill in the art that various cable lacing tie devices, electrical apparatus and systems can be constructed without departing from the scope or spirit of the present disclosure. Thus, although certain examples have been described herein, they are merely illustrative, are not to be considered limiting, and the scope of coverage of this patent is not limited thereto.

BRIEF DESCRIPTION OF THE DRAWINGS

In describing preferred examples, reference is made to the accompanying drawing figures wherein like parts have like reference numerals, and wherein:

FIG. 16 is a perspective view of a fourth example cable lacing tie device in a pre-installed position and with a simplified view of the cable lacing tape.

FIG. 17 is a perspective section view of the cable lacing tie device of FIG. 16 with the device being sectioned parallel to the lacing direction and with a simplified view of the cable lacing tape.

It should be understood that the drawings are not necessarily to scale and that actual embodiments may differ. It also should be understood that the claims are not limited to the particular examples illustrated or combinations thereof.

DETAILED DESCRIPTION

Figure 1A:
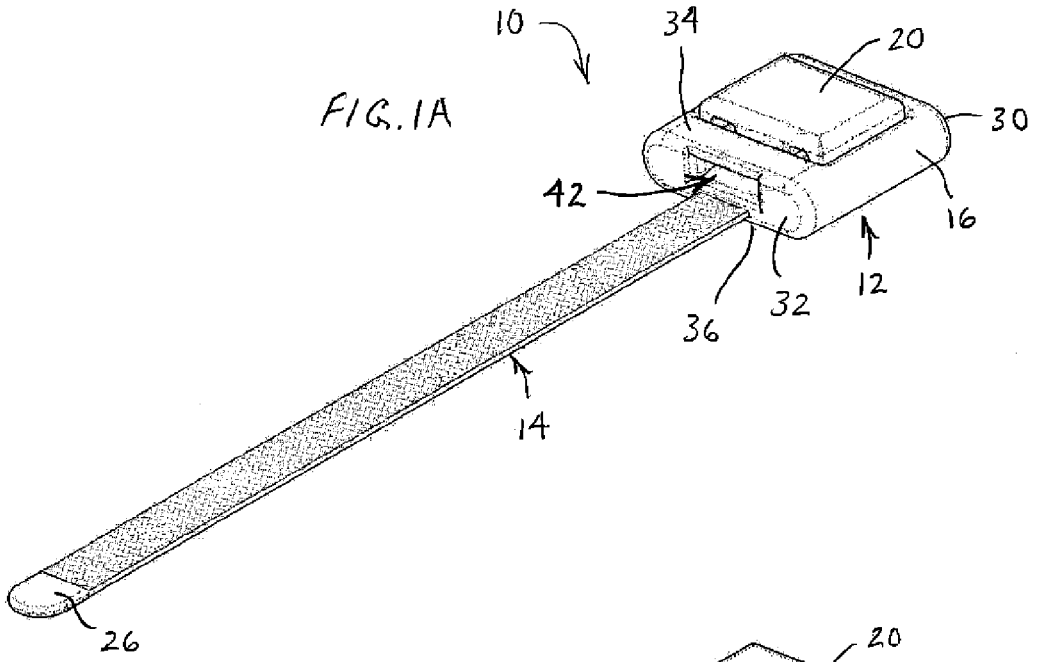
FIG. 1A is a perspective view of a first example cable lacing tie device having a compression member in an unlocked, ready position.
Figure 1B:
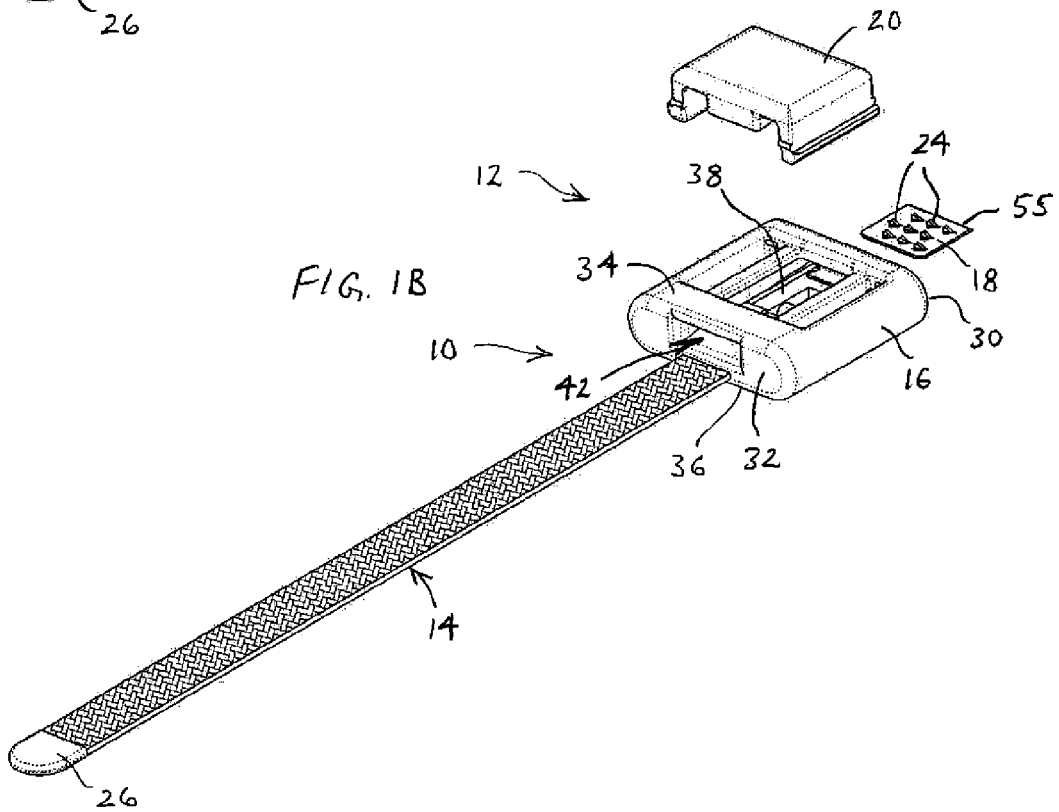
FIG. 1B is a perspective partially exploded view of the cable lacing tie device of FIG. 1.
Figure 2:
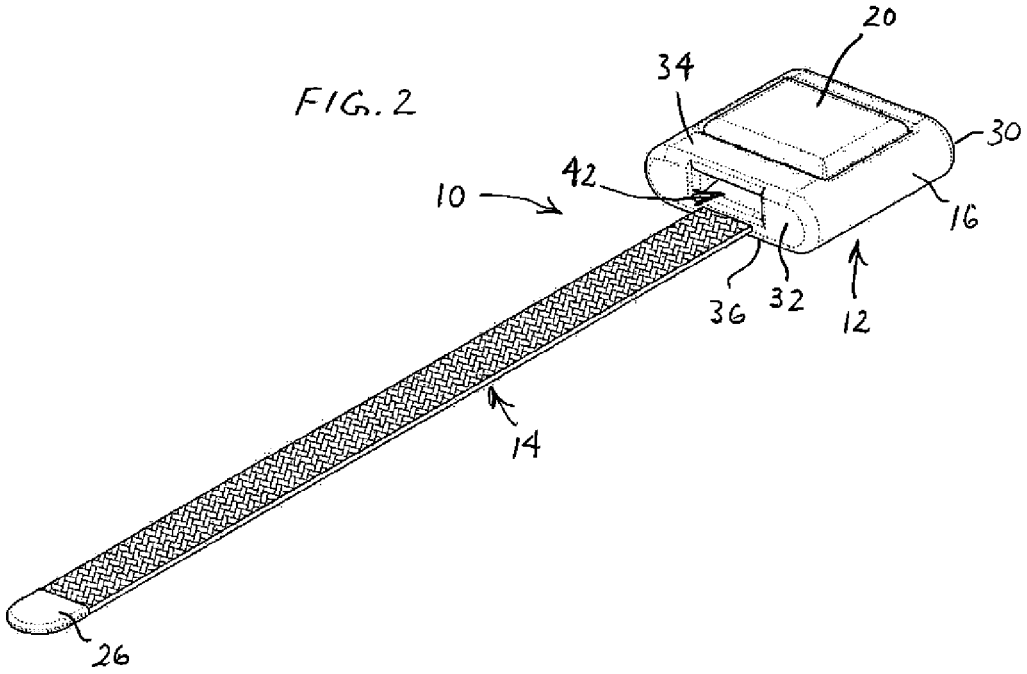
FIG. 2 is a perspective view of the cable lacing tie device of FIG. 1 having the compression member in a locked position.
Figure 3:
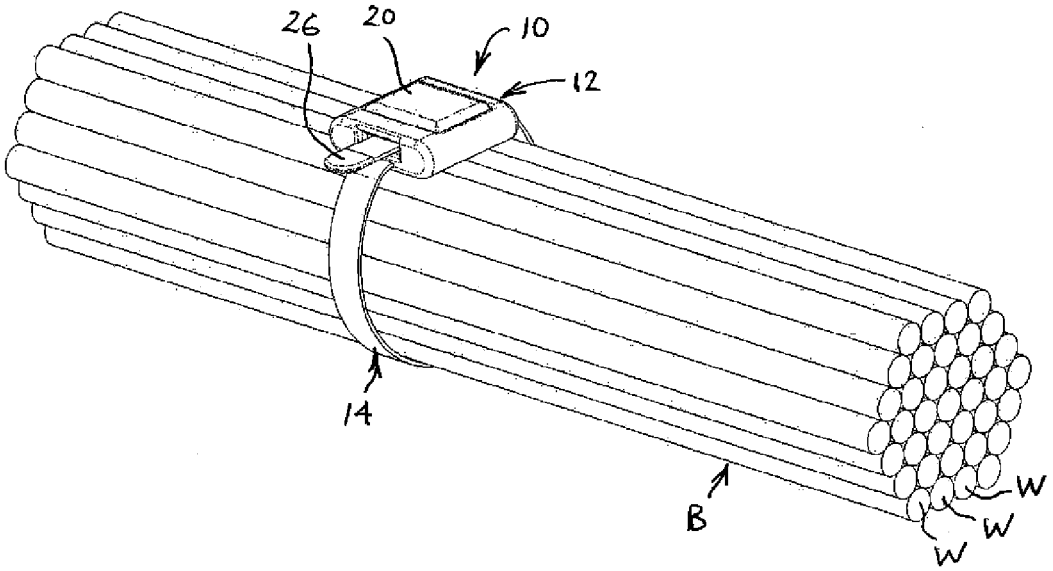
FIG. 3 is a perspective view of the cable lacing tie device of FIG. 1 in an installed position and with a simplified view of the cable lacing tape.
Figure 11:
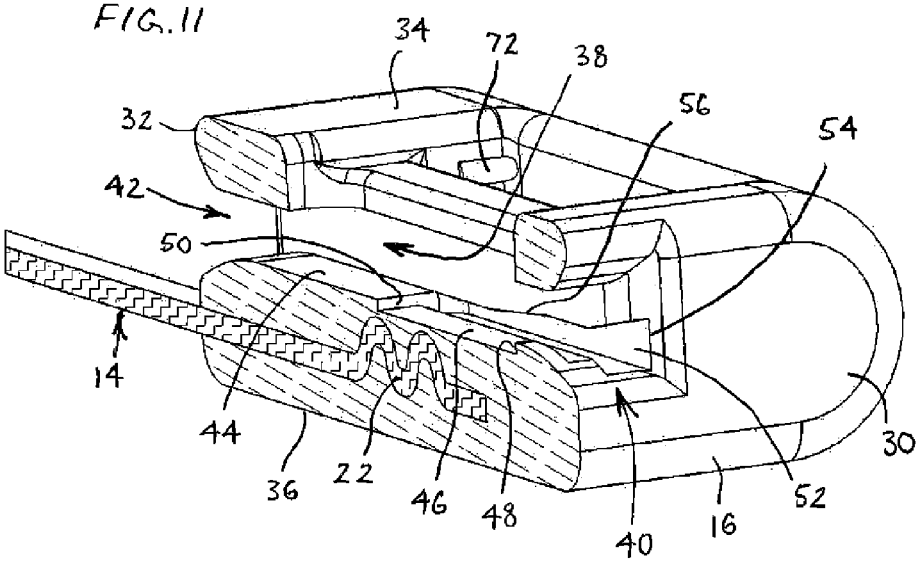
FIG. 11 is a perspective section view of the body of the head assembly of the cable lacing tie device of FIG. 10 with the device being sectioned parallel to the lacing direction and with a simplified view of the cable lacing tape.

A first example cable lacing tie device 10 is illustrated in FIGS. 1A, 1B and 2-11. The cable lacing tie device 10 includes a head assembly 12 and a length of cable lacing tape 14. The head assembly 12 of this example includes a molded body 16, a retainer 18 in the form of a retainer plate, and a compression member 20. A first portion 22 of the cable lacing tape 14 is configured to be retained in a first position within the head assembly 12 by having a first end insert-molded within the body 16 in a tortuous path for enhanced retention, as best seen in FIG. 11. A length of the cable lacing tape 14 then extends from the front of the head assembly 12. The cable lacing tie device 10 may be used, for example, to hold together a plurality of objects, such as to form a bundle B of a group of wires W, which are shown in FIG. 3, in a simplified manner.

The body 16 and compression member 20 preferably each are injection molded and constructed of a material that is suitable for use in a relatively high temperature environment, such as polyetheretherketone (PEEK) or polyetherimide (PEI), although other plastics may be suitable for less demanding environments. The retainer 18, in this example shown in the form of a retainer plate that is preferably formed from a metal, such as spring steel, or other suitable material such as an alloy or a molded composite, includes protrusions 24 that are formed, such as by a stamping process, so as to project upward and at an angle of 90 degrees or less.

Figure 5:
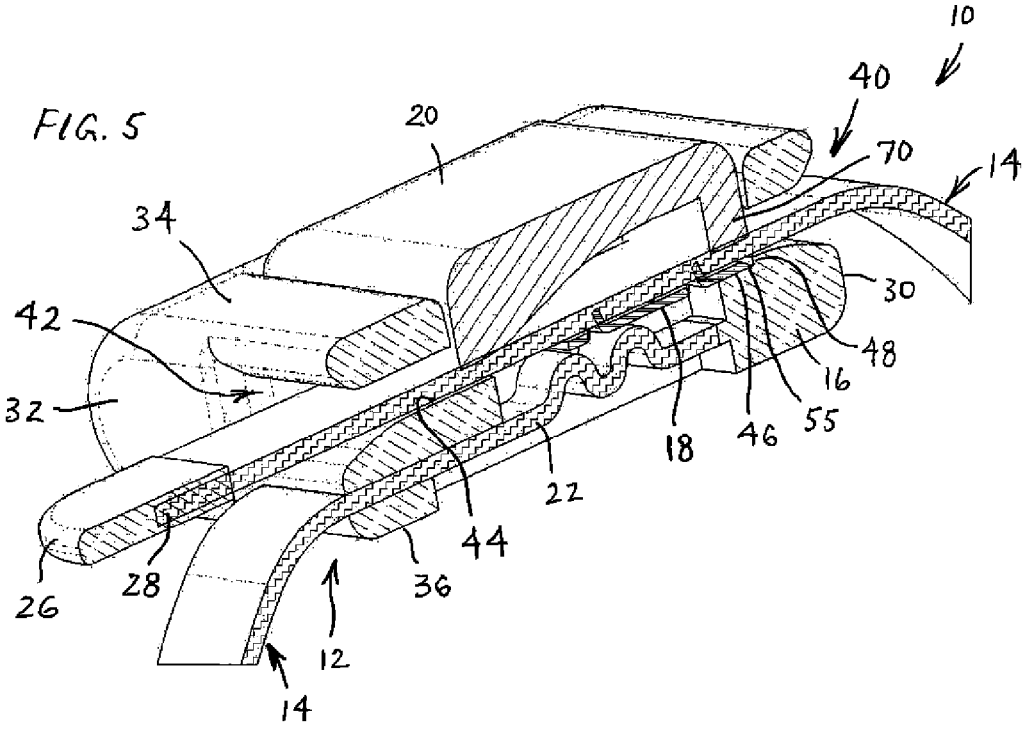
FIG. 5 is a perspective section view of the cable lacing tie device of FIG. 1 having the compression member in an installed position, with the device being sectioned parallel to the lacing direction and with a simplified view of the cable lacing tape.
Figure 6:
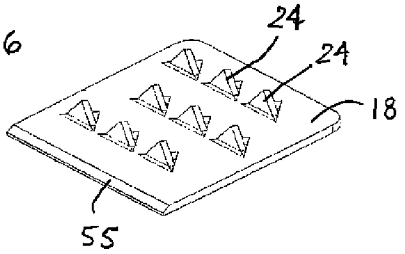
FIG. 6 is a perspective view of a retainer in the form of a retainer plate that is a component of the head assembly of the cable lacing tie device of FIG. 1.

The cable lacing tape 14 preferably is constructed of a thin, relatively flat, braided filament element, such as that known as braided cable lacing tape, which can be made of one or more materials suitable for the intended use. This may include materials such as Nylon, polyester, or natural fibers, but preferably for applications that require a more stable material it may include Nomex, or other suitable modern filaments. The cable lacing tape 14 is illustrated in FIGS. 1A, 1B and 2 in a manner that provides a rough approximation of the appearance of the upper surface of the braided filament element. When the cable lacing tape is depicted in the other Figures, for convenience, it is provided in a very simplified view in which it is represented as a thin, flat band. However, it will be understood that in all of the examples, the cable lacing tape is of a woven or braided filament construction. Here, a first portion 22, such as a first end of the cable lacing tape 14 is retained in the head assembly 12. The cable lacing tape 14 also preferably includes a tip 26 molded to the distal or second end 28 of the cable lacing tape 14 that extends from the head assembly 12, as best seen in FIG. 5. The tip 26 helps to prevent the braided filaments of the cable lacing tape 14 from becoming unraveled, and as discussed in further detail below, facilitates insertion of the second end 28 of the cable lacing tape 14 through the head assembly 12.

Figure 4:
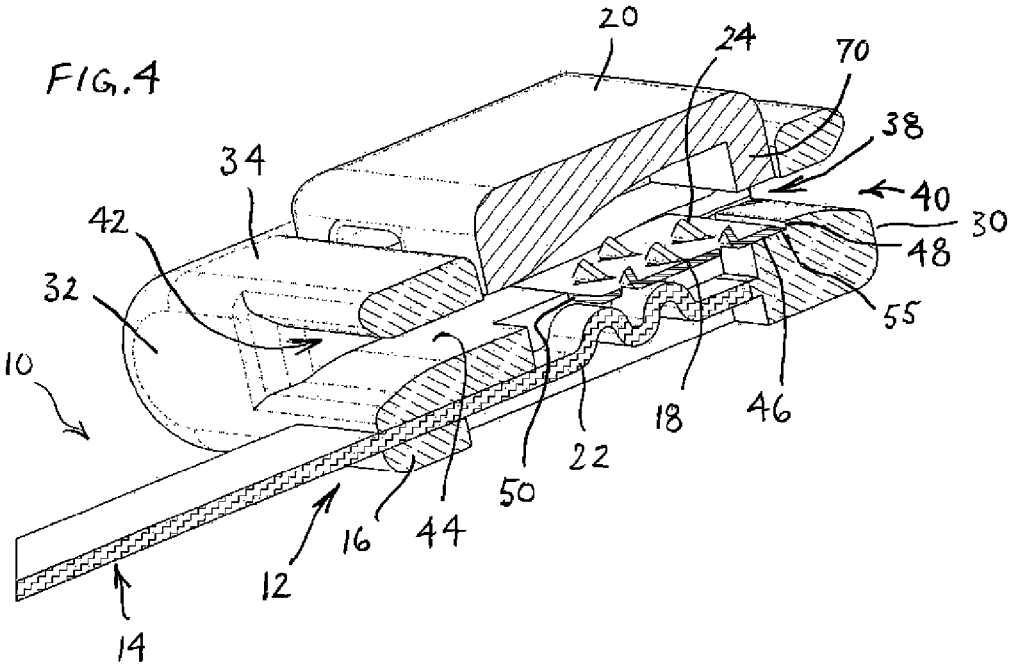
FIG. 4 is a perspective section view of the cable lacing tie device of FIG. 1 having the compression member in an unlocked, ready position, with the device being sectioned parallel to the lacing direction and with a simplified view of the cable lacing tape.

As best seen in FIGS. 2, 4, 9 and 11, the body 16 of the head assembly 12 has a rear surface 30, a front surface 32, a top surface 34, a bottom surface 36, and a passageway 38 having an entrance opening 40 and an exit opening 42. The passageway 38 through the body 16 includes a lower surface 44, and a recess 46 that receives the retainer 18 in the form of a retainer plate. The recess 46 has a rear wall 48 and a front wall 50 that locate the retainer plate 18 in a fore and aft manner. To locate the retainer 18 side-to-side, the body 16 also includes side slots 52 having a rear entrance 54 with a ramped upper surface 56. As the retainer 18 is inserted through the entrance opening 40 of the body 16 and into the rear entrance 54 of the side slots 52, the retainer 18 will bend slightly to allow the center of the retainer 18 to ride over the top of the rear wall 48 while the side edges of the retainer 18 engage and slide within the side slots 52 until the entire retainer 18 is beyond the rear wall 48. At this point, the retainer 18 will tend to return toward its resting condition and assume a position in the bottom of the recess 46. To prevent the potential of the rear of the retainer 18 riding up the rear wall 48 and backing out of the recess 46, as best seen in FIG. 4, the retainer 18 includes a rear edge 55 that preferably is coined or otherwise formed so as to be angled slightly downward.

Figure 7:
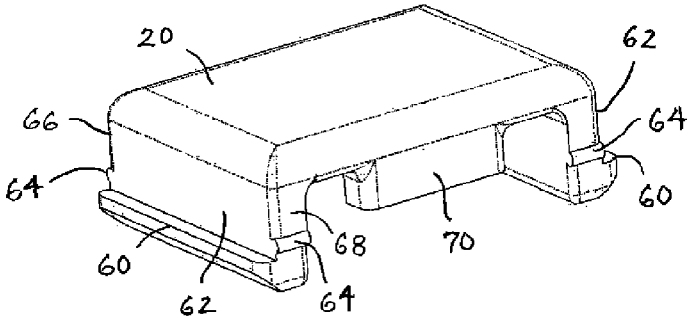
FIG. 7 is a perspective view of a compression member that is a component of the head assembly of the cable lacing tie device of FIG. 1.
Figure 8:
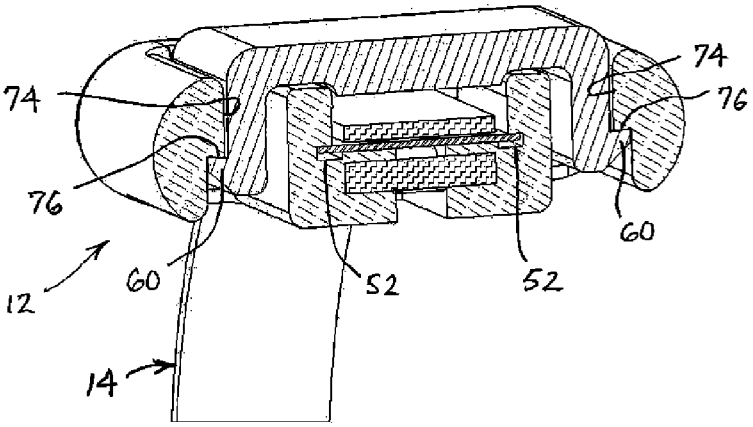
FIG. 8 is a perspective section view of the cable lacing tie device of FIG. 5 with the device being sectioned perpendicular to the lacing direction and with a simplified view of the cable lacing tape.
Figure 9:
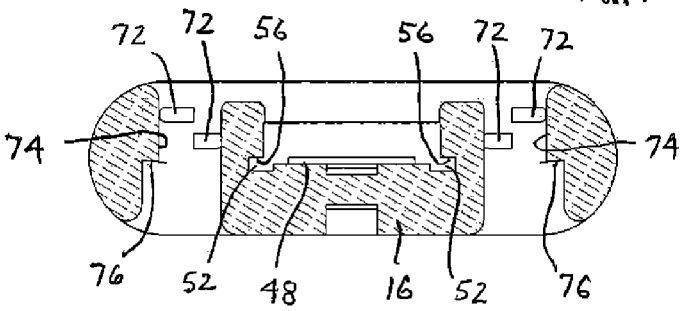
FIG. 9 is a section view of the body of the head assembly of the cable lacing tie device of FIG. 1 with the body being sectioned perpendicular to the lacing direction.
Figure 10:
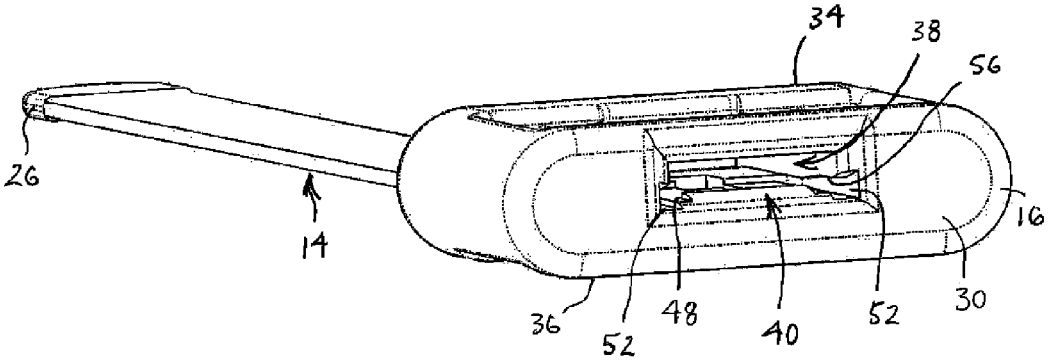
FIG. 10 is a perspective view of the cable lacing tie device of FIG. 1, without the compression member installed in the head assembly and with a simplified view of the cable lacing tape.

As best seen in FIGS. 7-9, the compression member 20 includes locking extensions 60 along its side walls 62, and detents 64 along a face of its front wall 66 and its rear wall 68. The compression member 20 also includes a downward extending rear engagement lug 70. The compression member 20 initially is disposed in a ready position in which it is held by the detents 64 on the compression member 20 being located between and engaging pairs of detents 72 within the body 16. This ready position holds the compression member 20 upward, so as not to block insertion of the cable lacing tape 14 through the entrance opening 40 in the rear surface 30 of the body 16. This allows for near zero insertion force of the cable lacing tape 14. Also, when in the ready position, the locking extensions 60 along the side walls 62 of the compression member 20 press against the vertical walls 74 within the body 16 and the side walls are deflected inward.

The cable lacing tie device 10 is easily and quickly installed. This is achieved by locating the head assembly 12 at or near a plurality of objects to be held together by the device. The second portion of the cable lacing tape 14 is then moved to a position looped around the plurality of objects, in a plane that is generally perpendicular to the longest axis of the objects, and the second portion of the cable lacing tape 14 is further moved to a position wherein it engages and is retained within the head assembly 12. In this first example, this is achieved by moving the distal or second end 28 with the tip 26 to the entrance opening 40 in the rear surface 30 of the body 16 of the head assembly 12. The tip 26 then is inserted into the entrance opening 40 and fed through the passageway 38 in the body 16 until the tip 26 extends outward and forward from the exit opening 42 in the front face 32 of the body 16. The tip 26 is then grasped and pulled until the cable lacing tape 14 has reached the desired level of tightness or tension. As the portion of the cable lacing tape 14 that is extending forward of the exit opening 42 is being pulled, a further more proximal length of the cable lacing tape 14 continues to pass through the passageway 38 and eventually the tension in the cable lacing tape 14 tends to pull the cable lacing tape 14 toward the center of the plurality of objects to be held together and therefore into more forceful engagement with the protrusions 24 extending from the retainer 18. At this point, the protrusions 24 tend to force filaments within the second portion of the braided cable lacing tape 14 to spread apart and permit the protrusions to extend between the filaments, with the retainer 18 urging a second portion of the cable lacing tape 14 into a retained position within the head assembly 12. In this example, the forward sloped angle of the protrusions 24 causes the braided filaments of the cable lacing tape 14 to become hooked on the protrusions 24. Once hooked on the protrusions 24, the protrusions 24 resist rearward movement of the second portion of the cable lacing tape 14. Thus, in the installed position, two portions of the cable lacing tape 14 are retained within the head assembly 12, with a first portion retained within the head assembly 12 in a first general direction and a second portion retained within the head assembly 12 in a second general direction, where the first and second general directions are substantially parallel.

As an added safety feature, this first example includes the compression member 20. With the cable lacing tape 14 pulled through the head assembly 12 until it has achieved the desired tension in the cable lacing tape 14, the compression member 20 then may be pressed downward. The compression member 20 is pressed until the detents 64 on the compression member 20 release from between the respective pairs of detents 72 within the body 16 of the head assembly 12. This moves the compression member 20 from its ready position and as it continues to be forced and moved toward the retainer 18, the rear engagement lug 70 presses on the cable lacing tape 14 to help ensure that the cable lacing tape 14 will remain engaged with the protrusions 24 on the retainer 18. When the locking extensions 60 on the side walls 62 of the compression member 20 reach the bottom of the vertical walls 74, the side walls 62 are permitted to expand outward to a rest position where the locking extensions 60 become located within the undercuts 76 that are located at the bottom of the vertical walls 74 of the body 16. As such, the compression member 20 has reached a locked position, further urging a second portion of the cable lacing tape 14 into a retained position within the head assembly 12 and ensuring that the cable lacing tape 14 cannot inadvertently lift away from the protrusions 24 on the retainer 18.

When in an installed, locked position, as seen in FIG. 5, the tip 26 and the distal end 28 may be tucked underneath the cable lacing tape 14 that extends around the objects being held together or bundled. Alternatively, to reduce bulk and unnecessary weight, the cable lacing tape 14 may be trimmed at the exit opening 42 or one may leave a portion extending a short distance from the exit opening 42 of the head assembly 12. Due to its braided filament structure, the reduced rigidity and relatively dull end of a trimmed cable lacing tape 14 help reduce potential abrasion among adjacent wires, wiring harnesses, cables or other objects, such as within bundling systems that are subject to movement or service activities. If one is concerned about the potential unraveling of a cut end of the cable lacing tape 14, then a suitable binding agent, such as an adhesive or glue may be used to join the separate filaments of the cut end.

Figure 12:
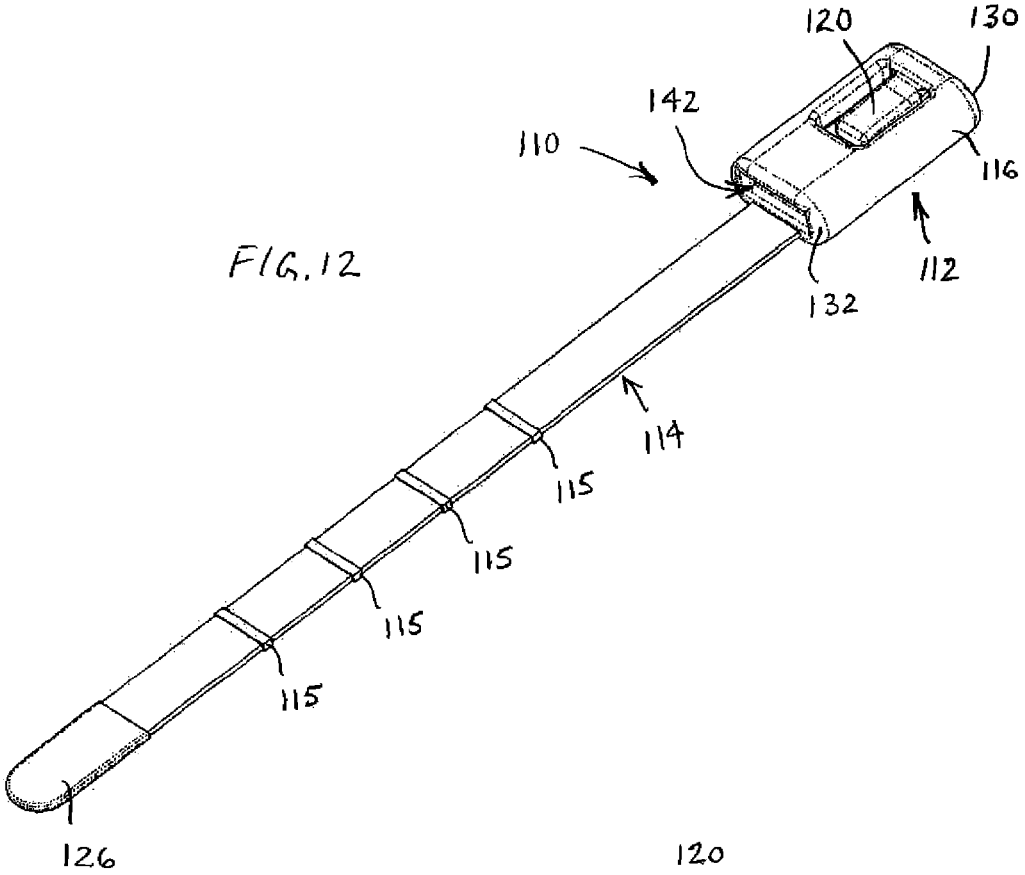
FIG. 12 is a perspective view of a second example cable lacing tie device in a pre-installed, ready position and with a simplified view of a cable lacing tape having segments.
Figure 13:
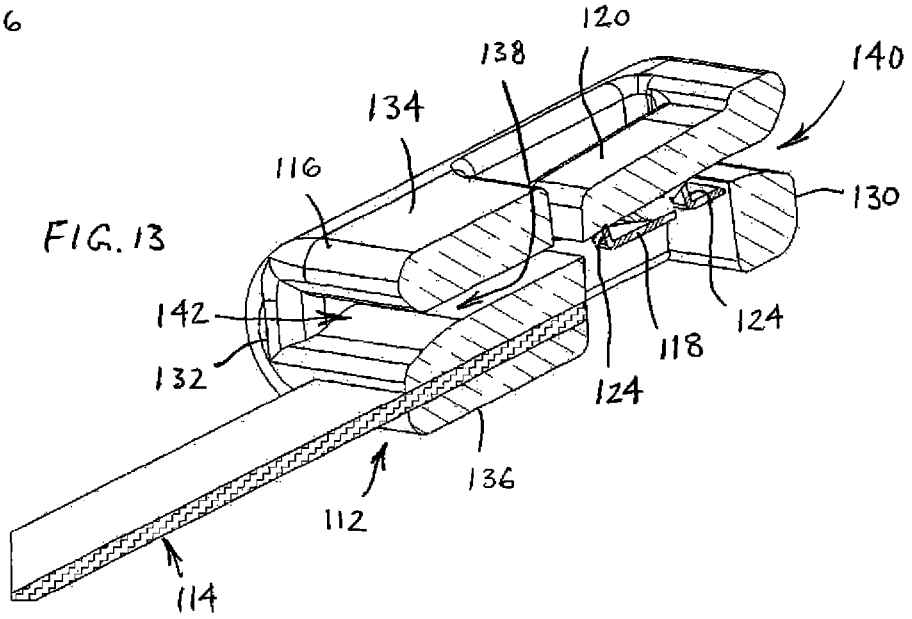
FIG. 13 is a perspective section view of the cable lacing tie device of FIG. 12 with the device being sectioned parallel to the lacing direction and with a simplified view of the cable lacing tape.

Among other variations from the first example cable lacing tie device 10, a second example cable lacing tie device 110, illustrated in FIGS. 12 and 13, includes a few alternative structures, such as a further alternative to avoiding unraveling of a cut end of an installed cable lacing tape 14 and an integrally molded compression member 120.

As shown in FIG. 12, the cable lacing tape 114 may include segments 115 at preselected positions along the length of the cable lacing tape 114, at positions that are thought to be preferable points at which to stop unraveling if the cable lacing tape 114 is cut. Such positions may be provided to permit removal of unnecessary or undesirable extra length of an installed cable lacing tape 114. The segments 115 may be molded to the cable lacing tape 114, or may be formed with other binding agents that are likely to prevent unraveling of the braided filaments of the cable lacing tape 114. The cable lacing tape 114 may be cut at any point along the portion of the cable lacing tape 114 that extends from the head assembly 112 that is more distal to at least a portion of such a segment 115. Thus, the cable lacing tape 114 is preferably cut at a point along its length that is located beyond a segment 115, so as to leave a soft end of the cable lacing tape 14 but with the assurance that it cannot unravel beyond the nearest segment 115. Alternatively, the cable lacing tape 114 could be cut through a segment 115, at a point that will leave a sufficient portion of the segment 115 to prevent the unraveling of the remaining cable lacing tape 114. It will be appreciated that such a cable lacing tape having segments may be used in any of the examples in this disclosure, and that the cable lacing tape 114 also would be of woven or braided construction but, for convenience, is illustrated in a simplified manner.

The second example cable lacing tie device 110 is otherwise constructed of similar materials and structures to that of cable lacing tie device 10, but instead of including the separate compression member 20, the device 110 includes an integrally formed compression member 120. Thus, the second example cable lacing tie device 110 includes a head assembly 112 and a length of cable lacing tape 114. The head assembly 112 includes a molded body 116, a retainer 118 shown in this example as a separate retainer plate, and an integrally formed alternative compression member 120. The head assembly 112 has a rear surface 130, a front surface 132, a top surface 134, a bottom surface 136, and a passageway 138 having an entrance opening 140 and an exit opening 142. The compression member 120 extends from the body 116. The retainer 118 is installed and held within the head assembly 112 in the same manner as described above with respect to the first example cable lacing tie device 10 by its interaction with surfaces within the body 116.

The protrusions 124 on the retainer 118 urge the second portion of the cable lacing tape 114 to be retained within the head assembly 116. In addition, in this example, the compression member 120 is biased to be disposed partially in the path of an incoming tip 126 at the second end of the cable lacing tape 114. Thus, the integrally formed compression member 120 tends to force the cable lacing tape 114 toward the retainer 118. This urges the second portion of the cable lacing tape 114 to be retained within the head assembly 112 by urging the cable lacing tape 114 to engage and be retained by the protrusions 124 on the retainer 118. Also, the tip 126 is a little longer than the tip 26 in the first example. This is intended to permit the tip 126 at the end of the cable lacing tape 114 to be inserted into the entrance opening 140 in the rear surface 130, through the passageway 138, and out the exit opening 142 in the front face 132 of the head assembly 112. The longer tip 126 is easier to grasp and manipulate as one moves it through the passageway 138 and deflects the integral compression member 120 in the body 116 of the head assembly 112 further away from the retainer 118. The tip 126 then may be grasped and pulled to advance the cable lacing tape 114 to a taught, installed position. Accordingly, this second example cable lacing tie device 110 may be installed using a similar method of holding together a plurality of objects. When in the installed position it will be appreciated that two portions of the cable lacing tape 114 are retained within the head assembly 112, with a first portion retained within the head assembly 112 in a first general direction and a second portion retained within the head assembly 112 in a second general direction, where the first and second general directions are substantially parallel.

Figure 14:
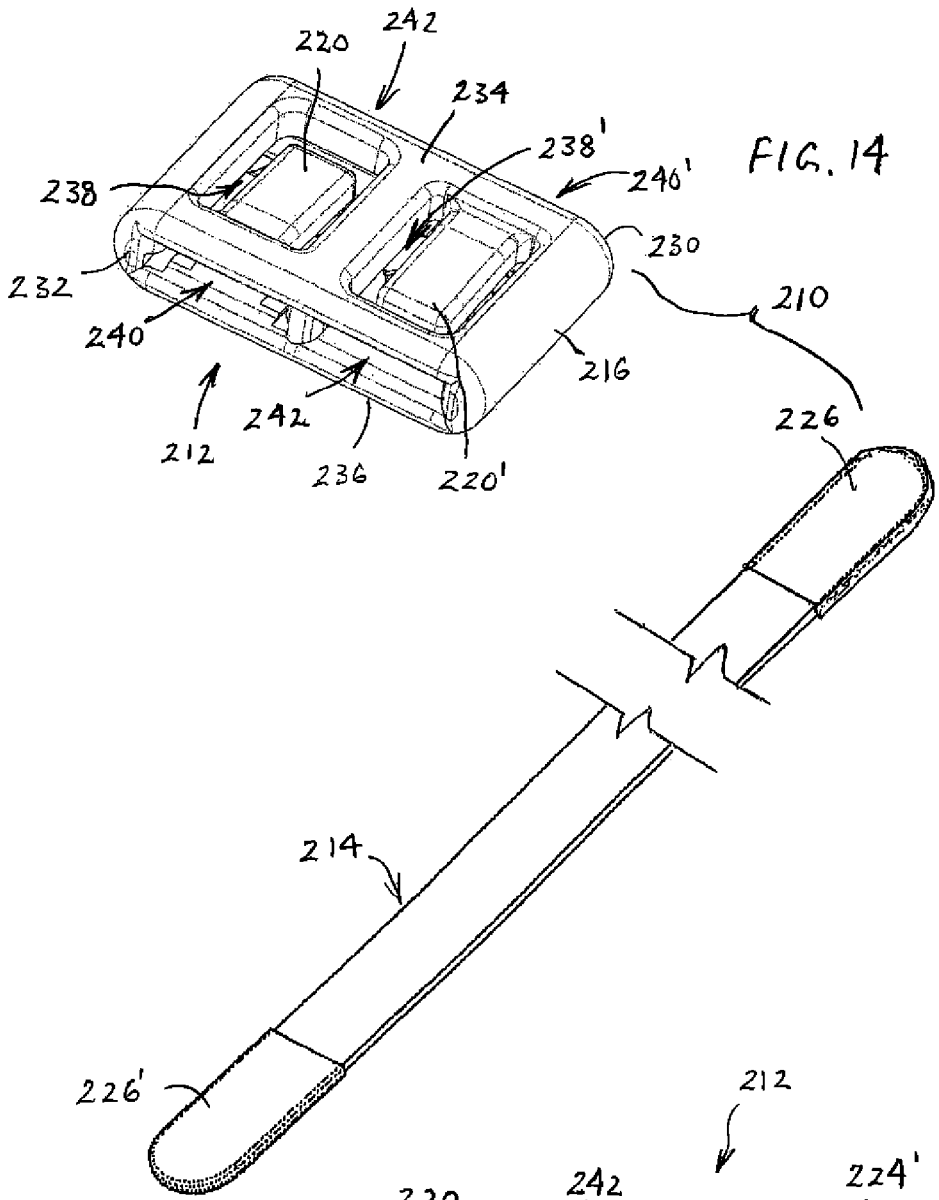
FIG. 14 is a perspective view of a head assembly and a cable lacing tape in a third example cable lacing tie device.
Figure 15:
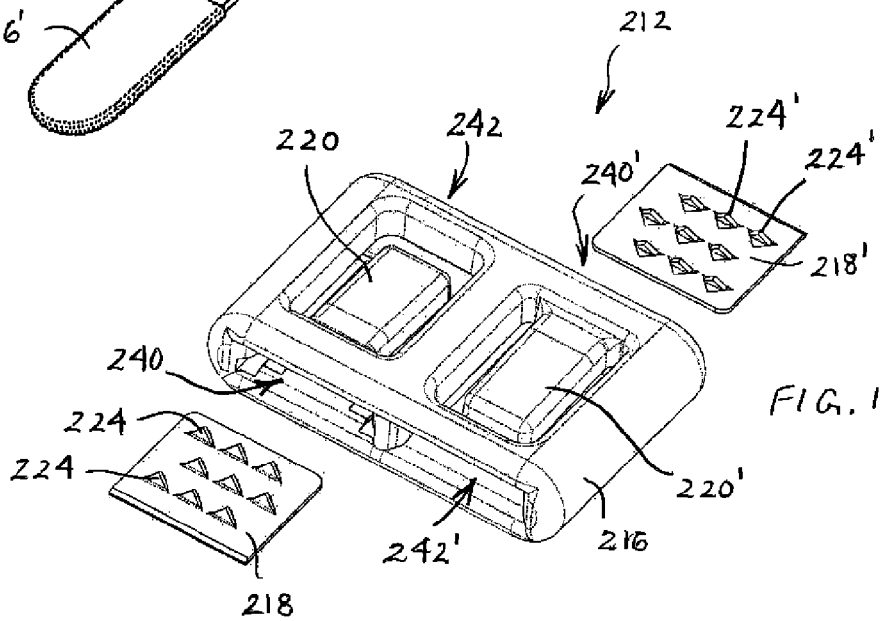
FIG. 15 is a perspective exploded view of the head assembly of FIG. 14.

Turning to FIGS. 14 and 15, a third example cable lacing tie device 210 is illustrated. This example device 210 includes a head assembly 212 that has a structure that resembles a joined pair of oppositely facing head assemblies 112 of the second example device 110, but the cable lacing tape 214 is not fixedly connected to the head assembly 212 by being insert-molded within the body 216. To be able to feed the respective ends of the length of cable lacing tape 214 through the passageways 238, 238', the cable lacing tape 214 has a tip, such as tips 226, 226' described above as being formed by insert-molding, at each end of the length of cable lacing tape 214. The head assembly 212 may be constructed of similar materials and via similar techniques to those described with respect to the prior example devices 10 and 110. The cable lacing tape 214 may be constructed similarly to either of the cable lacing tapes 14 and 114 of the prior examples, but is shown, for convenience, in a simplified manner.

The head assembly 212 includes a body 216 having a rear surface 230, a front surface 232, a top surface 234, a bottom surface 236, and passageways 238, 238' having respective entrance openings 240, 240' and exit openings 242, 242'. The head assembly 212 also includes integrally molded compression members 220, 220' that tend to force an inserted cable lacing tape 214 toward respective retainers 218, 218', in the form of respective retainer plates, with each being installed and held within the head assembly 212 in the same manner as described with respect to the first and second example cable lacing tie devices 10, 110. The retainers 218, 218' are configured as described in relation to the previous examples and have protrusions 224, 224', which act to urge the cable lacing tape 214 to be retained within the head assembly 212.

The head assembly 212 is used in a manner similar to the previous examples, however, as noted above, the cable lacing tape 214 is not molded within the head assembly 212. Instead, a first portion of the cable lacing tape 214 is retained in a first position within the head assembly 212 by inserting the first end with tip 226 through one of the passageways, such as passageway 238, to secure a first portion within the head assembly 212. Then, the head assembly 212 and cable lacing tape 214 may be treated in a manner similar to the previous examples to hold together a plurality of objects by locating the head assembly at or near the plurality of objects, moving a second portion of the cable lacing tape 214 to a position looped around the plurality of objects, and then moving the second portion of the cable lacing tape 214 to a position wherein the second portion of the cable lacing tape engages and is retained within the head assembly 212. This is accomplished by inserting the tip 226' at the second end of the cable lacing tape through the second passageway 238'. Either or both of the ends of the cable lacing tape 214 then may be pulled to tighten the cable lacing tie device 210 around the plurality of objects. Thus, when installed, first and second portions of the cable lacing tape 214 are retained within the head assembly 212, with a first portion retained in a first general direction and a second portion retained within the head assembly 212 in a second general direction, where the first and second general directions are substantially parallel. Also, optionally, any excess length of cable lacing tape extending from the respective exit openings 242, 242' may be removed by cutting the cable lacing tape 214, if desired.

It is contemplated that the tip 226 on a first end of the cable lacing tape 214 may be inserted into the entrance opening 240 and moved through the passageway 238 only as far as is necessary to have the tip 226 on the first end of the cable lacing tape extend from the exit opening 242. Using this method, any cutting along the length of a preformed cable lacing tape having a tip at each end could be confined to an optional single cut to remove any excess cable lacing tape from the second end after it is inserted and moved through the passageway 238' and extends from the exit opening 242'. Also, with the third example cable lacing tie device 210, any of the aforementioned structures and methods of controlling potential unraveling of the braided filament cable lacing tape 214 may be employed, if desired.

A fourth example cable lacing tie device 310 is illustrated in FIGS. 16 and 17. The cable lacing tie device 310 includes a head assembly 312 and a cable lacing tape 314 that is configured to have a first portion 322 retained in a first position within the head assembly 312 by having a first end insert-molded to a body 316 of the head assembly 312. The body 316 has a rear surface 330, a front surface 332, a top surface 334, a bottom surface 336, and a passageway 338 having an entrance opening 340 and an exit opening 342. The passageway 338 through the body 316 includes a retainer 318 shown in this example in the form of an integral retainer formed along a surface within the body 316, although it will be appreciated that a separate inserted retainer may be utilized. In this example, the integral retainer 318 includes upstanding protrusions 324 and the cable lacing tie device 310 does not include a compression member. The protrusions 324 permit the retainer 318 to urge the second portion of the cable lacing tape 314 to engage and be retained in the head assembly 312. The head assembly 312 also may be constructed using similar materials and techniques to those described with respect to the prior examples. While the cable lacing tape 314 may be constructed similarly to the prior examples, it is shown without an insert-molded tip at the distal or second end 328, as the tip is optional.

The cable lacing tie device 310 is easily and quickly installed. This is achieved by having a first portion 322 of the cable lacing tape 314 retained within the head assembly 312 and by locating the head assembly 312 at or near a plurality of objects to be held together by the device 310. The second portion of the cable lacing tape 314 that extends from the head assembly 312 then is moved to a position looped around the plurality of objects, in a plane that is generally perpendicular to the longest axis of the objects, and the second portion of the cable lacing tape 314 is moved to a position wherein the second portion is retained within the head assembly 312. This is achieved by moving the distal or second end 328 to the entrance opening 340 in the rear surface 330 of the body 316 of the head assembly 312, inserting the second end 328 into the entrance opening 340 and feeding the second end 328 through the passageway 338 in the body 316 until the second end 328 extends outward from the exit opening 342 in the front face 332 of the body 316. While the cable lacing tape 314 should be able to pass through the passageway 338 without difficulty even without a tip at the second end 328, if the cable lacing tape 314 is not sufficiently stiff, then when inserting the second end 328 into the entrance opening 340, it may be necessary to loop the cable lacing tape 314 upward, out of the passageway 338. As the second end 328 begins to extend over the protrusions 324 on the retainer 318, an ease of grasping the second end 328 and directing it up and over the protrusions 324 may be provided with an opening 343 in the top surface 334. The second end 328 of the cable lacing tape 314 then may be directed back downward into the passageway 338 and through the exit opening 342.

Once the second end 328 is extending out from the exit opening 342, it then may be grasped and pulled. As the portion of the cable lacing tape 314 that is extending from the exit opening 342 is being pulled, a further more proximal portion of the cable lacing tape 314 continues to pass through the passageway 338 and eventually the tension in the cable lacing tape 314 tends to pull the cable lacing tape 314 toward the center of the group of the plurality of objects to be held together and into engagement with the protrusions 324 extending from the retainer plate 318, until the cable lacing tape 314 has reached the desired level of tightness or tension. At this point, the protrusions 324 tend to force filaments to spread apart and permit the protrusions 324 to extend between filaments within the braided cable lacing tape 314. The upright protrusions 324 in this example cause the braided filaments of the cable lacing tape 314 to become hooked on the protrusions 324. Once hooked on the protrusions 324, the protrusions 324 resist rearward movement of the cable lacing tape 314. Accordingly, when installed, first and second portions of the cable lacing tape 314 are retained within the head assembly 312, with a first portion retained in a first general direction and a second portion retained within the head assembly 312 in a second general direction, where the first and second general directions are substantially parallel.

When in this installed, locked position, the free second end 328 may be tucked underneath the cable lacing tape 314 that extends around the objects being bundled, as could be done with any of the other examples disclosed herein. Alternatively, to reduce bulk and unnecessary weight, the cable lacing tape 314 may be trimmed at the exit opening 342 or so as to leave a portion extending a short distance from the exit opening 342 of the head assembly 312. Due to its braided filament structure, the reduced rigidity and relatively dull end of a trimmed cable lacing tape 314 helps reduce potential abrasion among adjacent wires, wiring harnesses, cables or other objects within systems, such as bundling systems that are subject to movement or service activities. If one is concerned about potential unraveling of the cable lacing tape 314, then any of the previously discussed structures and methods may be employed.

As an added safety feature, this method of installation may include application of a binding agent, such as a glue or adhesive, within the opening 343 in the top surface 334 of the body 316. Application of a binding agent to the cable lacing tape 314, in this location, can serve to prevent unraveling of the braided filaments of the cable lacing tape 314 if a length of the cable lacing tape 314 is removed from where it extends outward from the exit opening 342, and may serve to bind the cable lacing tape 314 to the integrally formed retainer 318. Thus, with the cable lacing tape 314 pulled through the head assembly 312 until it has achieved the desired tension in the cable lacing tape 314, the protrusions 324 will prevent the rearward movement and withdrawal of the cable lacing tape 314, thereby urging the second portion of the cable lacing tape 314 to be retained within the head assembly 312. If applying a binding agent to the cable lacing tape 314 within the opening 343, it is preferable to do so prior to optionally cutting away any excess length of cable lacing tape 314 that extends from the exit opening 342.

Figure 18:
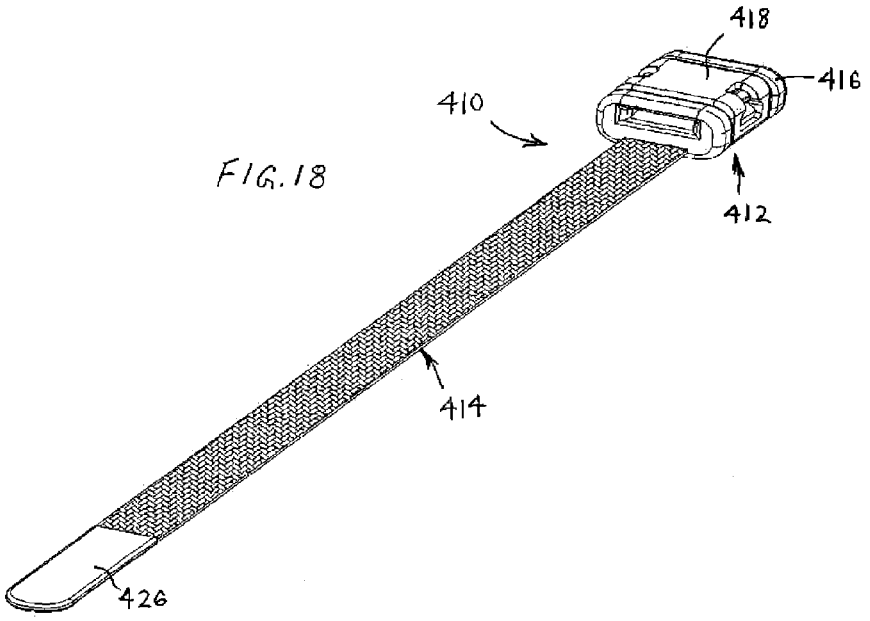
FIG. 18 is a perspective view of a fifth example cable lacing tie device having a retainer in a locked position.
Figure 19:
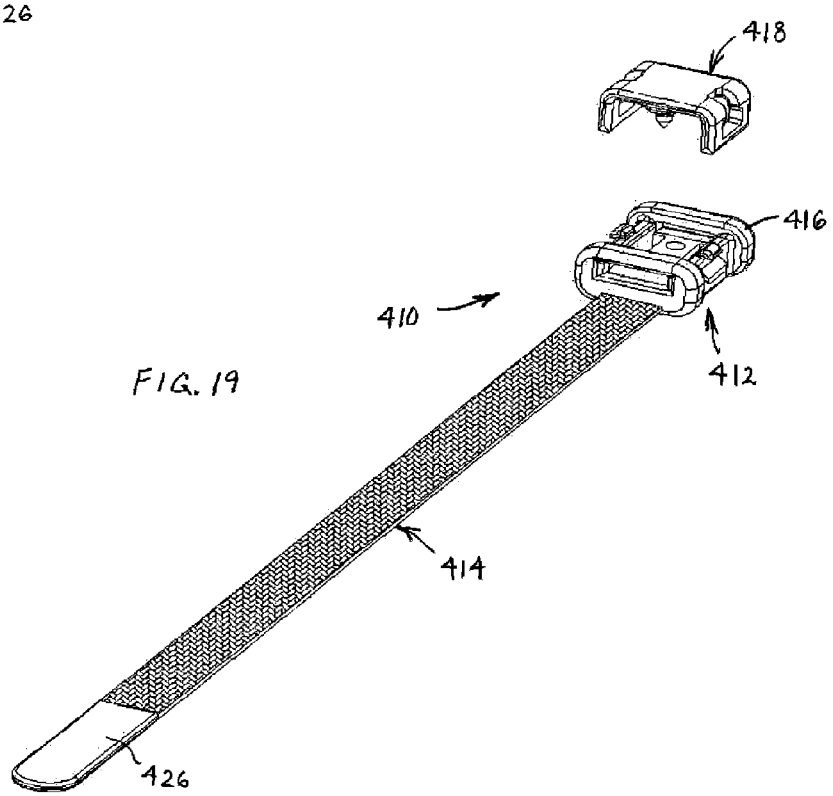
FIG. 19 is a perspective partially exploded view of the cable lacing tie device of FIG. 18.
Figure 20:
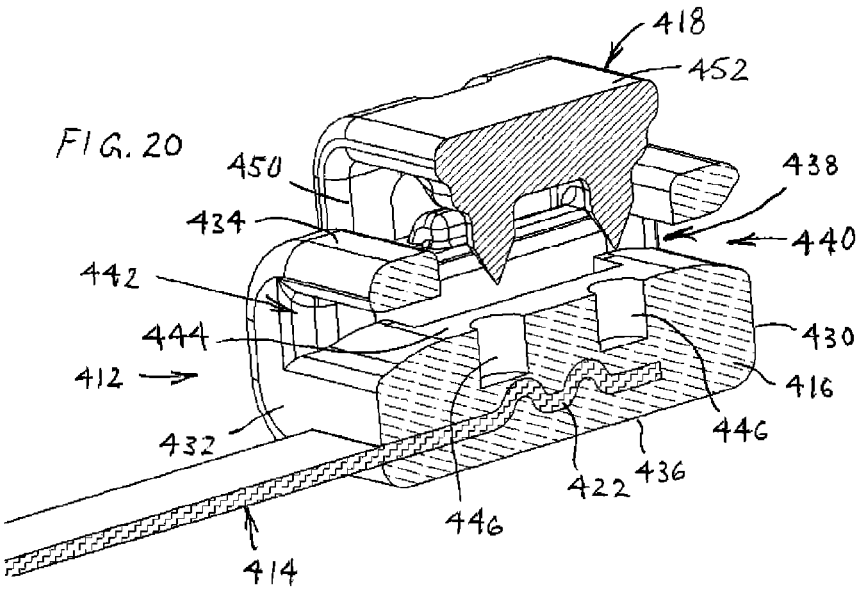
FIG. 20 is a perspective section view of the cable lacing tie device of FIG. 18 having the retainer in an unlocked, ready position, with the device being sectioned parallel to the lacing direction and with a simplified view of the cable lacing tape.
Figure 21:
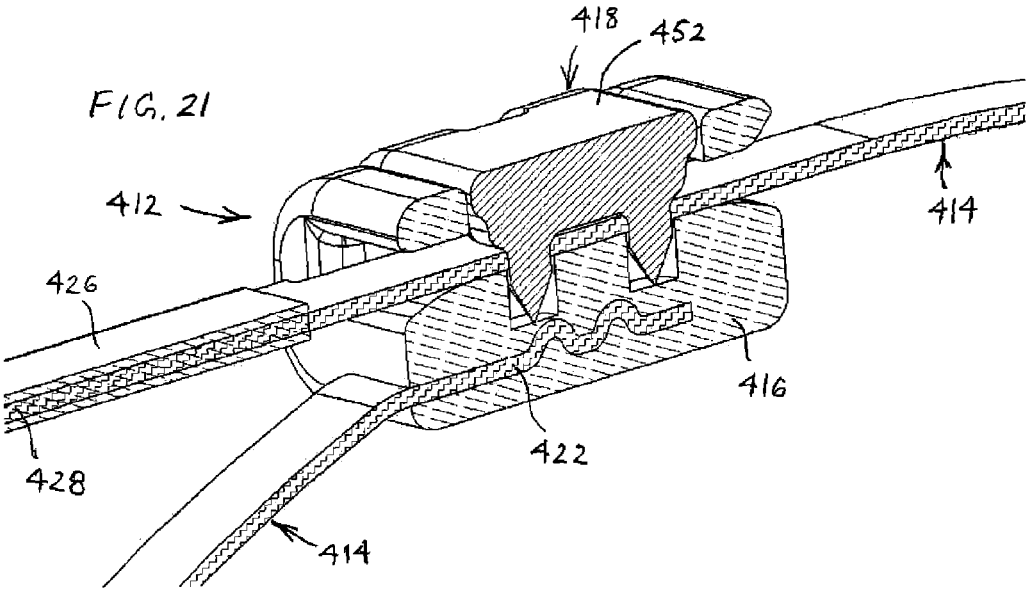
FIG. 21 is a perspective section view of the cable lacing tie device of FIG. 18 having the retainer in a locked position, with the device being sectioned parallel to the lacing direction and with a simplified view of the cable lacing tape.
Figure 22:
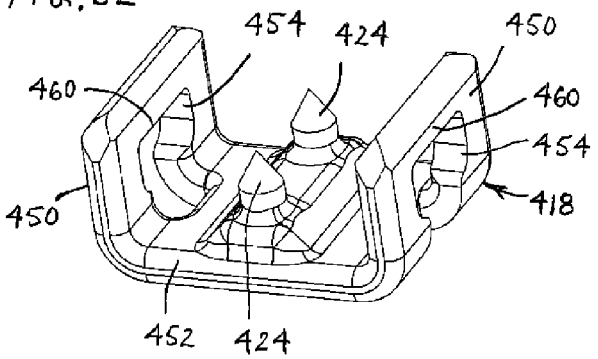
FIG. 22 is a perspective view of the retainer of the cable lacing tie device of FIG. 18 in an inverted position.
Figure 23:
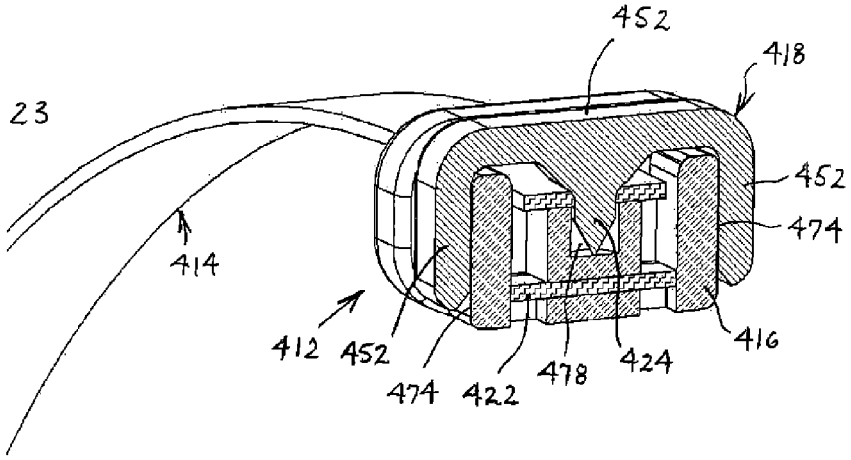
FIG. 23 is a perspective section view of the cable lacing tie device of FIG. 18 having the retainer in a locked position, with the device being sectioned through a protrusion on the retainer and perpendicular to the lacing direction and with a simplified view of the cable lacing tape.

Turning to FIGS. 18-24, a fifth example cable lacing tie device 410 is illustrated. The cable lacing tie device 410 includes a head assembly 412 and a length of cable lacing tape 414 that may be constructed using similar materials and techniques to those described in the prior examples. The head assembly 412 of this example includes a molded body 416 and a retainer 418 in the form of a generally U-shaped cap. A first portion 422 of the cable lacing tape 414 is configured to be retained in a first position within the head assembly 412 by having a first end insert-molded within the body 416 in a tortuous path for enhanced retention, as best seen in FIGS. 20 and 21. As with the prior examples, a tip 426 is molded to the distal or second end 428 of the cable lacing tape 414 that extends from the head assembly 412, as best seen in FIGS. 18 and 21. As with the prior examples, the cable lacing tie device 410 may be used, for example, to hold together a plurality of objects, such as to form or contain a bundle of wires, wire harnesses, cables or other objects.

As best seen in FIG. 20, the body 416 of the head assembly 412 has a rear surface 430, a front surface 432, a top surface 434, a bottom surface 436, and a passageway 438 having an entrance opening 440 and an exit opening 442. The passageway 438 through the body 416 includes a lower surface 444, and a pair of recesses 446 that receive the protrusions 424 of the retainer 418. The recesses 446 provide additional support for the protrusions 424 against the force that may be imparted by tension in the cable lacing tape 414.

The retainer 418, in this example shown in the form of a U-shaped cap, may be molded of similar materials and by similar techniques to those used to form the body 416 to which the retainer 418 is connected. The retainer 418 includes a pair of side walls 450 connected by an upper portion 452. The side walls 450 include openings 454, which form locking extensions 460 that extend in the direction of the cable lacing tape 414 along the lower end of the side walls 450. The body 416 of the head assembly 412 includes a narrowed central portion having spaced vertical walls 474. The side walls 450 of the retainer 418 are positioned to cooperated with and slide along the spaced vertical walls 474 of the narrowed central portion of the body 416.

The vertical walls 474 have first ramped extensions 465 that provide undercuts 466 located at the top of the vertical walls 474 of the body 416, and second ramped extensions 475 that provide undercuts 476 located along the middle of vertical walls 474 of the body 416. The ramped extensions 465, 475 are configured to cause the side walls 450 of the retainer 418 to be forced outward as the retainer 418 is moved by a user, such as when pressing the retainer 418 toward the body 416. The side walls 450 and their respective locking extensions 460 slide along the vertical walls 474, such that the retainer 418 can cooperate with the ramped extensions 465, 475. Thus, to install the retainer 418 in a ready position, such as is shown in FIG. 20, the retainer 418 may be moved to have the locking extensions 460 engage and ride over the first ramped extensions 465, thereby coming to rest between the first and second ramped extensions 465, 475, and against the undercuts 466. The cable lacing tie device 410 could be manufactured and distributed in such a ready position.

Figure 24:
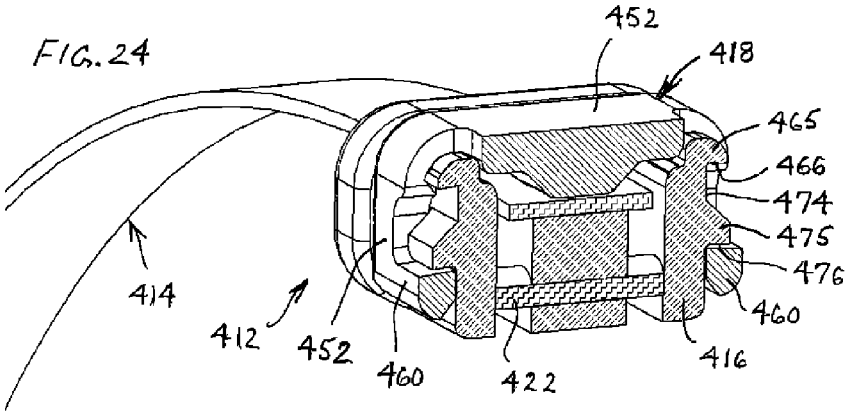
FIG. 24 is a perspective section view of the retainer of the cable lacing tie device of FIG. 18 having the retainer in a locked position, with the device being sectioned through the retainer and perpendicular to the lacing direction, and with a simplified view of the cable lacing tape.

The cable lacing tie device 410 may be installed using the same steps as were described with the prior examples. Thus, when installing a cable lacing tie device 410, once a second portion of a cable lacing tape 414 is looped around a plurality of objects to be held together and is passed through the passageway 438 in the body 416 of the head assembly 412, the retainer 418 may be moved to a locked position to urge the second portion of the cable lacing tape to engage and be retained within the head assembly 412, as best seen in FIG. 21. It will be appreciated that when the retainer 418 is moved toward the locked position, the ramped extensions 475 cause the side walls 450 of the retainer 418 to be forced outward as the retainer 418, until the locking extensions 460 ride over the ramped extensions 475 and reach a locked position with the locking extensions 460 coming to rest against the undercuts 476, as best seen in FIG. 24.

To retain the second portion of the cable lacing tape 414 in the head assembly, the retainer 418 also has a pair of protrusions 424 extending from the underside of the upper portion 452. The retainer protrusions 424 are configured to engage the second portion of the cable lacing tape 414 that is moved to a position extending through the head assembly 412. As with the protrusions of the prior examples, when the retainer 418 is moved to a locked position, the protrusions 424 tend to force filaments within the second portion of the braided cable lacing tape 414 to spread apart and permit the protrusions to extend between the filaments. The protrusions 424 cause the braided filaments of the cable lacing tape 414 to become hooked on the protrusions 424. Once hooked on the protrusions 424, the protrusions 424 resist rearward movement of the second portion of the cable lacing tape 414. Thus, in the installed and locked position, two portions of the cable lacing tape 414 are retained within the head assembly 412, with a first portion retained within the head assembly 412 in a first general direction and a second portion retained within the head assembly 412 in a second general direction, where the first and second general directions are substantially parallel. The excess cable lacing tape 414 extending from the head assembly 412 may be cut away, if desired, and unraveling may be prevented by use of any of the previously described structures and methods.

Figure 27:
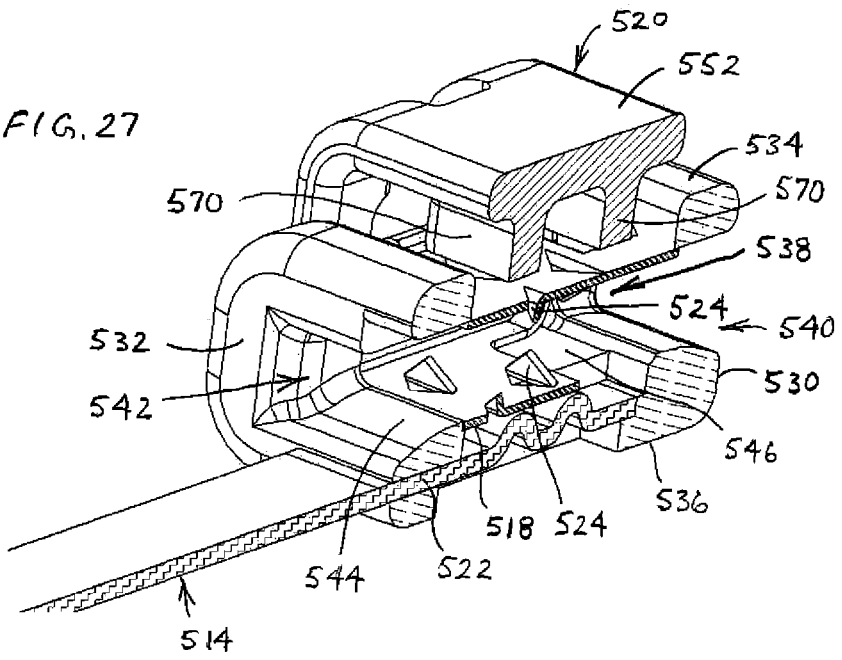
FIG. 27 is a perspective section view of the cable lacing tie device of FIG. 25 having the compression member in an unlocked, ready position, with the device being sectioned parallel to the lacing direction and with a simplified view of the cable lacing tape.
Figure 28:
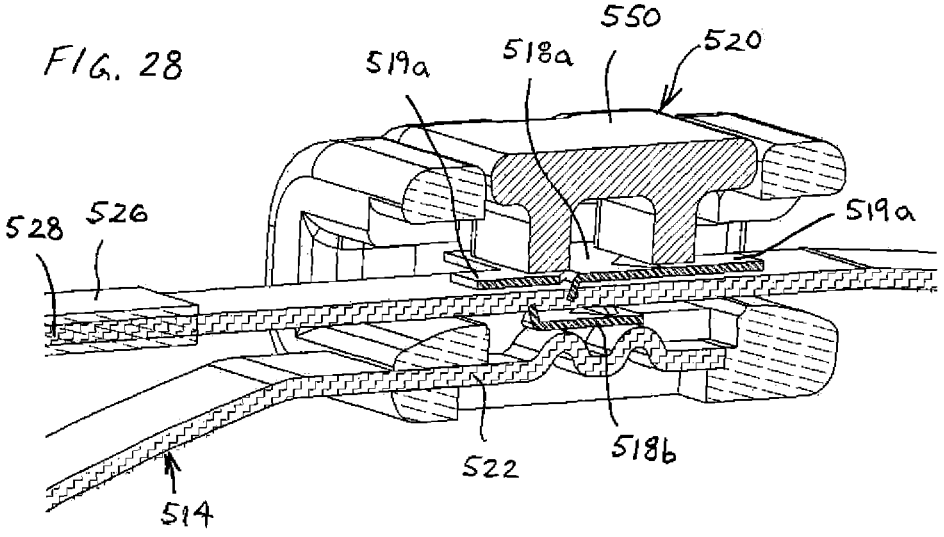
FIG. 28 is a perspective section view of the cable lacing tie device of FIG. 25 having the compression member in a locked position, with the device being sectioned parallel to the lacing direction and with a simplified view of the cable lacing tape.
Figure 29:
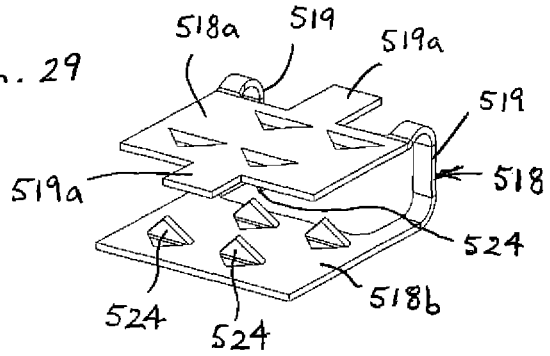
FIG. 29 is a perspective view of a retainer that is a component of the head assembly of the cable lacing tie device of FIG. 25.
Figure 30:
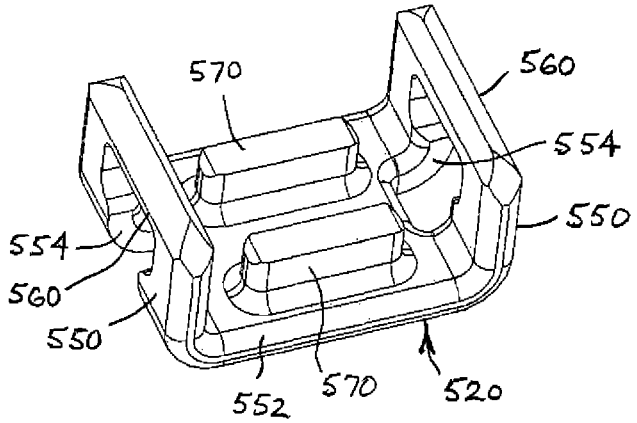
FIG. 30 is a perspective view of the compression member of the cable lacing tie device of FIG. 25 in an inverted position.

A sixth example cable lacing tie device 510 is illustrated in FIGS. 25-31. The cable lacing tie device 510 includes a head assembly 512 and a length of cable lacing tape 414 that may be constructed using similar materials and techniques to those described in the prior examples. The head assembly 512 of this example includes a molded body 516 and a retainer 518. As best seen in FIG. 29, the retainer 518 has a generally U-shaped structure that effectively provides upper and lower retainer plates **518*a* and 518*b*, that are structurally similar to the retainer 18 of the first example cable lacing tie device 10. Thus, each of the retainer plates 518*a*, 518*b* includes protrusions 524 that are formed, such as by stamping, to be forward sloped, so as to be able to separate and move between and hook the braided filaments of the cable lacing tape 514 and to resist rearward movement of the cable lacing tape 514, thereby urging a second portion of the cable lacing tape 514 to be retained within the head assembly 512**.

Figure 25:
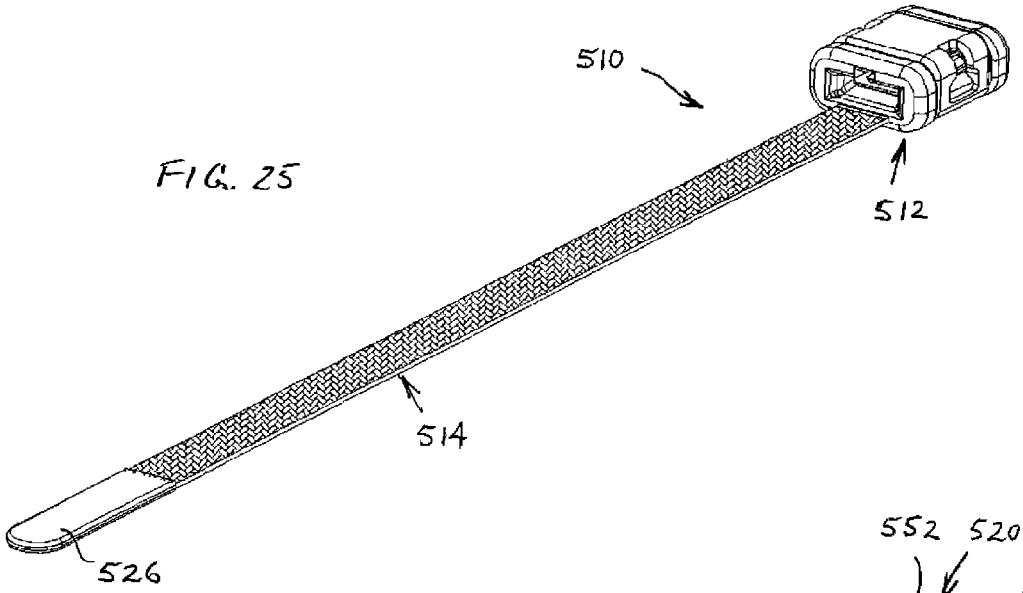
FIG. 25 is a perspective view of a sixth example cable lacing tie device having a compression member in a locked position.
Figure 26:
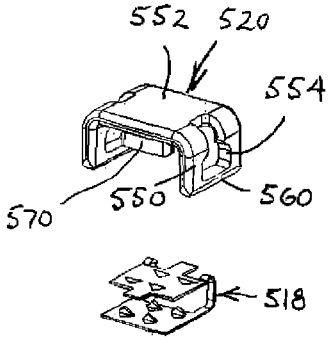
FIG. 26 is a perspective partially exploded view of the cable lacing tie device of FIG. 25.
Figure 26:
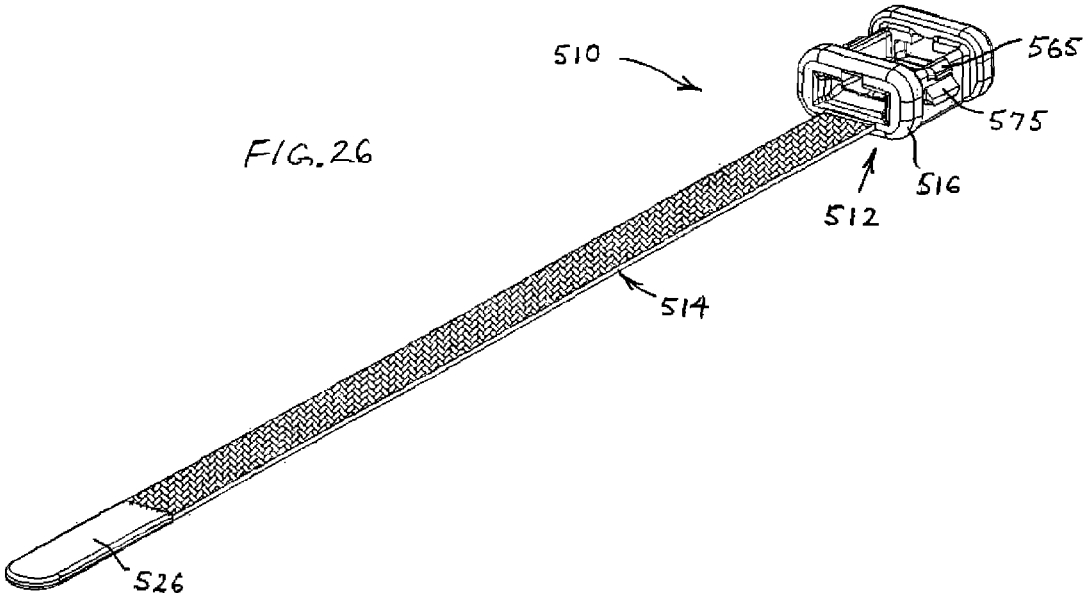

A first portion 522 of the cable lacing tape 514 is configured to be retained in a first position within the head assembly 512 by having a first end insert-molded within the body 516 in a tortuous path for enhanced retention, as best seen in FIGS. 27 and 28. A length of the cable lacing tape 514 then extends from the front of the head assembly 512. As with the prior examples, a tip 526 is molded to the distal or second end 528 of the cable lacing tape 514 that extends from the head assembly 512, as best seen in FIGS. 25 and 28. Similarly to the prior examples, the cable lacing tie device 510 may be used, for example, to hold together a plurality of objects, such as to form or contain a bundle of wires, wire harnesses, cables or other objects.

As best seen in FIG. 27, the body 516 of the head assembly 512 has a rear surface 530, a front surface 532, a top surface 534, a bottom surface 536, and a passageway 538 having an entrance opening 540 and an exit opening 542. The passageway 538 through the body 516 includes a lower surface 544 and a recess 546 that receives the lower retainer plate 518*b* of the retainer 518. The recess 546 has a front wall 548 that engages a front edge of the lower retainer plate 518*b*. The retainer 518 includes vertical strips 519 that connect the upper and lower retainer plates 518*a*, 518*b* and that engage inner surfaces of a rear wall within the body 516 of the head assembly 512. The upper retainer plate 518*a* also includes extensions 519*a* that engage inner surfaces of an upper wall within the body 516. These engagement surfaces serve to locate the retainer 518 when the retainer 518 is installed in the body 516 of the head assembly 512 by inserting it through the exit opening 542 and allowing the resilience of the retainer 518 to hold itself in place. The retainer 518 may be constructed of the same materials and by similar techniques to those used for the retainer 18 of the first example.

The head assembly 512 of this example includes a compression member 520. The compression member 520 is constructed somewhat similarly to the retainer 418, in that it is in the form of a U-shaped cap and may be molded of similar materials and by similar techniques to those used to form the body 516 to which the compression member 520 is connected. The compression member 520 includes a pair of side walls 550 connected by an upper portion 552. The side walls 550 include openings 554, which form locking extensions 560 that extend in the direction of the cable lacing tape 514 along the lower end of the side walls 550. The compression member 520 also includes a pair of downward extending engagement lugs 570 that are positioned for engagement with the upper retainer plate 518*a* of the retainer 518. The body 516 of the head assembly 512 includes a narrowed central portion having spaced vertical walls 574, somewhat like the spaced vertical walls 474 of the body 416. The side walls 550 of the compression member 520 are positioned to cooperate with and slide along the spaced vertical walls 574 of the narrowed central portion of the body 516.

The vertical walls 574 have first ramped extensions 565 that provide undercuts 566 located at the top of the vertical walls 574 of the body 516, and second ramped extensions 575 that provide undercuts 576 located along the middle of vertical walls 574 of the body 516. The ramped extensions 565, 575 are configured to cause the side walls 550 of the compression member 520 to be forced outward as the compression member 520 is moved by a user, such as when pressing the compression member 520 toward the body 516. The side walls 550 and their respective locking extensions 560 slide along the vertical walls 574, such that the compression member 520 can cooperate with the ramped extensions 565, 575. To install the compression member 520 in a ready position, such as is shown in FIG. 27, the compression member 520 may be moved to have the locking extensions 560 engage and ride over the first ramped extensions 565, thereby coming to rest between the first and second ramped extensions 565, 575, and against the undercuts 566. The cable lacing tie device 510 could be manufactured and distributed in such a ready position.

Figure 31:
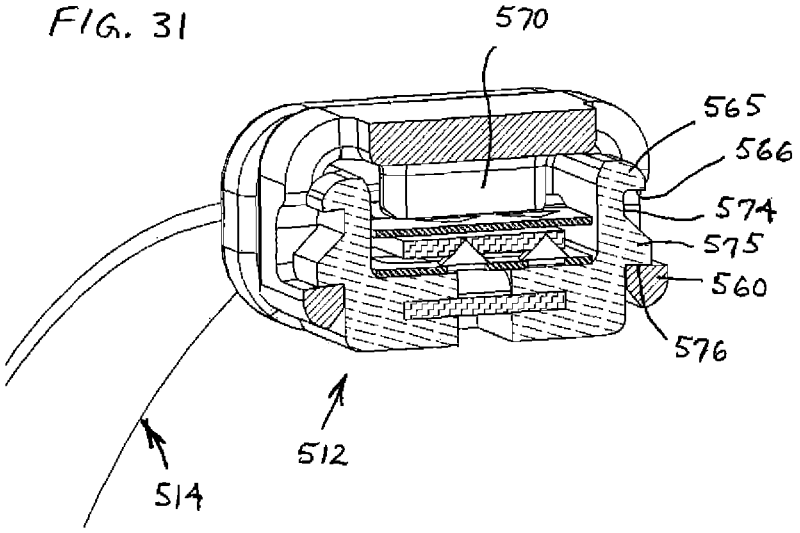
FIG. 31 is a perspective section view of the cable lacing tie device of FIG. 25 having the compression member in a locked position, with the device being sectioned through the compression member and perpendicular to the lacing direction, and with a simplified view of the cable lacing tape.
Figure 32:
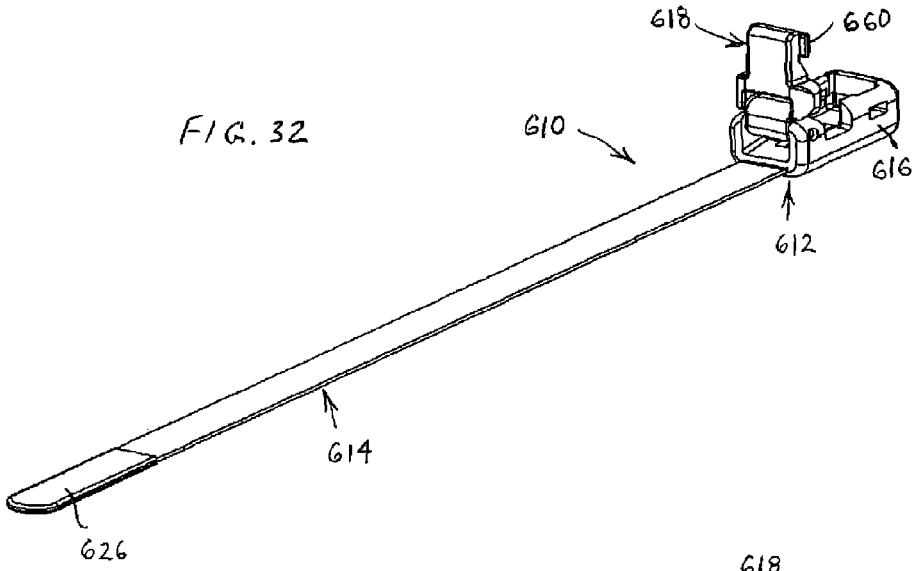
FIG. 32 is a perspective view of a seventh example cable lacing tie device having a compression member in an unlocked, ready position and with a simplified view of the cable lacing tape.
Figure 33:
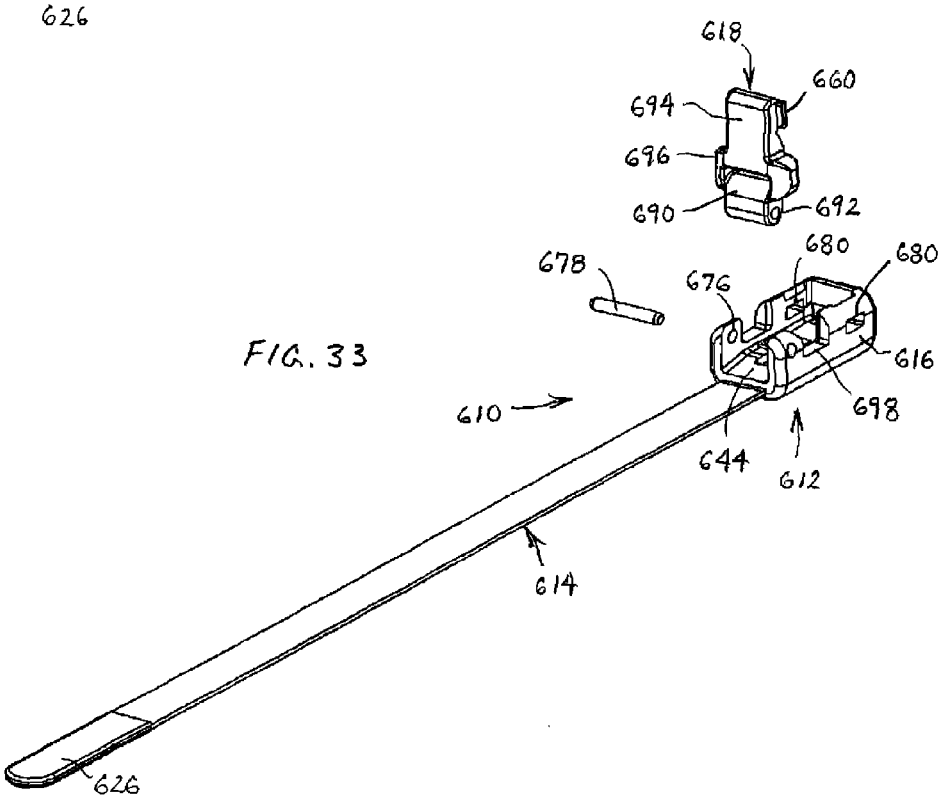
FIG. 33 is a perspective partially exploded view of the cable lacing tie device of FIG. 32.

With the compression member 520 in the ready position, the cable lacing tie device 510 may be installed using the same steps as were described with the prior examples. Thus, when installing a cable lacing tie device 510, once a second portion of a cable lacing tape 514 is looped around a plurality of objects to be held together and is passed through the passageway 538 in the body 516 of the head assembly 512, the compression member 520 may be moved to a locked position, such as shown in FIG. 28, in which the engagement lugs 570 engage the upper retainer plate 518*a* of the retainer 518 and force the upper retainer plate 518*a* toward the lower retainer plate 518*b*, so as to urge the second portion of the cable lacing tape 614 to engage and be retained within the head assembly 512. It will be appreciated that when the compression member 520 is moved toward the locked position, the ramped extensions 575 cause the side walls 550 of the compression member 520 to be forced outward until the locking extensions 560 ride over the ramped extensions 575 and reach a locked position with the locking extensions 560 coming to rest against the undercuts 576, as best seen in FIG. 31. Thus, in the installed and locked position, two portions of the cable lacing tape 514 are retained within the head assembly 512, with a first portion retained within the head assembly 512 in a first general direction and a second portion retained within the head assembly 512 in a second general direction, where the first and second general directions are substantially parallel. As with the prior examples, the excess cable lacing tape 514 extending from the head assembly 512 may be removed and, if desired, unraveling may be prevented by employing any of the previously described structures or methods.

Figure 36:
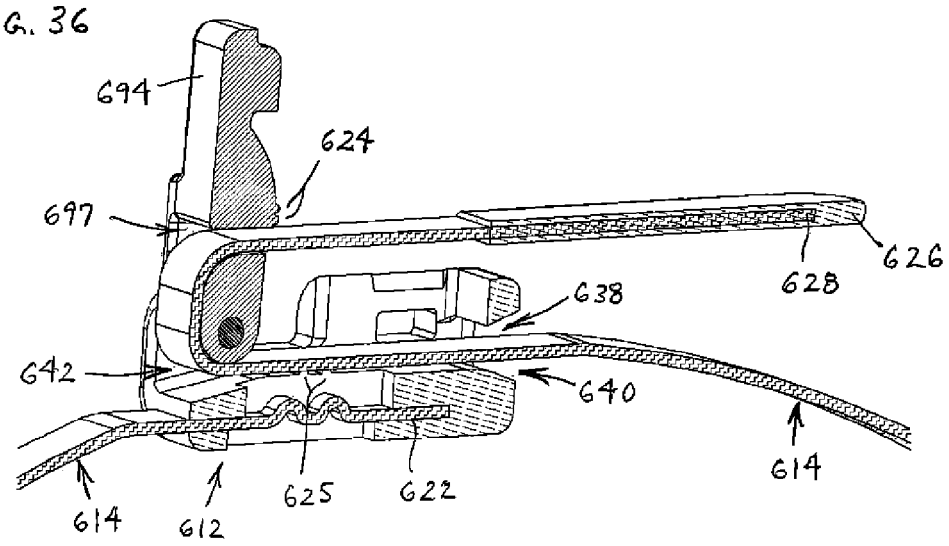
FIG. 36 is a perspective section view of the cable lacing tie device of FIG. 32 having the compression member in an unlocked, ready position and the cable lacing tape being passed through the head assembly and around the compression member, with the device being sectioned parallel to the lacing direction and with a simplified view of the cable lacing tape.
Figure 37:
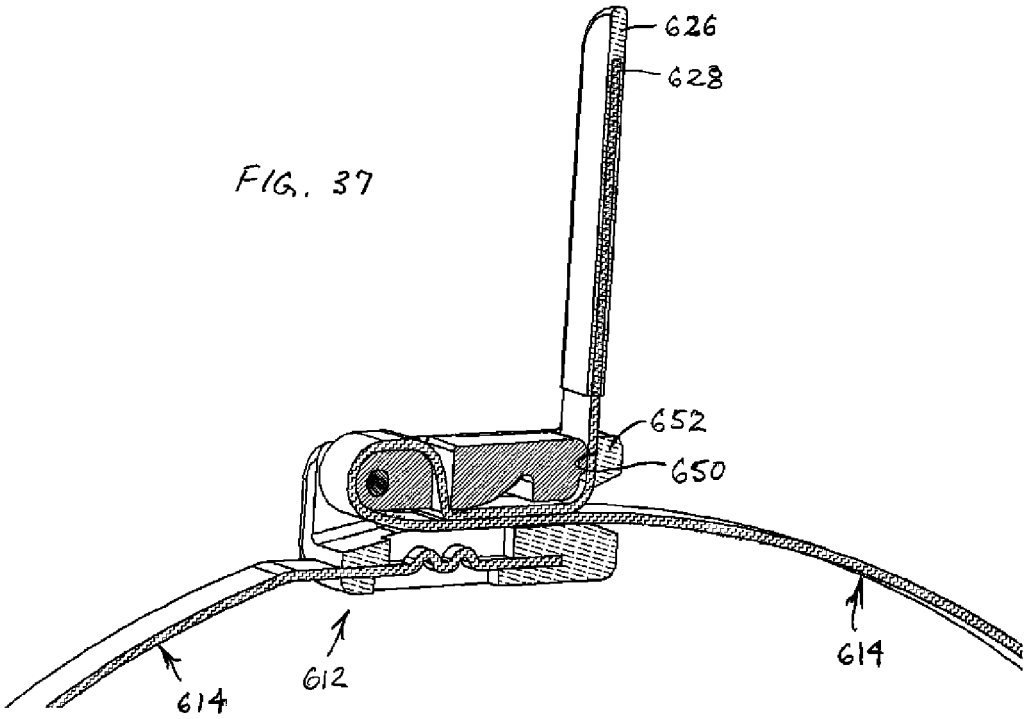
FIG. 37 is a perspective section view of the cable lacing tie device of FIG. 32 having the compression member in a locked position and the cable lacing tape being passed through the head assembly and around the compression member, with the device being sectioned parallel to the lacing direction and with a simplified view of the cable lacing tape.
Figure 38:
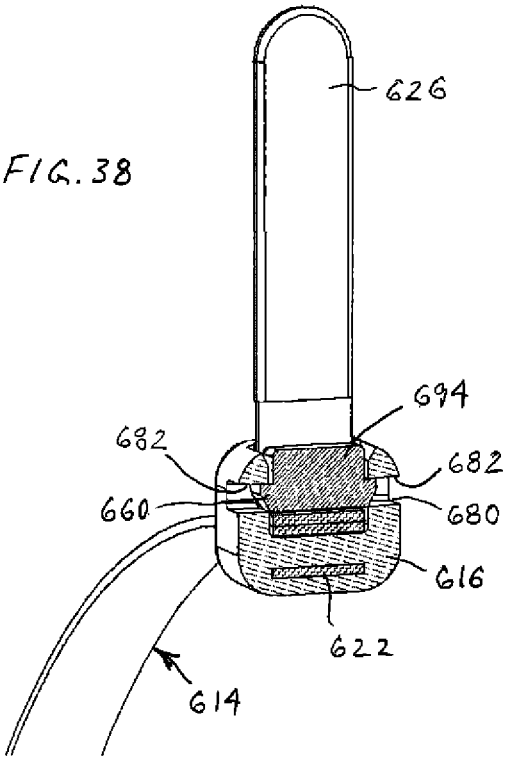
FIG. 38 is a perspective section view of the cable lacing tie device of FIG. 32 having the compression member in a locked position, with the device being sectioned through the compression member at a latch and perpendicular to the lacing direction, and with a simplified view of the cable lacing tape.
Figure 39:
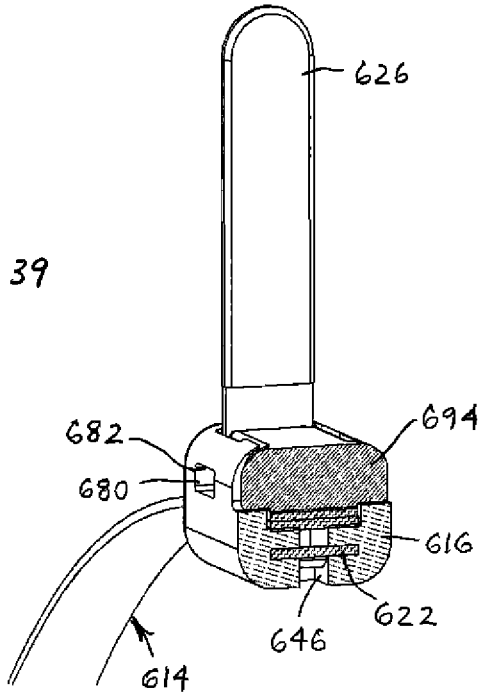
FIG. 39 is a perspective section view of the cable lacing tie device of FIG. 32 having the compression member in a locked position, with the device being sectioned through the compression member and perpendicular to the lacing direction, and with a simplified view of the cable lacing tape.
Figure 40:
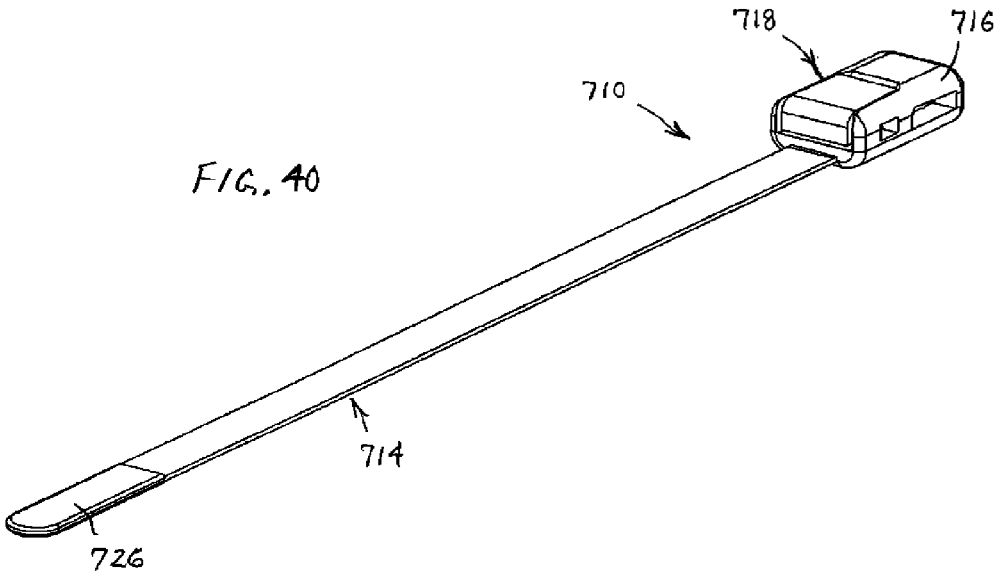
FIG. 40 is a perspective view of an eighth example cable lacing tie device having a compression member in a locked position and with a simplified view of the cable lacing tape.
Figure 41:
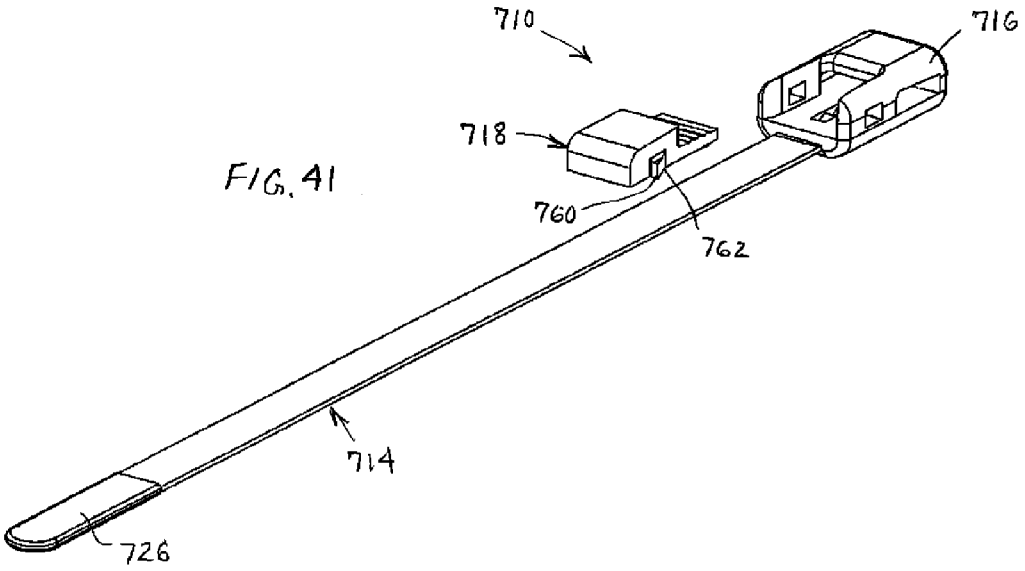
FIG. 41 is a perspective partially exploded view of the cable lacing tie device of FIG. 40.

A seventh example cable lacing tie device 610 is illustrated in FIGS. 32-39. The cable lacing tie device 610 includes a head assembly 612 and a length of cable lacing tape 614. The head assembly 612 of this example includes a molded body 616, a retainer 618 in the form of a pivotal compression member having protrusions 624. A first portion 622 of the cable lacing tape 614 is configured to be retained in a first position within the head assembly 612 by having a first end insert-molded within the body 16 in a tortuous path for enhanced retention, as best seen in FIGS. 36 and 37. As shown in this example, it may be necessary for molding purposes to have voids in the body 616 to properly capture the cable lacing tape 614. A length of the cable lacing tape 14 also extends from the front of the head assembly 612. The cable lacing tie device 610 may be used, for example, to hold together a plurality of objects, such as has been described with the prior examples.

Figure 34:
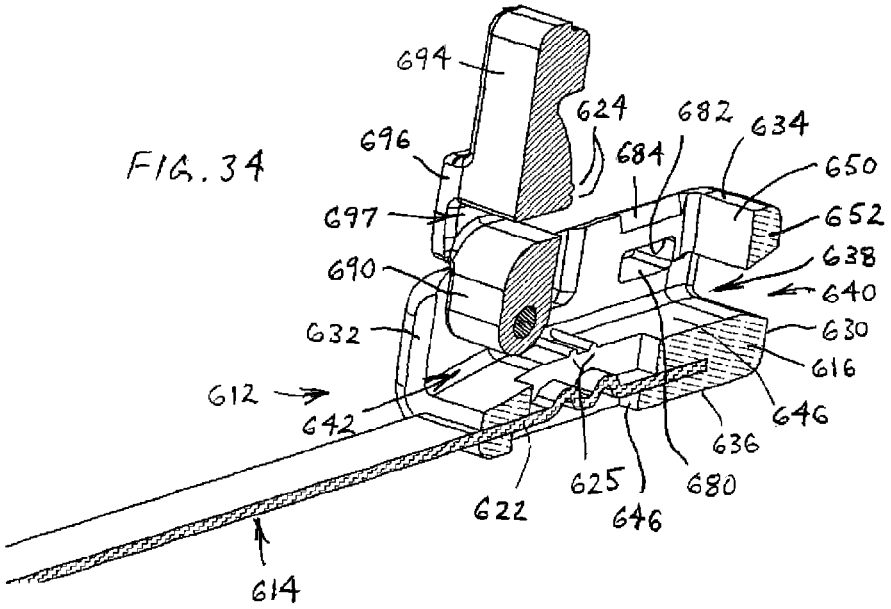
FIG. 34 is a perspective section view of the cable lacing tie device of FIG. 32 having the compression member in an unlocked, ready position, with the device being sectioned parallel to the lacing direction and with a simplified view of the cable lacing tape.
Figure 35:
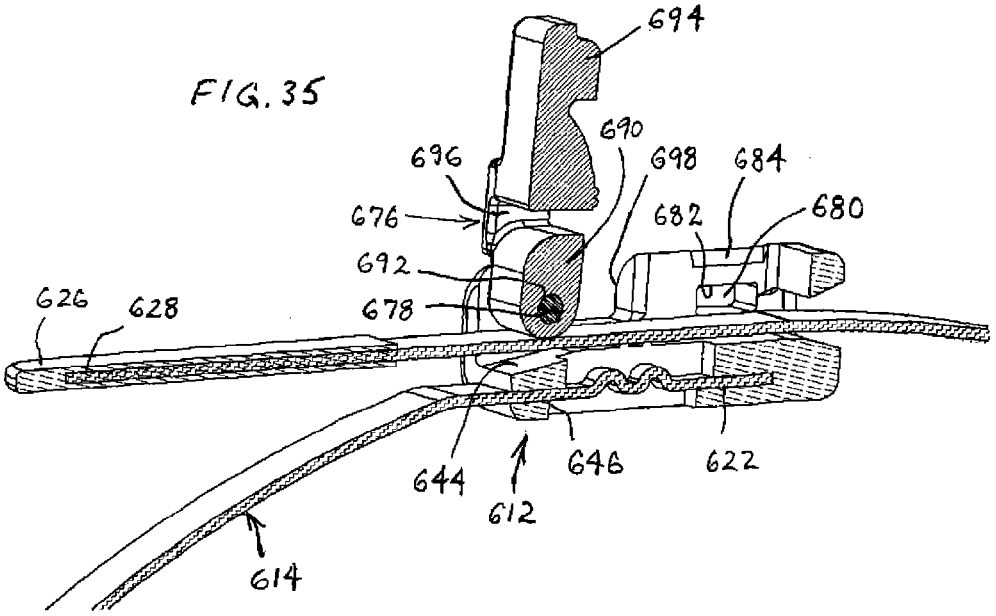
FIG. 35 is a perspective section view of the cable lacing tie device of FIG. 32 having the compression member in an unlocked, ready position and the cable lacing tape being passed through the head assembly, with the device being sectioned parallel to the lacing direction and with a simplified view of the cable lacing tape.

The body 616 and retainer 618 preferably each are injection molded and constructed of a materials and using techniques similar to those described with respect to the earlier examples. In this example, the retainer 618 includes integrally molded protrusions 624 on a surface that engages the cable lacing tape 614 when the retainer 618 is in a locked position. As best seen in FIGS. 34 and 36, the body 616 of this example also includes corresponding protrusions 625 on a lower surface 644 of the body 616 that engage the cable lacing tape 614 and are located opposite the protrusions 624 when the retainer is in a locked position. The protrusions 624, 625 are in the form of laterally extending ribs and provide an increased, localized compression load to enhance the grip on the cable lacing tape 614 without utilizing a destructive or damaging structure. In this manner, the retainer 618 urges a second portion of the cable lacing tape 614 to engage and be retained within the head assembly 612.

The cable lacing tape 614 of this example preferably is constructed similarly to that described in the first and second examples. As with the prior examples, a first portion 622, such as a first end of the cable lacing tape 614 is retained in the head assembly 612, while a tip 626 is molded to the distal or second end 628 of the cable lacing tape 614 that extends from the head assembly 612, as best seen in FIGS. 36 and 37. As with the prior examples, the tip 626 helps to prevent the braided filaments of the cable lacing tape 614 from becoming unraveled, and facilitates insertion of the second end 628 of the cable lacing tape 614 through the head assembly 612.

As best seen in FIG. 34, the body 616 of the head assembly 612 has a rear surface 630, a front surface 632, a top surface 634, a bottom surface 636, and a passageway 638 having an entrance opening 640 and an exit opening 642. The passageway 638 through the body 616 includes the lower surface 644, and a recess 646 in which the cable lacing tape 614 can be seen. The body 616 also includes side walls 674, each having a recess 676 toward the front to receive a pivot pin 678 and a recess 680 toward the rear that receives a locking extension 660 that extends from the side of the retainer 618. Each recess 680 provides an undercut surface 682 for locking engagement with locking extension 660 on the retainer 618. The inner side of the side walls 674 also have a ramped surface 684 that is used in allowing the locking extensions 660 to force and deflect the side walls 674 slightly outward as the locking extensions 660 move downward through the body 616 to come to rest in a locked position in engagement with the undercuts 682.

The retainer 618 includes a base portion 690 having a bore 692 through which the pivot pin 678 extends, thereby pivotally connecting the retainer 618 to the body 616. The retainer 618 also includes a handle portion 694 by which it may be manipulated to pivot from the unlocked, ready position shown in FIGS. 34-36 to the locked position shown in FIG. 37. A central portion 696 bridges between the base portion 690 and the handle portion 694, creating an opening 697 in the retainer 618, while allowing the body 616 to have side openings 698 for expansion of the compressed cable lacing tape 614 and avoiding interference between the retainer 618 and the side walls 674 of the body 616.

Thus the retainer 618 is pivotable from an unlocked, ready position to a locked position. When unlocked and rotated to be perpendicular to the normal path of the cable lacing tape 614, the retainer 618 is in a ready position and permits insertion of the cable lacing tape 614 through the passageway 638 in the body 616 to the exit opening 642, where the second end of the cable lacing tape 614 may be grasped and rerouted to go over the base portion 690 of the retainer 618 and rearward through the opening 697 in the retainer 618. As the cable lacing tape 618 extends rearward and above the body 616, the retainer 618 may be pivoted downward toward the body 616, which causes the cable lacing tape 614 to be forced downward by the handle portion 694 and into engagement with the portion extending forward through the passageway 638. The cable lacing tape 614 also then becomes wrapped around the handle portion 694 and redirected upward as the retainer reaches the locked position and the cable lacing tape 614 engages the inner surface 650 of a rear wall 652 of the body 616, as best seen in FIGS. 36 and 37. The path of the cable lacing tape 614 through the body 616 and around the various portions of the retainer 618 cause the retainer 618 to act as a cam latch mechanism which tends to be self-binding or self-tightening as further tension is applied to the cable lacing tape 614 that enters the entrance opening 640 in the body 616 of the head assembly 612.

The cable lacing tie device 610 is easily and quickly installed. This is achieved by locating the head assembly 612 at or near a plurality of objects to be held together by the cable lacing tie device 610. The second portion of the cable lacing tape 614 is then moved to a position looped around the plurality of objects, in a plane that is generally perpendicular to the longest axis of the objects, and the second portion of the cable lacing tape 614 is further moved to a position wherein it engages and is retained within the head assembly 612. In this seventh example, this is achieved by the routing shown in FIGS. 34-37, starting with the retainer 618 in an upward, ready position, by moving the distal or second end 628 with the tip 626 to the entrance opening 640 in the rear surface 630 of the body 616 of the head assembly 612. The tip 626 then is inserted into the entrance opening 640 and fed through the passageway 638 in the body 616 until the tip 626 extends outward and forward from the exit opening 642 in the front face 632 of the body 616. The tip 626 is then grasped and the cable lacing tape 614 is pulled until it has reached a desired level of tightness or tension.

As the portion of the cable lacing tape 614 that is extending forward of the exit opening 642 is being pulled, a further more proximal length of the cable lacing tape 614 continues to pass through the passageway 638 and eventually the tension in the cable lacing tape 614 tends to pull the cable lacing tape 614 toward the center of the plurality of objects to be held together, and therefore, into more forceful engagement with the protrusions 625 on the lower surface 644 in the body 616. The tip 626 is then rerouted rearward over the top of the base portion 690 of the retainer 618 and rearward through the opening 697 in the retainer 618. The tip 626 is then routed further rearward, under the handle portion 694 of the retainer 618 and then to extend upward, being further pinched between the handle portion 694 and the inner surface 650 of the rear wall 652 of the body 616 when the retainer 618 is pivoted to the locked position shown in FIG. 37. At this point, the protrusions 624 on the retainer 618, as well as the protrusions 625 on the body 616 of the head assembly 612 serve to provide increased compressive force to assist in holding a second portion of the cable lacing tape 614 within the head assembly 612. The protrusions 624, 625 and other surfaces of the head assembly 612 that engage the cable lacing tape 614, as well as the engagement with itself as it passes back through a portion of the passageway 638 do not present a destructive holding environment, as with prior art barbs that would cut into flat plastic cable tie straps. Thus, in the installed and locked position, two portions of the cable lacing tape 614 are retained within the head assembly 612, with a first portion retained within the head assembly 612 in a first general direction and a second portion retained within the head assembly 612 in a second general direction, where the first and second general directions are substantially perpendicular. As with the prior examples, the excess cable lacing tape 614 extending from the head assembly 612 may be trimmed and if one is concerned about the potential unraveling of the cable lacing tape 614, then any of the previously discussed structures or methods may be employed.

Figure 42:
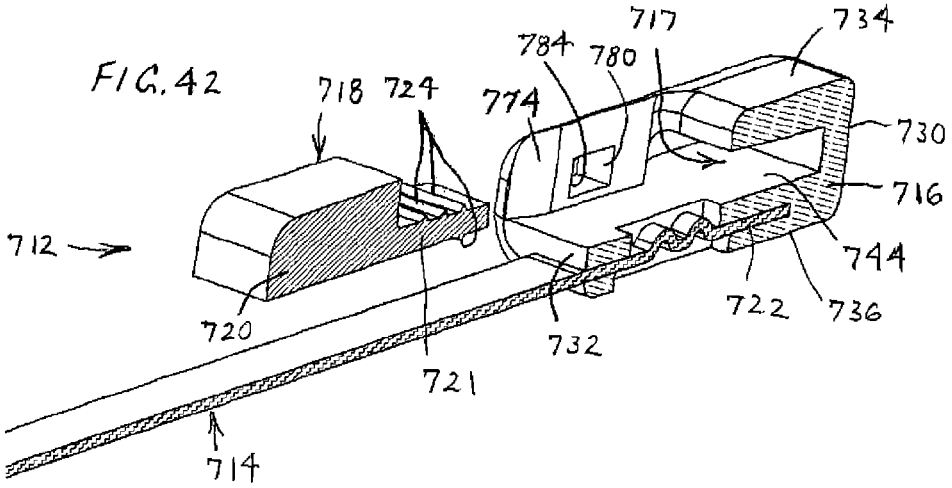
FIG. 42 is a perspective section view of the cable lacing tie device of FIG. 40 having the compression member in an unlocked, ready position, with the device being sectioned parallel to the lacing direction and with a simplified view of the cable lacing tape.

Among other variations from the prior examples, an eighth example cable lacing tie device 710 is illustrated in FIGS. 40-45. This example cable lacing tie device 710 is constructed of similar materials and using similar techniques as described with respect to the prior examples. This example cable lacing tie device 710 includes a head assembly 712 and a length of cable lacing tape 714. The head assembly 712 includes a molded body 716, and a retainer 718 that is shown in this example as a separate piece that is not connected to the body 716 until it is installed in a locked position. As best seen in FIG. 42, the head assembly 712 has a rear surface 730, a front surface 732, a top surface 734, and a bottom surface 736. The body 716 includes a wedge-shaped central opening 717, having a lower surface 744. The body further includes side walls 774 having openings 780, which provide undercuts 784. A first portion 722 of the cable lacing tape 714 is molded within the body 716 of the head assembly 712, with a second portion extending outward from the head assembly 712. For ease of manipulation and to prevent unraveling, the cable lacing tape includes a molded tip 726 at a distal or second end 728.

The retainer 718 is installed and held within the head assembly 712 by engagement with the cable lacing tape 714 and compression. The retainer 718 is configured to be a compression member for insertion into the wedge-shaped central opening 717. The retainer 718 further includes a main body 720 and an extension 721. The main body 720 includes locking extensions 760 extending laterally outward therefrom. The locking extensions 760 are configured with a ramped surface 762 to assist in deflecting side walls 774 of the body 716 as the locking extensions 760 are moved toward engagement with the undercuts 784 provided by the openings 780. The extension 721 has integrally molded protrusions 724, in the form of laterally extending ribs, on its upper and lower surfaces. Much like with the prior example cable lacing tie device 610, the protrusions 724 provide a localized increased compressive forces to the second portion of the cable lacing tape 714 to engage and be retained within the head assembly 712.

Figure 43:
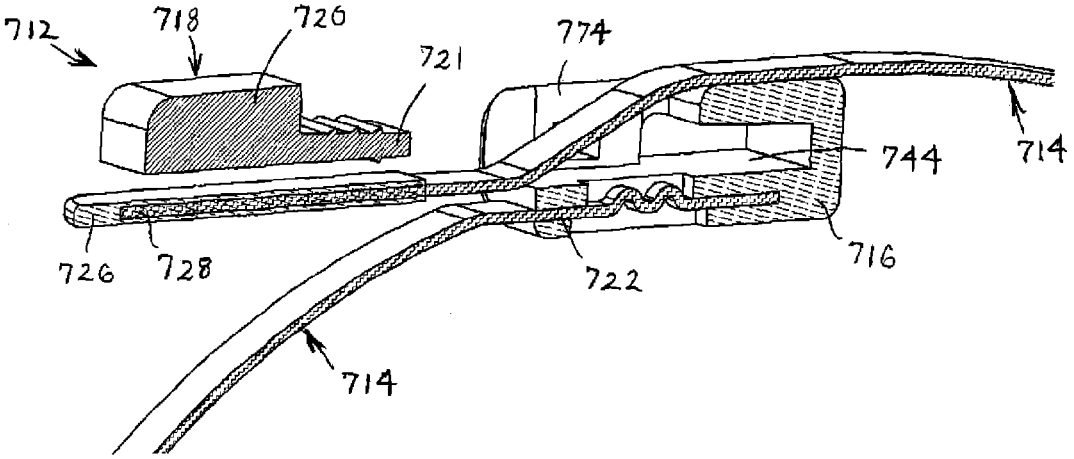
FIG. 43 is a perspective section view of the cable lacing tie device of FIG. 40 having the compression member in an unlocked, ready position and the cable lacing tape being in engagement with and passing over the head assembly, with the device being sectioned parallel to the lacing direction and with a simplified view of the cable lacing tape.
Figure 44:
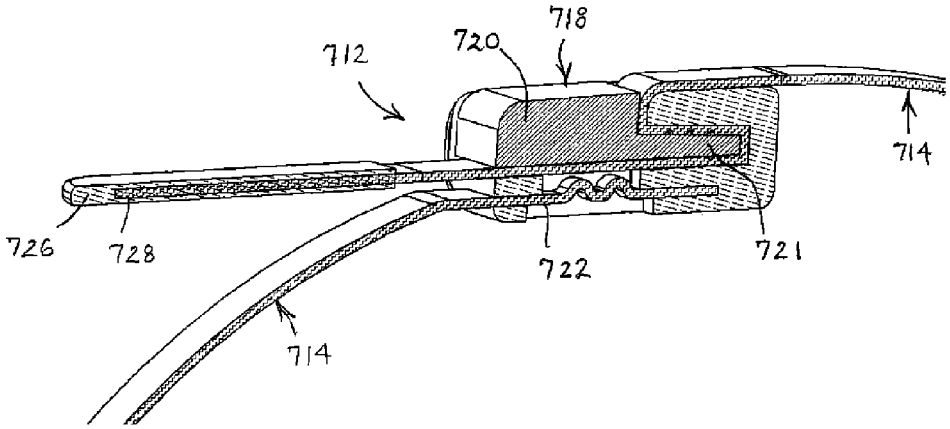
FIG. 44 is a perspective section view of the cable lacing tie device of FIG. 40 having the compression member in a locked position and the cable lacing tape being passed through the head assembly and around the compression member, with the device being sectioned parallel to the lacing direction and with a simplified view of the cable lacing tape.
Figure 45:
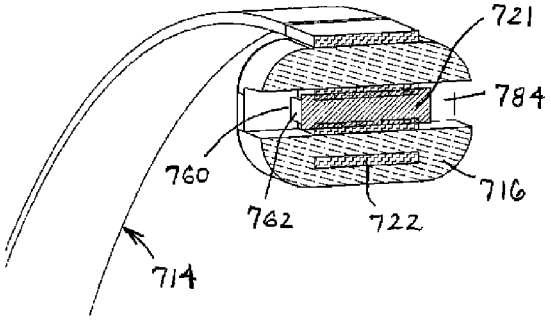
FIG. 45 is a perspective section view of the cable lacing tie device of FIG. 40 having the compression member in a locked position, with the device being sectioned through the compression member at a latch and perpendicular to the lacing direction, and with a simplified view of the cable lacing tape.

Thus, the head assembly 712 is used in a manner similar to the previous examples, however, as noted above, the cable lacing tape 714 does not extend through a passage in the head assembly 712, but rather the cable lacing tape 714 is routed over the top surface 734 of the body 716 and thereby engages and is held within the head assembly 712 by insertion of the retainer 718 until the locking extensions 760 engage the undercuts 784 and the retainer 718 reaches a locked position, as best seen in FIGS. 42-44.

Accordingly, the head assembly 712 and cable lacing tape 714 may be treated in a manner similar to the previous examples to hold together a plurality of objects by locating the head assembly 712 at or near the plurality of objects, moving a second portion of the cable lacing tape 714 to a position looped around the plurality of objects, and then moving the second portion of the cable lacing tape 714 to a position wherein the second portion of the cable lacing tape engages and is retained within the head assembly 712. This is accomplished by routing the cable lacing tape 714 over the body 716, and pulling to tighten the cable lacing tie device 710 around the plurality of objects. The retainer 718 then is inserted into the wedge-shaped opening 717 in the body 716 until it reaches the locked position. Thus, as with the prior examples, when installed, first and second portions of the cable lacing tape 714 are retained within the head assembly 712, with a first portion retained in a first general direction and a second portion retained within the head assembly 712 in a second general direction, where the first and second general directions are substantially parallel. Also, optionally, any excess length of cable lacing tape 714 extending from the head assembly 712 may be removed by cutting the cable lacing tape 714, if desired. As previously described with respect to prior examples, structures and methods of preventing unraveling of the cable lacing tape 714 may be employed.

Turning to FIGS. 46-51, a ninth example cable lacing tie device 810 is illustrated. This example cable lacing tie device 810 may be constructed of similar materials and by using similar construction techniques as described with respect to the prior examples, and includes a head assembly 812 and a length of cable lacing tape 814. The head assembly 812 includes a molded body 816, and a retainer 818 that also serves as a compression member, which will be referred to hereinafter as the retainer 818. The retainer 818 is shown in this example as being generally wedge-shaped and coupled to the body 816 by being formed integrally with the body 816 and having arms 820 on the sides of the retainer 818 that connect it to the body 816. The arms 820 are constructed to hold the retainer 818 in an unlocked, ready position, until the cable lacing tie device 810 is installed.

The head assembly 812 has a rear surface 830, a front surface 832, a top surface 834, a bottom surface 836 and a passageway 838 having a first opening 840 in the front surface 832 for entering and exiting the passageway 838, and a second opening 842 in the rear surface 830 for looping the cable lacing tape 814 around the retainer 818 and back through the passageway 838. In this example, a first portion 822 of the cable lacing tape 814 is retained in the body 816 of the head assembly 812, such as by insert-molding or by other methods of connection, as discussed with respect to prior examples. A second portion 824 of the cable lacing tape 814 extends outward from the front surface 832 of the head assembly 812, opposite the direction in which the retainer 818 extends from the head assembly 812 when in the unlocked position. Thus, the retainer 818 is held in a position extending rearward through the looping opening 842 in the rear surface 830 by the arms 820.

In this example, the passageway 838 is generally tapered or wedge-shaped with an upper wall 850, a lower wall 852 and side walls 854. The retainer 818 has an upper surface 856 and a lower surface 858, which include locking protrusions or extensions 860. In this example, the locking extensions 860 are configured to cooperate with locking recesses or detents 862 in the upper and lower walls 850, 852 of the passageway 838. It will be appreciated that, in any of the examples having locking protrusions or extensions and corresponding locking recesses or detents, such locking structures could be located with respect to any of the respective opposed outer surfaces of the compression member or retainer, or the inner surfaces of the passageway through the body, and that such structures may be configured so as to have a single, or at least one locking extension and detent, or a plurality of such locking structures, such as the pairs that are shown in the present example. Thus, each of the retainer and the body may include at least one complementary locking member that is engaged when the retainer is moved to the locked position.

The arms 820 are configured to hold the retainer 818 to permit easy installation of the cable lacing tie device 810. It further will be appreciated that in any of the examples having such arm structures, the arms could be located with respect to any of the corresponding outer surfaces of the retainer or inner surfaces of the passageway through the body that are opposed to each other, and may be integrally molded with the body and retainer, as is shown in this example, or the body and retainer could be separately formed and then joined in a head assembly, as is shown and described below in connection with the example of FIGS. 58-62. These alternatives also could be utilized with respect to any of the other examples that include a retainer that can be moved from an unlocked position at least partially extending from a body of a head assembly to a locked position advanced further into the body.

When desiring to use the cable lacing tie device 810 to hold together a plurality of objects, the head assembly 812 is moved to a position at or near a plurality of objects, such as a group of wires W to form a bundle B, located generally perpendicular to the first portion 822 and along the front surface 832 of the head assembly 812. The end 828 of the second portion 824 of the cable lacing tape 814 is moved to be looped around the plurality of objects and passed through the first opening 840 in the front surface 832, and then between the lower wall 852 of the passageway 838 and the lower surface 858 of the retainer 818, so as to extend rearward from the second opening 842. With the second portion 824 engaging the head assembly 812, the end 828 of the second portion 824 of the cable lacing tape 814 then is routed over the rear of the retainer 818 and passed back through the second opening 842 in the rear surface 830 and between the upper wall 850 of the passageway 838 and the upper surface 856 of the retainer 818. The end 828 then extends forward through the first opening 840 where it can be grasped and pulled by the user.

Figure 50:
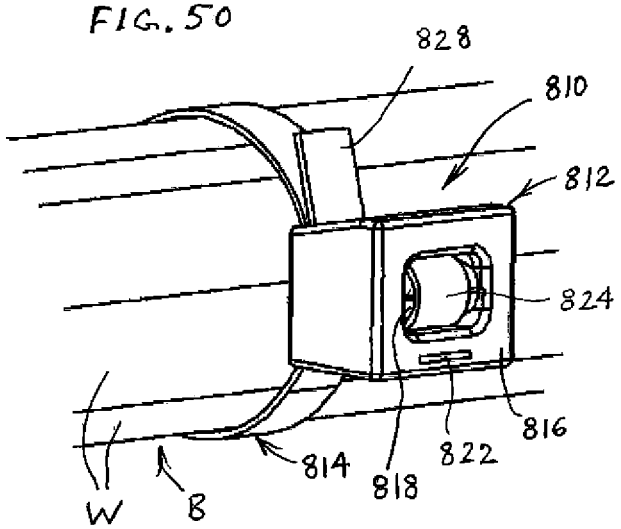
FIG. 50 is a perspective view of the cable lacing tie device of FIG. 46, after the second portion of the cable lacing tape has been grasped and pulled through the head assembly until the retainer has advanced to a locked position.
Figure 51:
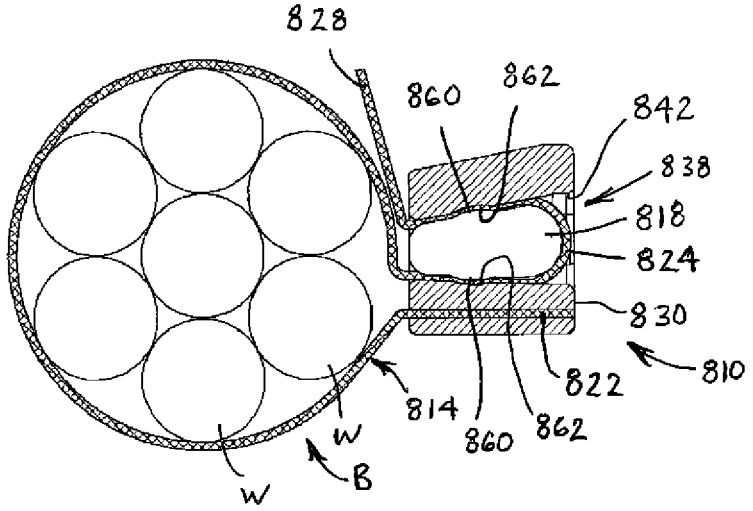
FIG. 51 is a section view of the cable lacing tie device of FIG. 46, in the locked position shown in FIG. 50.

When the end 828 of the cable lacing tape 814 is pulled, any slack is taken up as the second portion 824 of the cable lacing tape 814 moves through the head assembly 812 and around the retainer 818. The cable lacing tape 814 is tightened in this manner until the pulling force exceeds the strength of the arms 820 that connect the sides of the retainer 818 to the body 816. The arms 820 are constructed so as to then break and permit the retainer 818 to advance forward to a locked position, as shown in FIGS. 50-51. In the locked position, the locking extensions 860 on the retainer 818 reach the detents 862 in the upper and lower walls 850, 852 of the passageway 838. In this way, the cable lacing tie device 810 is configured for a method of use where tightening the cable lacing tape 814 drives the retainer 818 from an unlocked, ready or open position to a locked, closed position. In the locked position, a portion of the cable lacing tape 814 that extends from the head assembly 812 is looped back through and retained in the head assembly 812 as it is compressed between the upper and lower surfaces 856, 858 of the retainer 818 and the respective opposing upper and lower walls 850, 852 of the passageway 838.

Having the retainer 818 held in the unlocked position, spaced from the upper and lower walls 850, 852 of the passageway 838, reduces the need for a molded tip on the end 828, because the end 828 may easily be threaded through the head assembly 812 and around the retainer 818. Further, although a molded tip may be provided, as described with respect to prior examples, it is not required to avoid unraveling if the end 828 is trimmed to a shorter length after the retainer 818 has reached a locked position, because the cable lacing tape 814 would not be able to unravel while compressed within the head assembly 812. Indeed, once in the locked position, the wedge-shaped engagement of the retainer 818 is adapted to be self-tightening, and the threading around the retainer 818 will cause the retainer 818 to urge the cable lacing tape 814 into a further compressed and therefore more securely retained position if the plurality of objects pulls on the cable lacing tape 814.

It will be appreciated that the first portion of the cable lacing tape may not be retained initially within the head assembly, but only after being passed through a passageway in the head assembly and after a retainer has been manipulated or moved into a locked position. Also, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

Figure 52:
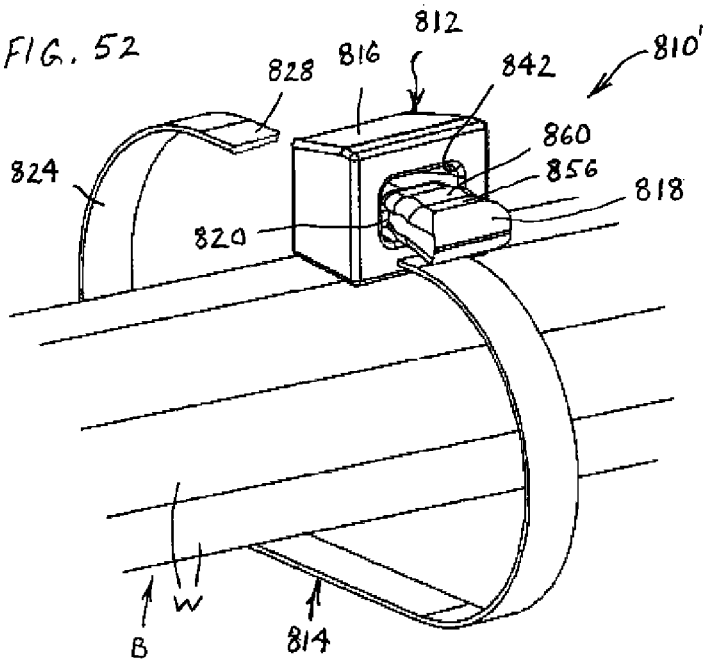
FIG. 52 is a perspective view of a tenth example cable lacing tie device that is similar to the cable lacing tie device shown in FIGS. 46-51, but with the second portion of the cable lacing tape extending from the head assembly in the same direction that the compression member or retainer is extending from the head assembly when in the unlocked, ready position, and with a simplified view of the cable lacing tape.
Figure 53:
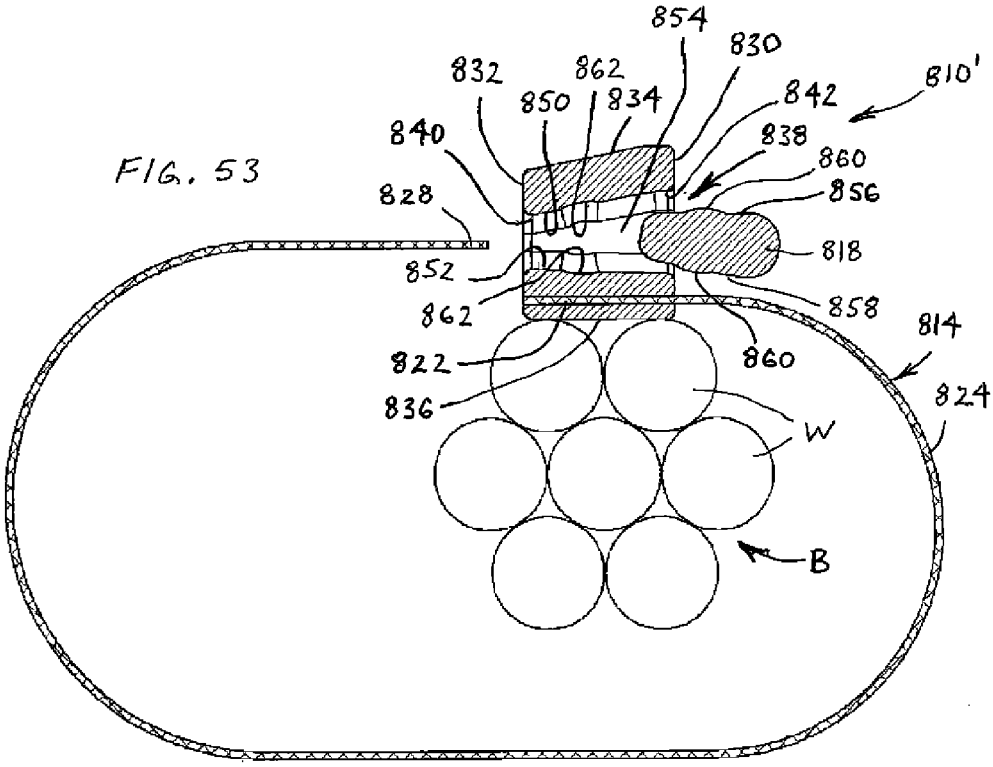
FIG. 53 is a section view of the cable lacing tie device of FIG. 52, being sectioned parallel to the lacing direction and showing the plurality of objects to be bundled being located generally adjacent a bottom surface of the head assembly.

An example of a device exhibiting such an alternative direction for extension of the second portion of the cable lacing tape from the head assembly is provided when comparing the ninth example cable lacing tie device 810 to a tenth example cable lacing tie device 810', which is illustrated in FIGS. 52-53. The tenth example cable lacing tie device 810' may be constructed of similar materials and by using similar construction techniques as described with respect to the prior examples, but more specifically, its components are configured in the same way as the ninth example cable lacing tie device 810 in FIGS. 46-51, except that the second portion 824 of the cable lacing tape 814 extends rearward from the rear surface 830 of the head assembly 812, instead of forward from the front surface 832. Thus, the second portion 824 of the cable lacing tape 814 extends from the head assembly 812 in the same direction that the retainer 818, which also serves as a compression member, is extending from the head assembly 812 when in the unlocked, ready position.

In use, the cable lacing tie device 810' is positioned at or near the plurality of objects to be grouped, such as the wires W to be formed into a bundle B, which with this example are positioned along the bottom surface 836 of the head assembly 812, so as to be generally parallel to the first portion 822 of the cable lacing tape 814. This configuration may require a slightly longer piece of the second portion 824 of the cable lacing tape 814 to be used when looping around the plurality of objects, but it also may facilitate easier handling of the cable lacing tie device 810' with respect to feeding the end 828 of the second portion 824 through the head assembly 812 and pulling the end 828 until the arms 820 on the sides of the retainer 818 break and allow the retainer 818 to move to a locked, closed position, in the same manner as described above with respect to the ninth example cable lacing tie device 810. This also may permit easier access to the end 828 if the user wishes to trim away the portion of the cable lacing tape 814 that would be extending from the head assembly 812, once installed. Thus, the cable lacing tie device 810' similarly is configured for a method of use where tightening the cable lacing tape 814 drives the retainer 818 from an unlocked, ready or open position to a locked or closed position. Once in the locked position, the wedge-shaped engagement of the retainer 818 is adapted to be self-tightening, as described with respect to the ninth example.

Figure 54:
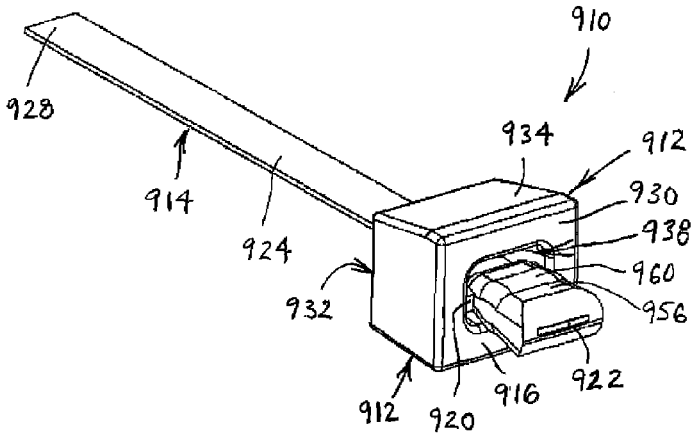
FIG. 54 is a perspective view of an eleventh example cable lacing tie device that has a head assembly having a first portion of a cable lacing tape retained within a compression member or retainer and a second portion of the cable lacing tape extending from the head assembly, prior to the second portion of the cable lacing tape being looped around a plurality of objects and routed through the head assembly and around the retainer, and with a simplified view of the cable lacing tape.
Figure 55:
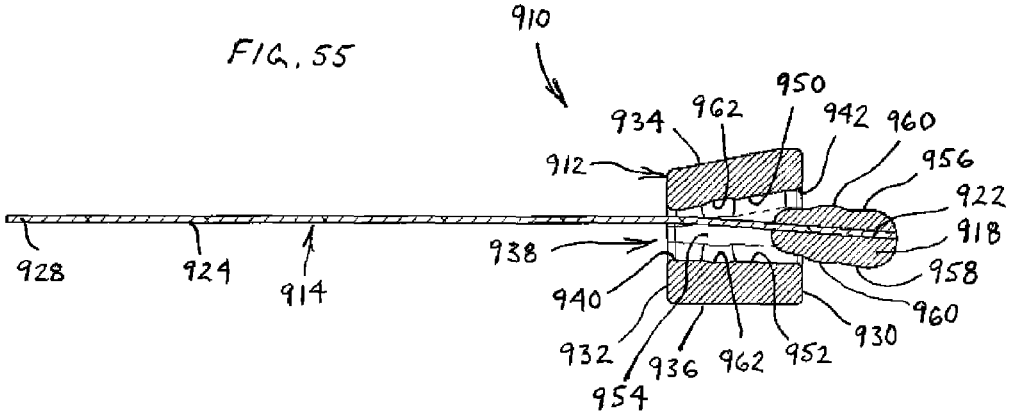
FIG. 55 is a section view of the cable lacing tie device of FIG. 54, sectioned parallel to the lacing direction.

Turning to FIGS. 54-55, an eleventh example cable lacing tie device 910 is illustrated. The example cable lacing tie device 910 may be constructed of similar materials and by using similar construction techniques as described with respect to the prior examples, and includes a head assembly 912 and a length of cable lacing tape 914. The head assembly 912 includes a molded body 916, and a retainer 918 that also serves as a compression member and which will be referred to hereinafter as the retainer 918. The retainer 918 shown in this example is of the same generally wedge-shaped configuration as in the prior ninth and tenth examples, and is similarly coupled to the body 916 by arms 920 that are formed integrally with the body 916 and retainer 918. The body 916 and retainer 918 differ from those of the prior two examples in that a first portion 922 of the cable lacing tape 914 is insert-molded within the retainer 918 instead of within the body 916. As with the prior two examples, the arms 920 on the sides of the retainer 918 connect it to the body 916 and hold the retainer 918 in an unlocked, ready position, until the cable lacing tie device 910 is installed. It will be appreciated that the retainer and body of the head assembly alternatively may be formed as separate pieces, as in the example discussed below and shown in FIGS. 58-62.

The head assembly 912 has a rear surface 930, a front surface 932, a top surface 934, a bottom surface 936 and a passageway 938 having a first opening 940 in the front surface 932 for entering and exiting, and a second opening 942 in the rear surface 930 to permit the end 928 to be looped over the retainer 918 and passed back through the passageway 938. As noted above, the first portion 922 of the cable lacing tape 914 is retained in the head assembly 912 of this example by being insert-molded into the retainer 918, instead of the body 916. Accordingly, a second portion 924 of the cable lacing tape 914 extends forward from the retainer 918 and outward from the passageway 938 in the head assembly 912, opposite the direction in which the retainer 918 extends from the head assembly 912 when in the unlocked position. As with the prior two examples, the retainer 918 is held in a position extending rearward through the looping opening 942 in the rear surface 930 by the arms 920.

As with the prior two examples, the passageway 938 is generally tapered or wedge-shaped with an upper wall 950, a lower wall 952 and side walls 954. The retainer 918 has an upper surface 956 and a lower surface 958, which include locking extensions 960. The locking extensions 960 are configured to cooperate with locking recesses or detents 962 in the upper and lower walls 950, 952 of the passageway 938. As noted previously, the retainer and body could have at least one, or a single corresponding complementary locking extension and recess or detent that is engaged when the retainer is moved to the locked position, although this example includes two.

The arms 920 are configured to hold the retainer 918 to permit easy installation of the cable lacing tie device 910. It will be appreciated that the arms could be located with respect to any of the corresponding outer surfaces of the retainer or inner surfaces of the passageway through the body that are opposed to each other, and may be integrally molded with the body and retainer, as is shown in this example, or the body and retainer could be separately formed and then joined in a head assembly, as is shown and described below in connection with the example of FIGS. 58-62.

Similar to the ninth example, the head assembly 912 is moved to a position at or near a plurality of objects, located generally along the front surface 832 of the head assembly 912. However, the end 928 of the second portion 924 of the cable lacing tape 914 would be moved to be looped over the top of and around the plurality of objects and then passed through the first opening 940 in the front surface 932, and then between the lower wall 952 of the passageway 938 and the lower surface 958 of the retainer 918, so as to extend rearward from the second opening 942. With the second portion 924 engaging the head assembly 912, the end 928 of the second portion 924 of the cable lacing tape 914 then is routed over the rear of the retainer 918 and passed back through the second opening 942 in the rear surface 930 and between the upper wall 950 of the passageway 938 and the upper surface 956 of the retainer 918. The end 928 then extends forward through the first opening 940 where it can be grasped and pulled by the user.

Upon pulling the end 928 of the cable lacing tape 914, any slack is taken up as the second portion 924 of the cable lacing tape 914 moves through the head assembly 912 and around the retainer 918, until the pulling force exceeds the strength of the arms 920, breaking the arms 920 and driving the retainer 918 forward to a locked position, similar to that shown with the ninth example in FIGS. 50-51. In the locked position, the locking extensions 960 on the retainer 918 reach the detents 962 in the upper and lower walls 950, 952 of the passageway 938. In this way, the cable lacing tie device 910 is configured for a method of use where tightening the cable lacing tape 914 drives the retainer 918 from an unlocked, ready or open position to a locked or closed position. In the locked position, a portion of the cable lacing tape 914 that extends from the head assembly 912 is looped back through and retained in the head assembly 912 as it is compressed between the upper and lower surfaces 956, 958 of the retainer 918 and the respective opposing upper and lower walls 950, 952 of the passageway 938. The pre-installation positioning of the retainer 918 and the compression applied to the cable lacing tape 914 within the head assembly 912 when in a locked position, reduces the need for a molded tip on the end 828, for similar reasons to those previously discussed with respect to the ninth example cable lacing tie device 810. The present cable lacing tie device 910 includes the same advantageous wedge-shaped engagement of the retainer 918, so as to be self-tightening, with the threading of the second portion 924 of the cable lacing tape 914 around the retainer 918 and its tendency to urge the cable lacing tape 914 into a further compressed and therefore more securely retained position if the plurality of objects pulls on the cable lacing tape 914.

Figure 56:
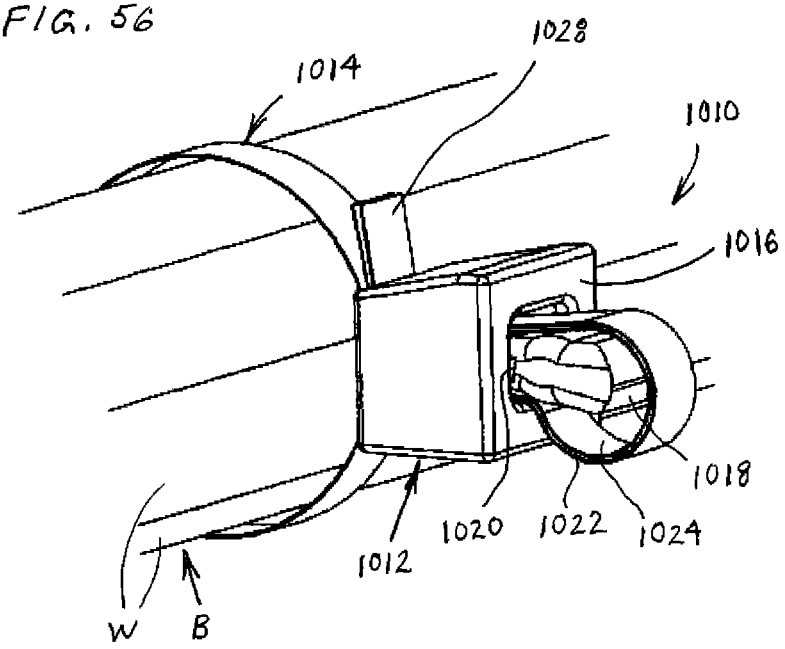
FIG. 56 is a perspective view of a twelfth example cable lacing tie device that has a head assembly and a cable lacing tape that is looped around a plurality of objects and then having the first and second portions of the cable lacing tape passed through the head assembly and around a compression member or retainer that is in an unlocked, ready position and with a simplified view of the cable lacing tape.
Figure 57:
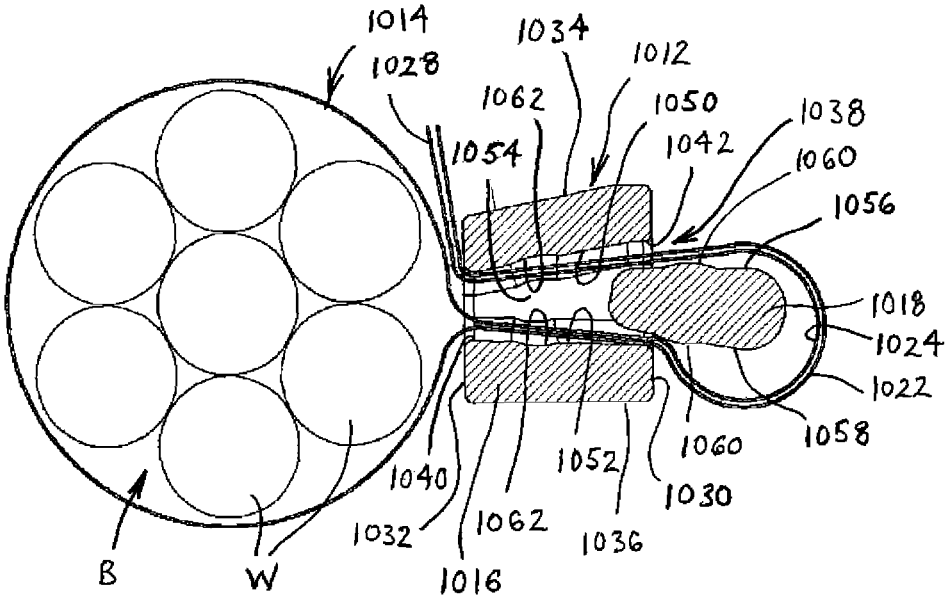
FIG. 57 is a section view of the cable lacing tie device of FIG. 56, with the device being sectioned parallel to the lacing direction.

A twelfth example cable lacing tie device 1010 is illustrated in FIGS. 56-57. The example cable lacing tie device 1010 may be constructed of similar materials and by using similar construction techniques as described with respect to the prior examples, and includes a head assembly 1012 and a length of cable lacing tape 1014. The head assembly 1012 includes a molded body 1016, and a retainer 1018 that also serves as a compression member and which will be referred to hereinafter as the retainer 1018. The retainer 1018 shown in this example is of the same generally wedge-shaped configuration as in the prior ninth example, and is similarly coupled to the body 1016 by arms 1020 that are formed integrally with the body 1016 and retainer 1018. The body 1016 differs from the body 816 of the ninth example in that a first portion of the cable lacing tape 1014 is not insert-molded therein. Instead of being retained in the head assembly 1012 by being insert-molded, both a first portion 1022 and a second portion 1024 of the cable lacing tape 1014 are retained in the head assembly 1012 by being compressed between the retainer 1018 and the body 1016. As with the ninth example, the arms 1020 on the sides of the retainer 1018 connect it to the body 1016 and hold the retainer 1018 in an unlocked, ready position, until the cable lacing tie device 1010 is installed.

The head assembly 1012 has a rear surface 1030, a front surface 1032, a top surface 1034, a bottom surface 1036 and a passageway 1038 having a first opening 1040 in the front surface 1032 for entering and exiting the passageway 1038, and a second opening 1042 in the rear surface 1030 to allow the ends of the cable lacing tape 1014 to be looped or routed over the retainer 1018 and passed back through the passageway 1038. As with the ninth example, the passageway 1038 is generally tapered or wedge-shaped with an upper wall 1050, a lower wall 1052 and side walls 1054. The retainer 1018 has an upper surface 1056 and a lower surface 1058, which include locking extensions 1060. The locking extensions 1060 are configured to cooperate with locking recesses or detents 1062 in the upper and lower walls 1050, 1052 of the passageway 1038. The arms 1020 are configured to hold the retainer 1018 to permit easy installation of the cable lacing tie device 1010.

Similar to the ninth example, to install the cable lacing tie device 1010, the head assembly 1012 is moved to a position at or near a plurality of objects, such as wires W that are to be formed into a bundle B. The second portion 1024 of the cable lacing tape 1014 is looped around the plurality of objects, and the first and second portions 1022, 1024 of the cable lacing tape 1014 are directed rearward through the first opening 1040 and moved through the head assembly 1012 between the lower wall 1052 of the body 1016 and the lower surface 1058 of the retainer 1018. Both the first and second portions 1022, 1024 of the cable lacing tape 1014 are routed over the rear of the retainer 1018 and then forward through the second opening 1042 in the body 1016 and between the upper wall 1050 of the passageway 1038 and the upper surface 1056 of the retainer 1018 that is extending from the rear surface 1030 of the head assembly 1012 when in the unlocked position. The end 1028 of the second portion 1024, as well as the end of the first portion 1022, then extend forward through the first opening 1040 where they can be grasped and pulled by the user.

Upon pulling the free ends of the cable lacing tape 1014, any slack is taken up as to both the first and second portions 1022, 1024 of the cable lacing tape 1014 as they move through the head assembly 1012 and around the retainer 1018, until the pulling force exceeds the strength of the arms 1020, breaking the arms 1020 and driving the retainer 1018 forward to a locked position, similar to that shown with the ninth example in FIGS. 50-51. In the locked position, the locking extensions 1060 on the retainer 1018 reach the detents 1062 in the upper and lower walls 1050, 1052 of the passageway 1038. In this way, the cable lacing tie device 1010 is configured for a method of use where tightening the cable lacing tape 1014 drives the retainer 1018 from an unlocked, ready or open position to a locked or closed position. In the locked position, a portion of the cable lacing tape 1014 extends from the head assembly 1012 and the ends are routed through and retained in the head assembly 1012 as they are compressed between the retainer 1028 and the body 1016.

The pre-installation positioning of the retainer 1018 and the compression applied to the cable lacing tape 1014 within the head assembly 1012 when in a locked position, reduces the need for a molded tip on the ends of the cable lacing tape 1014, for similar reasons to those previously discussed with respect to the end 828 in the ninth example cable lacing tie device 810. The present cable lacing tie device 1010 includes the same advantageous wedge-shaped engagement of the retainer 1018, so as to be self-tightening, with the threading of the first and second portions 1022, 1024 of the cable lacing tape 1014 around the retainer 1018 and its tendency to urge the cable lacing tape 1014 into a further compressed and therefore more securely retained position if the plurality of objects pulls on the cable lacing tape 1014. It will be appreciated that the previously discussed alternative configurations for the construction of the locking features and arms between the corresponding compression member or retainer and the body may be utilized with this example device, as well. Thus, each of the retainer and the body may include at least one complementary locking member that is engaged when the retainer is moved to the locked position.

Turning to FIGS. 58-62, a thirteenth example cable lacing tie device 1110 is illustrated. This example cable lacing tie device 1110 includes a head assembly 1112 and a cable lacing tape 1114. The components may be constructed of similar materials and by using similar construction techniques as described with respect to the ninth example, but more specifically, its components are configured similarly to those of the ninth example cable lacing tie device 810 in FIGS. 46-51, except that the compression member or retainer 1118 is not integrally molded with the body 1116 of the head assembly 1112. Instead, the retainer 1118 is a separate component from the body 1116, having arms 1120 that engage the body 1116, with the retainer 1118 being movable between an unlocked, ready or open position and a locked or closed position.

The head assembly 1112 has a rear surface 1130, a front surface 1132, a top surface 1134, a bottom surface 1136 and a passageway 1138 having a first opening 1140 in the front surface 1132 for entering and exiting the passageway 1238, and a second opening 1142 in the rear surface 1130 to allow the cable lacing tape to be passed over the rear of the retainer 1118 and passed back through the passageway 1138. A first portion 1122 of the cable lacing tape 1114 is retained in the body 1116 of the head assembly 1112, such as by insert-molding or by other methods of connection, as discussed with respect to prior examples. A second portion 1124 of the cable lacing tape 1114 extends outward from the front surface 1132 of the head assembly 1112, opposite the direction in which the retainer 1118 extends from the head assembly 1112 when in the unlocked position. Thus, the retainer 1118 is held in a position extending rearward through the looping opening 1142 in the rear surface 1130 by the arms 1120.

As noted previously, it will be appreciated that the first portion of the cable lacing tape alternatively may not be retained initially within the head assembly, but only after being passed through a passageway in the head assembly and after a retainer has been manipulated or moved into a locked position. Also, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

Figure 58:
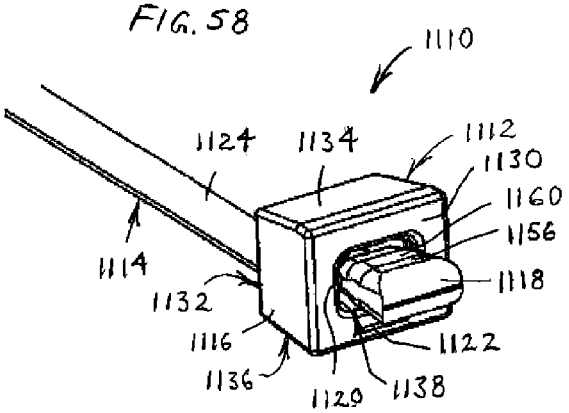
FIG. 58 is a perspective view of a thirteenth example cable lacing tie device that has a head assembly having a first portion of a cable lacing tape retained within the head assembly, a second portion of the cable lacing tape extending from the head assembly opposite the direction a compression member or retainer is extending from the head assembly in an unlocked, ready position, and with a simplified view of the cable lacing tape.
Figure 61:
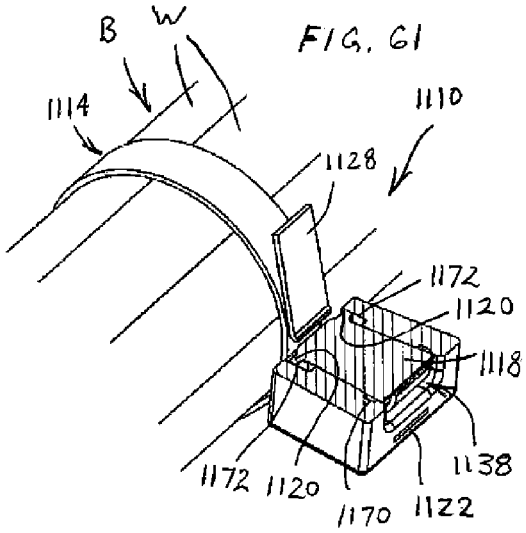
FIG. 61 is a perspective section view of the cable lacing tie device of FIG. 58, with the head assembly located near a plurality of objects and the second portion of the cable lacing tape moved to a position looped around the plurality of objects and engaging the head assembly by being passed through the head assembly, routed over the compression member or retainer and passed back through the head assembly, and then grasped and pulled until the compression member has advanced to a locked position, with the device being sectioned parallel to the lacing direction.
Figure 59:
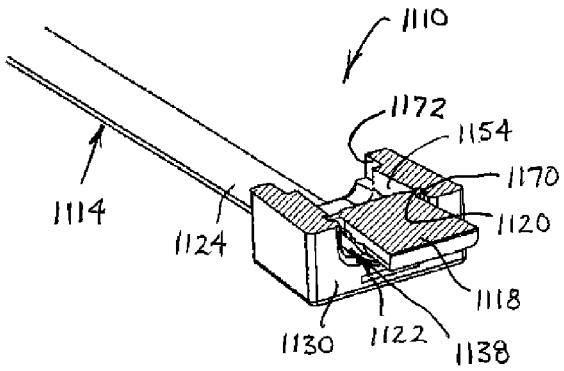
FIG. 59 is a perspective section view of the cable lacing tie device of FIG. 58, with the device being sectioned vertically and parallel to the lacing direction.
Figure 62:
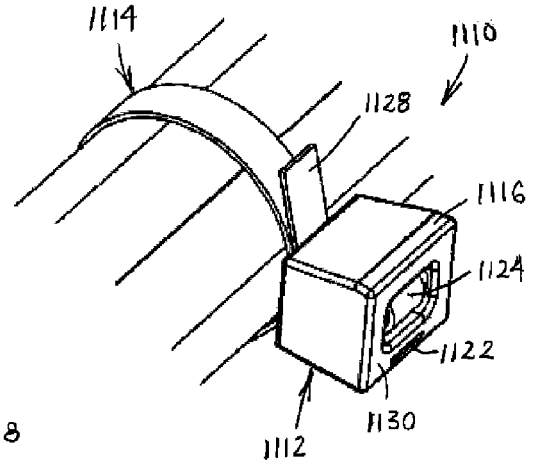
FIG. 62 is a perspective view of the cable lacing tie device of FIG. 58 in the locked position shown in FIG. 61.
Figure 60:
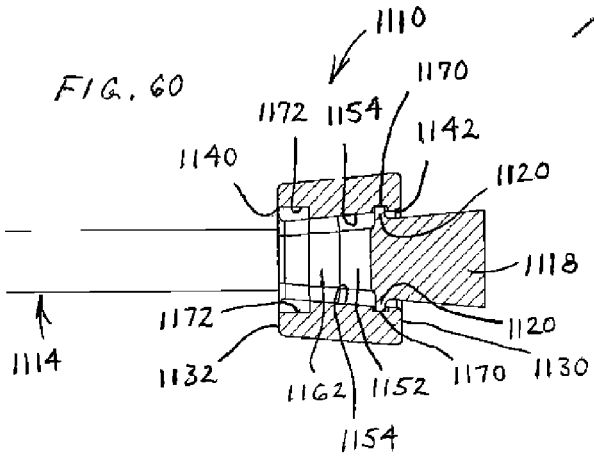
FIG. 60 is a top section view of the cable lacing tie device of FIG. 58, with the device being sectioned horizontally and parallel to the lacing direction.

In this example, similar to the ninth example, the passageway 1138 is generally tapered or wedge-shaped with an upper wall, a lower wall 1152 and side walls 1154. The retainer 1118 has an upper surface 1156 and a similar lower surface, which each include a locking extension 1160. The locking extensions 1160 are configured to cooperate with locking recesses or detents 1162 in the upper wall and the lower wall 1152 of the passageway 1138. The arms 1120 are configured to engage detents 1170 located in the side walls 1154 of the passageway 1138 near the rear of the body 1116, which hold the retainer 1118 in an unlocked position extending from the rear surface 1130 of the head assembly 1112, as shown in FIGS. 58-60. The body 1116 also includes detents 1172 located in the side walls 1154 of the passageway 1138 near the front of the body 1116, which hold the retainer 1118 in a locked position within the body 1116 of the head assembly 1112, as shown in FIGS. 61-62. It will be appreciated that, in any of the examples having locking protrusions or extensions and corresponding locking recesses or detents, such locking structures could be located with respect to any of the respective opposed outer surfaces of the compression member or retainer, or the inner surfaces of the passageway through the body, and that such structures may be configured so as to have a single, or at least one locking extension and detent, or a plurality of such locking structures, such as the pairs that are shown in the present example. Thus, each of the retainer and the body may include at least one complementary locking member that is engaged when the retainer is moved to the locked position.

Having the retainer 1118 held in the unlocked position permits easy installation of the cable lacing tie device 1110. The head assembly 1112 may be moved to a position at or near a plurality of objects, such as a group of wires W to form a bundle B, located generally perpendicular to the first portion 1122 and along the front surface 1132 of the head assembly 1112. The end 1128 of the second portion 1124 of the cable lacing tape 1114 is moved to be looped around the plurality of objects and passed through the first opening 1140 in the front surface 1132, and then between the lower wall 1152 of the passageway 1138 and the lower surface of the retainer 1118, so as to extend rearward from the second opening 1142. With the second portion 1124 engaging the head assembly 1112, the end 1128 of the second portion 1124 of the cable lacing tape 1114 then is routed over the rear of the retainer 1118 and fed back through the looping opening 1142 in the rear surface 1130 and between the upper wall of the passageway 1138 and the upper surface 1156 of the retainer 1118. The end 1128 then extends forward through the first opening 1140 where it can be grasped and pulled by the user.

When the end 1128 of the cable lacing tape 1114 is pulled, any slack is taken up as the second portion 1124 of the cable lacing tape 1114 moves through the head assembly 1112 and around the retainer 1118. The cable lacing tape 1114 is tightened in this manner until the pulling force exceeds the resistance of the arms 1120 on the sides of the retainer 1118 to stay within the detents 1170. The arms 1120 may be constructed so as to break or to simply move out of the rearward detents 1170 and to permit the retainer 1118 to advance forward until whatever is left of the arms 1120 reach and engage the forward detents 1172, and achieve the locked position shown in FIGS. 61-62. It will be appreciated that the arms could be located with respect to any of the corresponding outer surfaces of the retainer or inner surfaces of the passageway through the body that are opposed to each other.

In the locked position, the locking extensions 1160 on the upper surface 1156 and the lower surface of the retainer 1118 also reach the detents 1162 in the upper wall and in the lower wall 1152 of the passageway 1138. In this way, the cable lacing tie device 1110 is configured for a method of use where tightening the cable lacing tape 1114 drives the retainer 1118 from an unlocked, ready or open position to a locked, closed position. In the locked position, a portion of the cable lacing tape 1114 that extends from the head assembly 1112 is looped back through and retained in the head assembly 1112 as it is compressed between the upper surface 1156 and lower surface of the retainer 1118 and the respective opposing upper wall and lower wall 1152 of the passageway 1138.

Having the retainer 1118 held in the unlocked position, spaced from the upper wall and lower wall 1152 of the passageway 1138, reduces the need for a molded tip on the end 1128, because the end 1128 may easily be threaded through the head assembly 1112 and around the retainer 1118. Further, although a molded tip may be provided, as described with respect to prior examples, it is not required to avoid unraveling if the end 1128 is trimmed to a shorter length after the retainer 1118 has reached a locked position, because the cable lacing tape 1114 would not be able to unravel while compressed within the head assembly 1112. Indeed, once in the locked position, the wedge-shaped engagement of the retainer 1118 is adapted to be self-tightening, and the threading around the retainer 1118 will cause the retainer 1118 to urge the cable lacing tape 1114 into a further compressed and therefore more securely retained position if the plurality of objects pulls on the cable lacing tape 1114.

Figure 63:
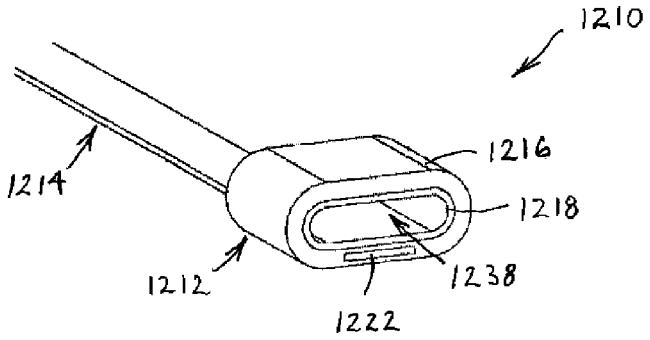
FIG. 63 is a perspective view of a fourteenth example cable lacing tie device that has a head assembly having a first portion of a cable lacing tape retained within the head assembly, a second portion of the cable lacing tape extending from the head assembly and a compression member incorporated into the head assembly and being in an unlocked, ready position, with a simplified view of the cable lacing tape.
Figure 64:
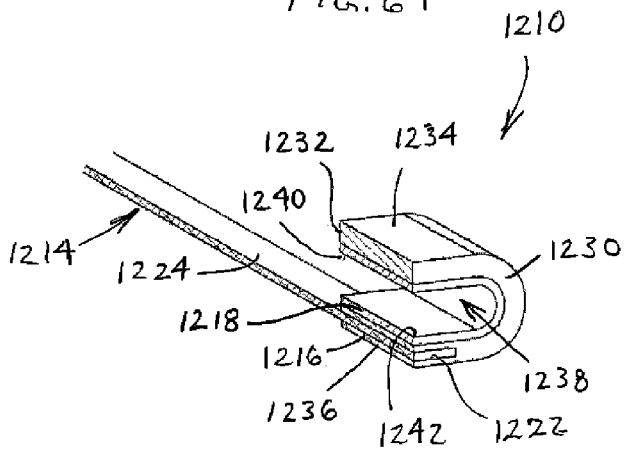
FIG. 64 is a perspective section view of the cable lacing tie device of FIG. 63, with the device being sectioned parallel to the lacing direction.
Figure 65:
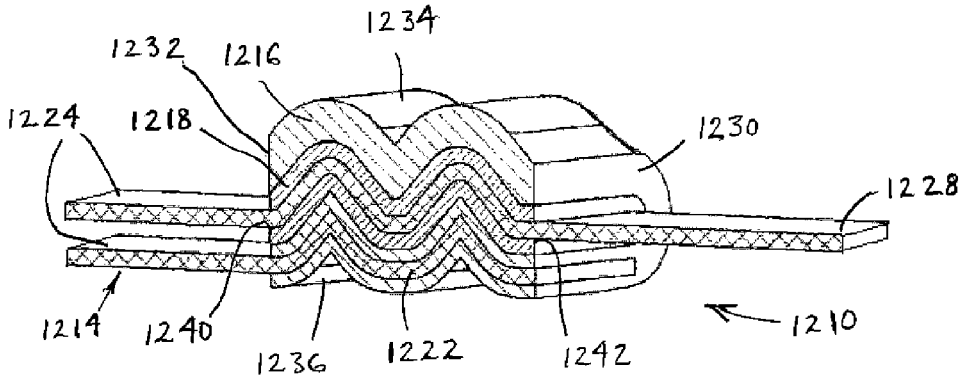
FIG. 65 is a perspective section view of the cable lacing tie device of FIG. 63, in an enlarged, simplified view that shows the second portion of the cable lacing tape extending back through the head assembly and having the compression member in a crimped, locked position.

Turning to FIGS. 63-65, a fourteenth example cable lacing tie device 1210 is illustrated. The example cable lacing tie device 1210 may be constructed of similar materials and by using similar construction techniques as described with respect to the prior examples, and includes a head assembly 1212 and a length of cable lacing tape 1214. The head assembly 1212 has a rear surface 1230, a front surface 1232, a top surface 1234, and a bottom surface 1236.

The head assembly 1212 includes a molded body 1216, and a compression member or retainer 1218 that is incorporated into the head assembly 1212, such as by being molded in place or by friction fit. In this example, the retainer 1218 is configured as a deformable member having a passageway 1238 therethrough, having a first opening 1240 in the front surface 1232 and a second opening 1242 in the rear surface 1230, as may be seen in FIGS. 63-64. A first portion 1222 of the cable lacing tape 1214 is insert-molded within the body 1216. A second portion 1224 of the cable lacing tape 1214 then extends from the front surface 1232 of the body 1216 to an end 1228.

Figure 46:
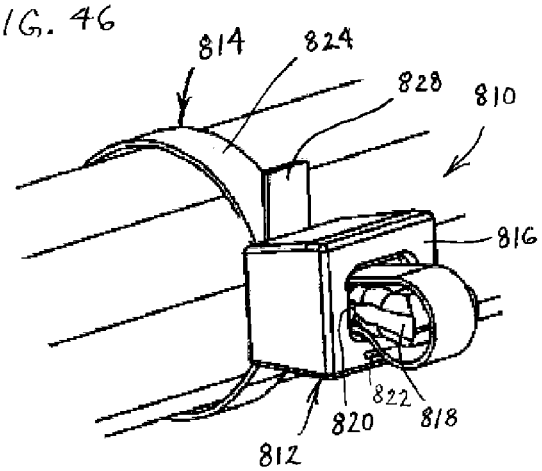
FIG. 46 is a perspective view of a ninth example cable lacing tie device that has a head assembly having a retainer in the form of a compression member that is shown in an unlocked position with a first portion of a cable lacing tape retained within the head assembly and a second portion of the cable lacing tape extending from the head assembly and being routed around a plurality of objects and through the head assembly, while engaging the retainer.
Figure 47:
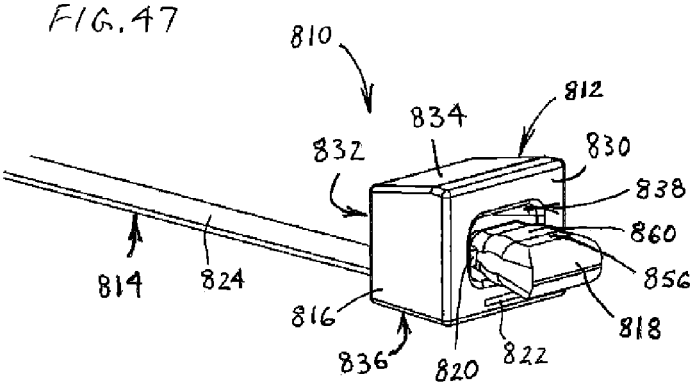
FIG. 47 is a perspective view of the cable lacing tie device of FIG. 46 prior to being moved into the position shown in FIG. 46.
Figure 48:
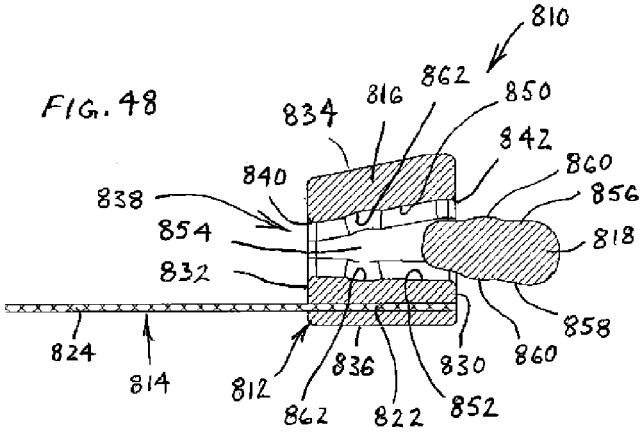
FIG. 48 is a section view of the cable lacing tie device of FIG. 46, in the position shown in FIG. 47 and being sectioned parallel to the lacing direction.
Figure 49:
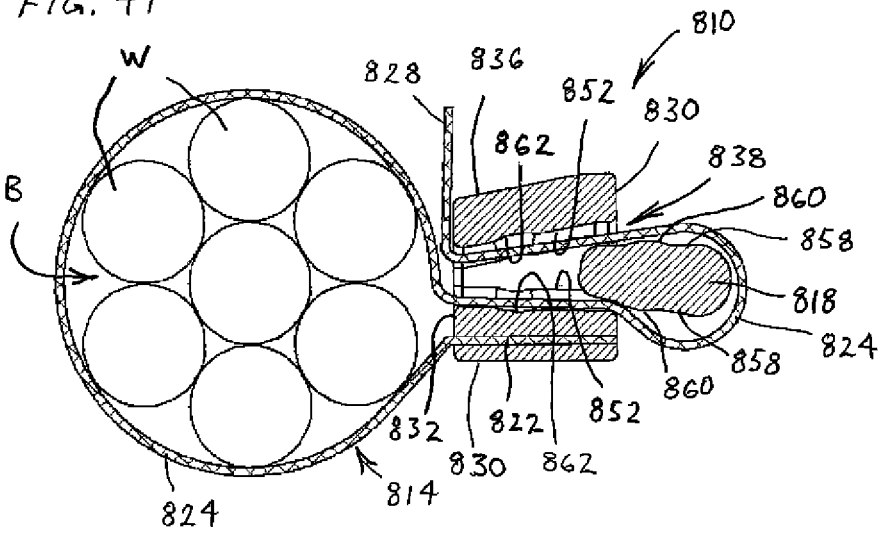
FIG. 49 is a section view of the cable lacing tie device of FIG. 46, with the device being sectioned parallel to the lacing direction.

The body 1216 and retainer 1218 differ from those of the immediately preceding five examples in that the retainer 1218 is not a wedge-shaped member that is moved by pulling on the end 1228 of the cable lacing tape 1214. The head assembly 1212 and retainer 1218 therefore permit the second portion 1224 of the cable lacing tape 1214 to be freely moved within the passageway 1238, in either direction, prior to deformation of the head assembly 1212, as shown in FIGS. 63-46. However, free movement along a portion of the cable lacing tape 1214 ceases once the head assembly 1212, which includes the body 1216 and corresponding retainer 1218, is manipulated by use of a tool, so as to crimp the head assembly 1212. As shown in FIG. 65, when crimped, the second portion 1224 of the cable lacing tape 1214 is compressed and retained in the head assembly 1212.

FIG. 65 also shows the second portion 1224 of the cable lacing tape 1214 extending from the front surface 1232 of the head assembly 1212 in a first direction, so as to permit the end 1228 to be looped around a plurality of objects, and then routed in the opposite direction through the opening 1240 in the front surface 1232, to pass through the passageway 1238 in the head assembly 1212. However, it will be appreciated that the end 1228 could have been routed so as to first pass through the opening 1242 in the rear surface of the head assembly. Alternatively, the second portion 1224 could have extended from the rear surface 1230 of the head assembly 1212 and then could have been routed through either the opening 1240 in the front surface 1232 or through the opening 1242 in the rear surface 1230 of the head assembly 1212. In yet a further alternative, both the first and second portions 1222, 1224 of the cable lacing tape 1214 could initially be free to route through the passageway 1238, either both from the same direction or in opposite directions, and then the head assembly could be crimped by a tool to compress and retain first and second portions of the cable lacing tape 1214 within the head assembly 1212.

In the configuration shown in FIG. 65, after passing the second portion 1224 through the passageway 1238, the end 1228 of the cable lacing tape 1214 may be pulled relative to the head assembly 1212 to remove any slack, as the second portion 1224 moves through the passageway 1238 through the retainer 1218 in the head assembly 1212. Once the cable lacing tape 1214 has been pulled tight, a tool may be used to deform the retainer 1218 by crimping, to move the retainer 1218 to a locked or compressed condition in which the retainer 1218 retains the second portion 1224 within the head assembly 1212. It will be appreciated that if the first portion 1222 were to start in a loose position and to be passed through the passageway 1238, then it the first portion 1222 also would be retained within the head assembly 1212 upon crimping of the retainer 1218. The cable lacing tie device 1210 may provide a light weight device that may be constructed from any of the advantageous materials discussed in relation to above examples, while presenting a structure that is fully assembled and quite easy to use.

Figure 66:
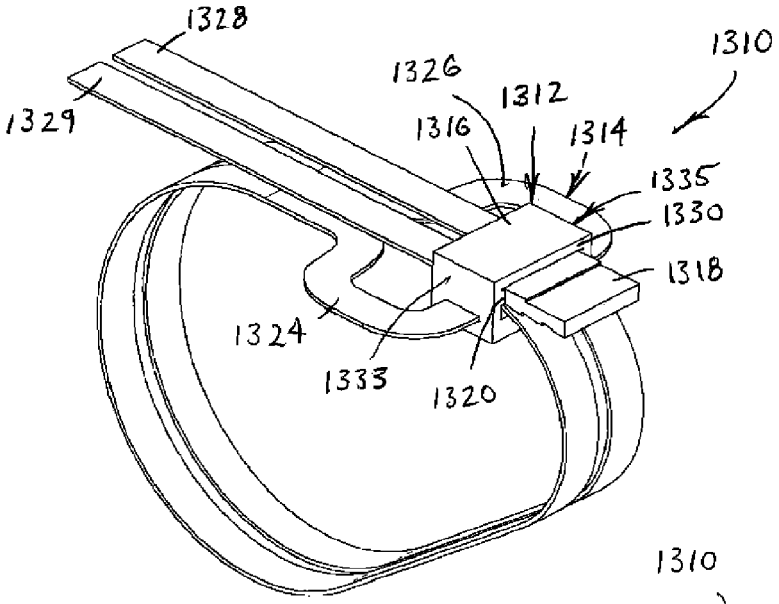
FIG. 66 is a perspective view of a fifteenth example cable lacing tie device that has a head assembly having a first portion of a cable lacing tape retained within the head assembly and second and third portions of the cable lacing tape extending from the head assembly in opposite directions and perpendicular to the direction a compression member or retainer is extending from the head assembly in an unlocked, ready position, with the second and third portions then bending to be extending parallel to each other and as though they are looped around a plurality of objects and then having been passed through the head assembly in a direction opposite the direction the compression member is extending, and with a simplified view of the cable lacing tape.
Figure 68:
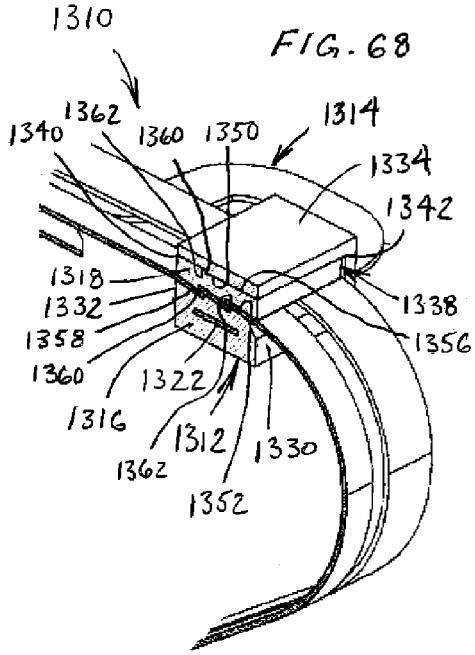
FIG. 68 is a perspective section view of the cable lacing tie device of FIG. 66, with the device being sectioned parallel to the lacing direction, the compression member in the locked position, and the second and third portions of the cable lacing tape partially removed for ease of viewing.
Figure 67:
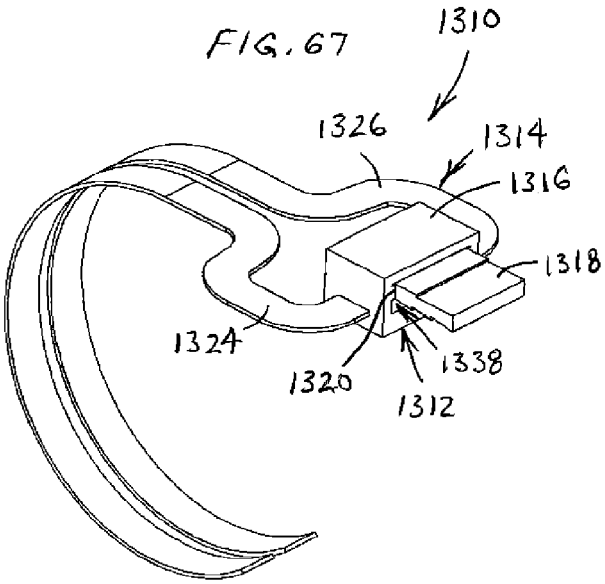
FIG. 67 is a perspective view of the cable lacing tie device of FIG. 66, with the second and third portions of the cable lacing tape partially removed for ease of viewing.
Figure 69:
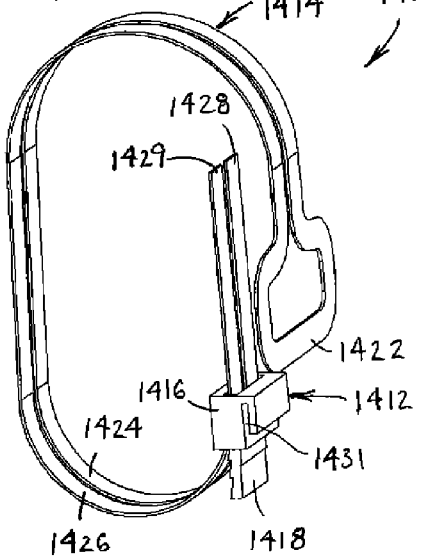
FIG. 69 is a perspective view of a sixteenth example cable lacing tie device that has a head assembly that receives and retains second and third portions of a cable lacing tape that are passed through the head assembly from which a compression member extends in an unlocked, ready position, with the cable lacing tape forming a loop that presents a first portion of the cable lacing tape to be retained within a channel in the head assembly, and with a simplified view of the cable lacing tape.
Figure 70:
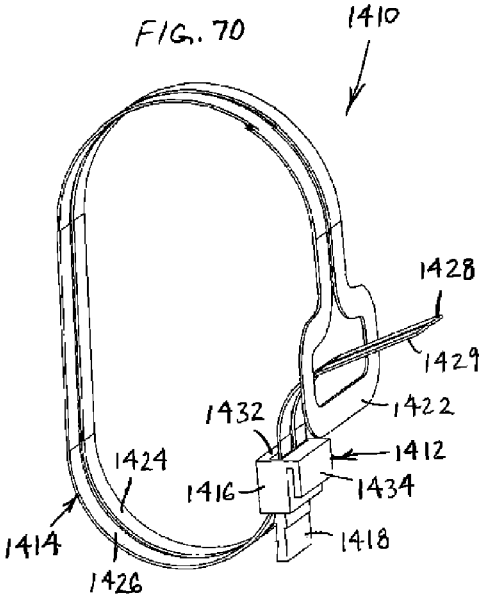
FIG. 70 is a perspective view of the cable lacing tie device of FIG. 69, with the second and third portions of the cable lacing tape passing through the loop that presents a first portion of the cable lacing tape so as to complete a loop around a plurality of objects and to permit the first portion of the cable lacing tape to be retained within the channel in the head assembly.
Figure 71:
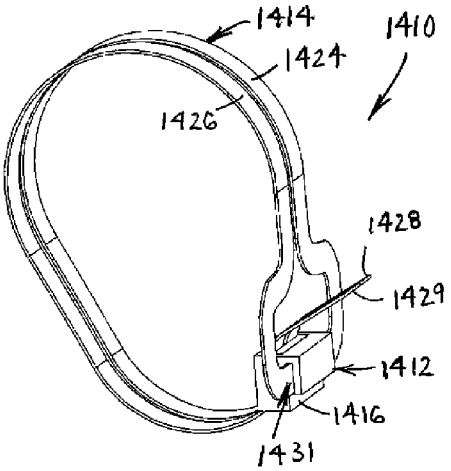
FIG. 71 is a perspective view of the cable lacing tie device of FIG. 69 in a position after that shown in FIG. 70 and with a first portion of the cable lacing tape moved to be positioned and retained within the channel in the head assembly as the second and third portions of the cable lacing tape are to be grasped and pulled.

A fifteenth example cable lacing tie device 1310 is illustrated in FIGS. 66-68. This example cable lacing tie device 1310 includes a head assembly 1312 and a cable lacing tape 1314 having a length and first and second ends 1328, 1329. The components may be constructed of similar materials and by using similar construction techniques as described with respect to the prior examples. The head assembly 1312 also includes a body 1316 and a compression member or retainer 1318. In this example, the retainer 1318 is integrally molded with the body 1316 of the head assembly 1312, so as to be connected to the body by small arms 1320 that are configured to hold the retainer 1318 in the unlocked position shown in FIGS. 66-67, while also to be easily broken by hand if the retainer 1318 is forced into the body 1316 and toward the locked position shown in FIG. 68. It will, however, be appreciated that the retainer could be separately formed and then held in a position relative to the body by use of protrusions or extensions and corresponding recesses or detents, or other suitable means of connection that will permit the retainer 1318 to be moved from an unlocked to a locked position, as described above with respect to other examples.

The head assembly 1312 has a rear surface 1330, a front surface 1332, a top surface 1334, a bottom surface 1336, a left side surface 1333, and a right side surface 1335. The head assembly 1312 also includes a passageway 1338 having a first opening 1340 in the front surface 1332 for exiting the passageway 1338, and a second opening 1342 in the rear surface 1330 to allow the first and second ends 1328, 1329 of the cable lacing tape 1314 to be passed through the passageway 1338 below the retainer 1318. A first portion 1322 of the cable lacing tape 1314 is retained in the body 1316 of the head assembly 1312, such as by insert-molding or by other methods of connection, as discussed with respect to prior examples, although it will be appreciated that the body 1316 could slidably engage the cable lacing tape 1314 to retain a first portion 1322 within the body 1316 of the head assembly 1312. Moreover, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

A second portion 1324 of the cable lacing tape 1314 extends outward from the left side surface 1333 of the head assembly 1312, while a third portion 1326 of the cable lacing tape 1314 extends outward from the right side surface 1335 of the head assembly. When in the unlocked position, the retainer 1318 is held in a position extending from the second opening 1342 in the rear surface 1330 by the arms 1320.

In this example, somewhat similar to some of the prior examples, the passageway 1338 generally includes an upper wall 1350, a lower wall 1352 and side walls. The retainer 1318 has an upper surface 1356 and a lower surface 1358, with the upper and lower surfaces 1356, 1358 each including at least one locking protrusion or extension 1360. The locking extensions 1360 are configured to cooperate with locking recesses or detents 1362 in the walls 1350, 1352 of the passageway 1338. Thus, each of the retainer and the body may include at least one complementary locking member that is engaged when the retainer is moved to the locked position.

The arms 1320 are configured to break when the retainer 1318 is forced forward into the passageway 1338, where the retainer 1318 engages the second and third portions 1324, 1326 of the cable lacing tape 1314, and the locking extensions 1360 engage the detents 1362, as shown in FIG. 68. The locking extensions and detents also are configured to resist reward movement of a second or third portion of a cable lacing tape that would be compressed between the retainer 1318 and the body 1316. It will be appreciated that in examples having arm structures on a retainer, the arms could be located with respect to any of the corresponding outer surfaces of the retainer or inner surfaces of the passageway through the body that are opposed to each other, and may be integrally molded with the body and retainer, as in this example, or the body and retainer could be separately formed and then joined in a head assembly, as is shown and described above in connection with the example of FIGS. 58-62.

Having the retainer 1318 held in the unlocked position permits easy installation of the cable lacing tie device 1310. The head assembly 1312 may be moved to a position at or near a plurality of objects, such as a group of wires to form a bundle. With the first portion 1322 of the cable lacing tape 1314 retained within the head assembly 1312, the first and second ends 1328, 1329, which correspond with the second and third portions 1324, 1326 of the cable lacing tape 1314 may be moved to be looped around the plurality of objects and to pass through the opening 1342 and through the passageway 1338 until they exit the opening 1340, generally in a direction perpendicular to the first portion 1322 and to an axis of the plurality of objects. With the second and third portions 1324, 1326 engaging the head assembly 1312, the ends 1328, 1329 are then pulled to take up any slack in and tighten the cable lacing tape 1314. The ends 1328, 1329 then extend forward from the first opening 1340 where they can be grasped and pulled by the user.

When the ends 1328, 1329 of the cable lacing tape 1314 are pulled, any slack is taken up as the second and third portions 1324, 1326 of the cable lacing tape 1314 move through the head assembly 1312 and past the retainer 1318. The cable lacing tape 1314 is tightened in this manner until satisfactorily tensioned, and then the retainer 1318 is manually moved forward, exceeding the force required to fracture the arms 1320 on the retainer 1318 and causing the retainer 1318 to move from the unlocked position extending from the passageway 1338 to the locked position within the passageway 1338. However, it will be appreciated that the force to move the retainer into the locked position could be provided when a user pulls on the cable lacing tape, if the cable lacing tie device is configured in a manner more similar to some of the other examples that provide for such movement.

The engagement of the locking extensions 1360 with the locking detents 1362 hold the retainer 1318 in the locked position shown in FIG. 65, while also compressing the second and third portions 1324, 1326 of the cable lacing tape 1314 between the lower surface 1358 of the retainer 1318 and the upper surface of the lower wall 1352 of the body 1316. In general, the cable lacing tie device 1302 likely would be provided with the first portion 1322 retained within the head, loosely or fixedly, with the second and third portions 1324, 1326 extending from the head assembly 1312 separately or in a manner joined so as to be adjacent each other at their ends or along their length. While both ends 1328, 1329 may be moved through the head assembly 1312 to retain both the second and third portions 1324, 1326 of the cable lacing tape 1314, it will be appreciated that either of the second or third portions could be individually retained within the head assembly 1312, if desired.

A sixteenth example cable lacing tie device 1410 is illustrated in FIGS. 69-72. This example cable lacing tie device 1410 includes a head assembly 1412 and a cable lacing tape 1414 having a length and first and second ends 1428, 1429. The components may be constructed of similar materials and by using similar construction techniques as described with respect to the prior examples and the device 1410 is most similar to the fifteenth example device 1310 shown in FIGS. 66-68. The head assembly 1412 similarly includes a body 1416 and a compression member or retainer 1418, wherein the retainer 1418 is integrally molded with the body 1416 of the head assembly 1412, so as to be connected to the body by small attachments members or arms 1420 that are configured to hold the retainer 1418 in the unlocked position shown in FIGS. 69-70, while also to be easily broken by hand if the retainer 1418 is forced into the body 1416 and toward the locked position shown in FIGS. 71-72. It will, however, be appreciated that the retainer could be separately formed and then held in a position relative to the body by use of protrusions or extensions and corresponding recesses or detents, or other suitable means of connection that will permit the retainer 1418 to be moved from an unlocked to a locked position, as described above with respect to other examples.

The head assembly 1412 has a rear surface 1430, a front surface 1432, a top surface 1434, a bottom surface 1436, a left side surface 1433, and a right side surface 1435. The head assembly 1412 also includes a passageway 1438 having a first opening 1440 in the front surface 1432 for exiting the passageway 1438, and a second opening 1442 in the rear surface 1430 to allow the first and second ends 1428, 1429 of the cable lacing tape 1414 to be passed through the passageway 1438 below the retainer 1418. A first portion 1422 of the cable lacing tape 1414 is retained in the body 1416 of the head assembly 1412, such as by engaging a channel 1431 in the body 1416, although it will be appreciated that the body 1416 could slidably engage the cable lacing tape 1414 to retain a first portion 1422 within the body 1416 of the head assembly, as is alternatively shown in FIGS. 66-68. Second and third portions 1424, 1426 of the cable lacing tape 1414 extend outward from the side surfaces 1433, 1435 of the head assembly 1412, as in the prior example. When in the unlocked position, the retainer 1418 is held in a position extending rearward, in alignment with the second opening 1442 in the rear surface 1430 by the arms 1420.

Figure 72:
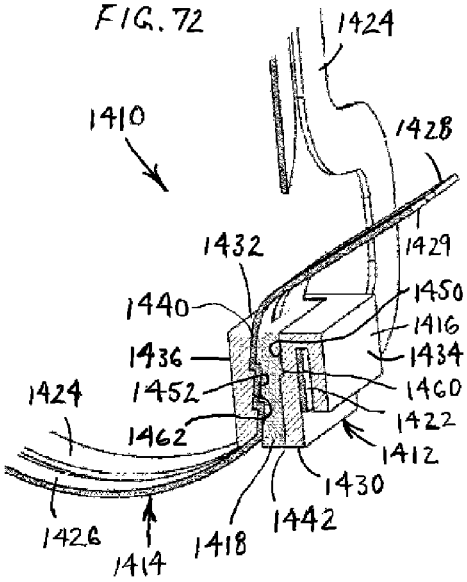
FIG. 72 is a perspective section view of the cable lacing tie device of FIG. 69, with the device being sectioned parallel to the lacing direction, the compression member or retainer in the locked position, and the second and third portions of the cable lacing tape partially removed for ease of viewing.
Figure 73:
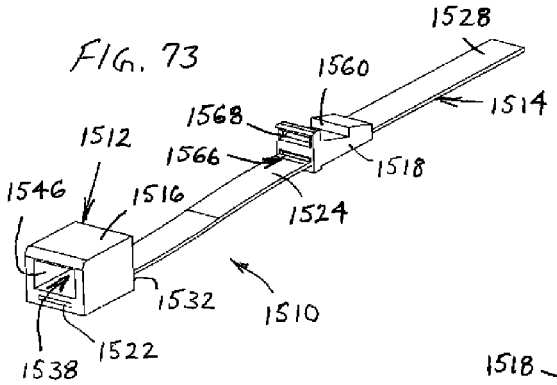
FIG. 73 is a perspective view of a seventeenth example cable lacing tie device that has a head assembly having a first portion of a cable lacing tape retained within the head assembly, and a second portion of the cable lacing tape extending from the head assembly and passing through a compression member or retainer that is slidable along the second portion, and with a simplified view of the cable lacing tape.
Figure 74:
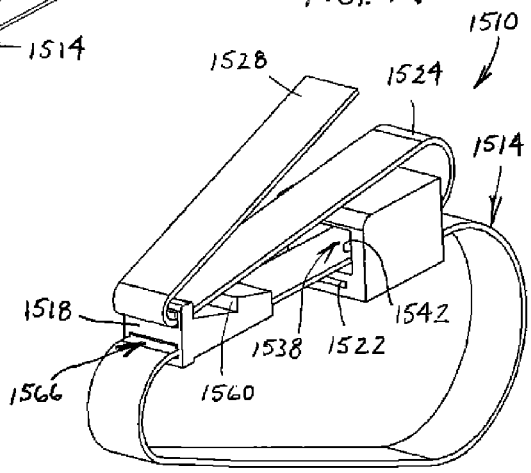
FIG. 74 is a perspective view of the cable lacing tie device of FIG. 73, with the second portion of the cable lacing tape shown as though it is looped around a plurality of objects and then having the second portion of the cable lacing tape passed through the head assembly and then back over the head assembly and through the compression member or retainer.

In this example, somewhat similar to some of the prior examples, the passageway 1438 generally includes an upper wall 1450, a lower wall 1452 and side walls. The retainer 1418 has an upper surface 1456 and a lower surface 1458, with the upper and lower surfaces 1456, 1458 each including at least one locking protrusion or extension 1460. The locking extensions 1460 are configured to cooperate with locking recesses or detents 1462 in the upper wall 1450 and the lower wall 1452 of the passageway 1438. The arms 1420 are configured to break when the retainer 1418 is forced forward into the passageway 1438, where the retainer 1418 engages the second and third portions 1424, 1426 of the cable lacing tape 1414, and the locking extensions 1460 engage the detents 1462, as shown in FIG. 72. The locking extensions and detents also are configured to resist reward movement of a second or third portion of a cable lacing tape that would be compressed between the retainer 1418 and the body 1416.

Having the retainer 1418 held in the unlocked position permits easy installation of the cable lacing tie device 1410. The head assembly 1412 may be moved to a position at or near a plurality of objects, such as a group of wires to form a bundle. The first portion 1422 of the cable lacing tape 1414 is presented as a free loop that may be looped around the plurality of objects and extended over the head assembly 1412, in which the second and third portions 1424, 1426 of the cable lacing tape 1414 are located. The loop of the first portion 1422 then is moved to a position where it is received in a channel 1431 in the body 1426. As the first and second ends 1428, 1429, which correspond with the second and third portions 1424, 1426 of the cable lacing tape 1414, are pulled, they take up any slack in and tighten the cable lacing tape 1414. This draws the first portion 1422 more securely into the channel 1431, while still permitting some adjustment of the device, if desired. The second and third portions 1424, 1426 continue to move through the head assembly 1412 and past the retainer 1418, until the cable lacing tape 1414 is tightened and then the retainer 1418 is manually moved forward, exceeding the force required to fracture the arms 1420 on the retainer 1418 and causing the retainer 1418 to move from the unlocked position extending from the passageway 1438 to the locked position within the passageway 1438. As noted with respect to the example in FIGS. 66-68, it will be appreciated that the force to move the retainer into the locked position could be provided when a user pulls on the cable lacing tape, if the cable lacing tie device is configured in a manner more similar to some of the other examples that provide for such movement.

The engagement of the locking extensions 1460 with the locking detents 1462 hold the retainer 1418 in the locked position shown in FIG. 72, while also compressing the second and third portions 1424, 1426 of the cable lacing tape 1414 between the lower surface 1458 of the retainer 1418 and the upper surface of the lower wall 1452 of the body 1416. In general, the cable lacing tie device 1402 may be provided with the second and third portions 1424, 1426 extending from the head assembly 1412, and the first portion 1422 prepared to be looped around a plurality of objects and retained within the channel 1431 to be held loosely until the ends 1428, 1429 are pulled, taking up slack in the device and more firmly gripping the channel 1431. As in the prior example, the second and third portions 1424, 1426 extend from the head assembly 1412 separately or in a manner joined so as to be adjacent each other at their ends or along their length. It will be appreciated that both ends 1428, 1429 must be moved through the head assembly 1412 to retain both the second and third portions 1424, 1426 of the cable lacing tape 1414.

Among other variations from the prior examples, a seventeenth example cable lacing tie device 1510 is illustrated in FIGS. 73-76. This example cable lacing tie device 1510 is constructed of similar materials and using similar techniques as described with respect to the prior examples. This example cable lacing tie device 1510 includes a head assembly 1512 and a length of cable lacing tape 1514. The head assembly 1512 includes a molded body 1516, and a compression member or retainer 1518 that is shown in this example as a separate piece that is not connected to the body 1516 until it is installed in a locked position. The head assembly 1512 has a rear surface 1530, a front surface 1532, a top surface 1534, and a bottom surface 1536. The head assembly 1512 also includes a passageway 1538 having a first opening 1540 in the front surface 1532 for exiting the passageway 1538, and a second opening 1542 in the rear surface 1530 to allow the cable lacing tape 1514 to be passed through the passageway 1538 and to receive the retainer 1518. The passageway 1538 through the body 1516 is somewhat wedge-shaped and has a flat lower surface 1544 and side walls 1546. The passageway 1538 also includes a locking undercut, recess or detent 1562 in an upper surface 1564.

In this example, a first portion 1522 of the cable lacing tape 1514 is molded within the body 1516 of the head assembly 1512, with a second portion 1524 extending outward from the front surface 1532 of the head assembly 1512 and terminating in an end 1528. As noted with respect to other examples herein, a first portion of a cable lacing tape may be retained in the head assembly in a fixed or non-fixed manner initially, and the second portion of the cable lacing tape may extend from the head assembly from the same surface through which the second portion will be routed to pass through the head assembly, or may extend from other than the surface through which the second portion will be routed to pass through the head assembly.

The retainer 1518 has a locking protrusion or extension 1560 on an upper surface 1556 and a generally flat lower surface 1558, which alternatively may have protrusions or otherwise be roughened to improve gripping the cable lacing tape 1514. The retainer 1518 also slidably receives the second portion 1524 of the cable lacing tape 1514 through a first central passageway 1566 and again through a second passageway 1568. The second portion 1524 of the cable lacing tape 1518 may be routed through a path that starts with looping the free end 1528 around a plurality of objects, and then passing it through the second opening 1542 in the rear surface 1530 of the body 1516. The end 1528 then would be passed through passageway 1538 and out the first opening 1540 in the front surface 1532 of the body 1516, where it would be routed upward along the rear surface 1530 and then rearward over the top surface 1534 of the body 1516 until passing through the second passageway 1568 in the retainer 1518, and presenting the free end 1528 to be grasped and pulled by a user.

Figure 76:
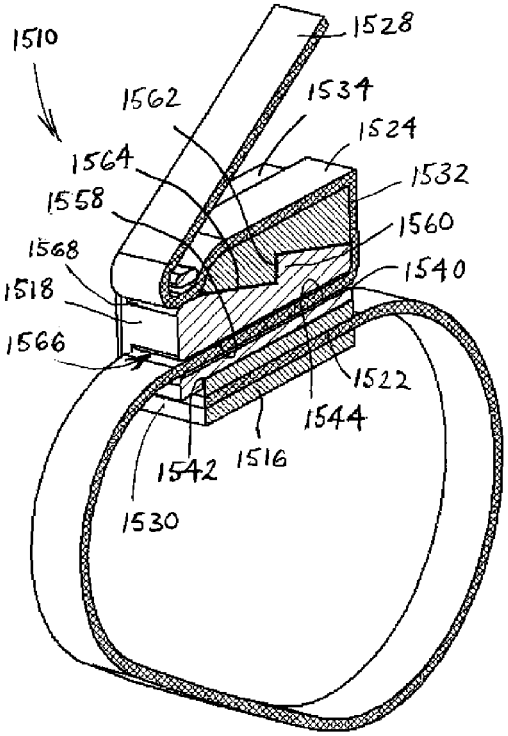
FIG. 76 is a perspective section view of the cable lacing tie device of FIG. 73, in the position shown in FIG. 75 and with the device being sectioned parallel to the lacing direction.
Figure 75:
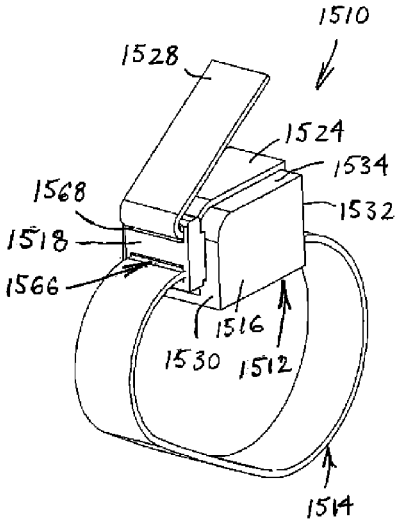
FIG. 75 is a perspective view of the cable lacing tie device of FIG. 73, after the second portion of the cable lacing tape has been grasped and pulled until the cable lacing tape would be tightened around a plurality of objects and the compression member or retainer has been moved to a locked position.
Figure 77:
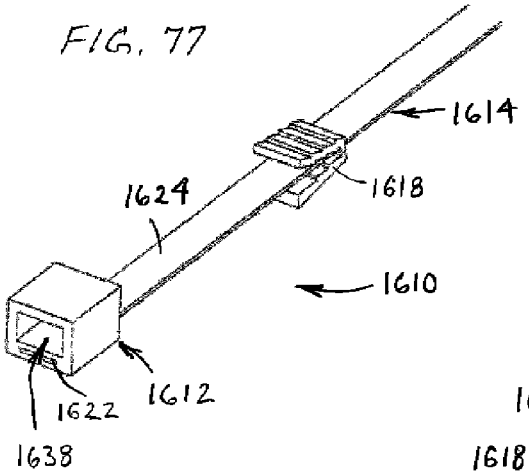
FIG. 77 is a perspective view of an eighteenth example cable lacing tie device that has a head assembly having a first portion of a cable lacing tape retained within the head assembly, and a second portion of the cable lacing tape extending from the head assembly and passing through a compression member or retainer that is slidable along the second portion, and with a simplified view of the cable lacing tape.
Figure 78:
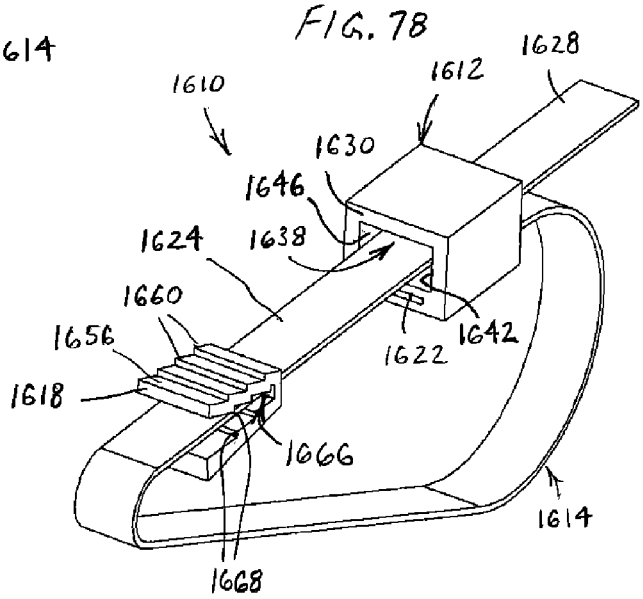
FIG. 78 is a perspective view of the cable lacing tie device of FIG. 77, with the second portion of the cable lacing tape shown as though it is looped around a plurality of objects and then having the second portion of the cable lacing tape pass through the head assembly.

The retainer 1518 is configured to be a compression member for insertion into the generally wedge-shaped passageway 1538 to compress the second portion 1524 of the cable lacing tape 1514 between the lower surface 1558 of the retainer 1518 and the lower surface 1544 of the passageway 1538. When the end 1528 of the second portion 1524 of the cable lacing tape 1514 is pulled, the retainer 1518 is pulled by the second portion 1524 passing through the second passageway 1568, so as to move the retainer 1518 from its unlocked position spaced apart along a length of the second portion 1524 from the body 1516 to a locked position located within the body 1516, where the locking extension 1560 engages the locking detent 1562. In addition, when the retainer 1518 is moved to its locked position, as shown in FIGS. 75-76, the second portion 1524 of the cable lacing tape 1514 is compressed between the retainer 1518 and an upper portion of the rear surface 15320 of the body 1516 of the head assembly 1512. It will be appreciated that, similar to some of the prior examples disclosed herein, the locking extension 1560 also may be provided on a surface over which the second portion 1524 of the cable lacing tape 1514 will pass, so as to provide a locking feature, as well as a localized increase in the compressive force applied to the second portion 1524 of the cable lacing tape 1514 to improve its retention within the head assembly 1512.

Turning to FIGS. 77-80, an eighteenth example cable lacing tie device 1610 is illustrated. This example cable lacing tie device 1610 is constructed of similar materials and using similar techniques as described with respect to the prior examples, and includes a head assembly 1612 and a length of cable lacing tape 1614. The head assembly 1612 includes a molded body 1616, and a compression member or retainer 1618 that is shown in this example as a separate piece that is not connected to the body 1616 until it is installed in a locked position. The head assembly 1612 has a rear surface 1630, a front surface 1632, a top surface 1634, and a bottom surface 1636. The head assembly 1612 also includes a passageway 1638 having a first opening 1640 in the front surface 1632 for exiting the passageway 1638, and a second opening 1642 in the rear surface 1630 to allow the cable lacing tape 1614 to be passed through the passageway 1638 and to receive the retainer 1618. The passageway 1638 through the body 1616 includes recesses or detents 1662 on an upper surface 1664, and a flat lower surface 1644 and side walls 1646.

In this example, a first portion 1622 of the cable lacing tape 1614 is molded within the body 1616 of the head assembly 1612, with a second portion 1624 extending outward from the front surface 1632 of the head assembly 1612 and terminating in a free end 1628. As noted with respect to other examples herein, a first portion of a cable lacing tape may be retained in the head assembly in a fixed or non-fixed manner initially, and the second portion of the cable lacing tape may extend from the head assembly from the same surface through which the second portion will be routed to pass through the head assembly, or may extend from other than the surface through which the second portion will be routed to pass through the head assembly.

The retainer 1618 has a plurality of locking protrusions or extensions 1660 on an upper surface 1656 and a generally flat lower surface 1658. The retainer 1618 also slidably receives the second portion 1624 of the cable lacing tape 1614 through a passageway 1666 that includes protrusions or extensions 1668 that may help grip and retain the second portion 1624 of the cable lacing tape 1614 when in the locked position shown in FIGS. 79-80. As with the other examples, it will be appreciated that such locking structures could be located with respect to any of the respective opposed outer surfaces of the compression member or retainer, or the inner surfaces of the passageway through the body, and that such structures may be configured so as to have a single, or at least one locking extension and detent, or a plurality of such locking structures, such as the plurality shown in the present example. Thus, each of the retainer and the body may include at least one complementary locking member that is engaged when the retainer is moved to the locked position.

The second portion 1624 of the cable lacing tape 1614 may be routed through a path that starts with looping the free end 1628 around a plurality of objects, and then passing it through the second opening 1642 in the rear surface 1630 of the body 1616. The end 1628 then would be passed through passageway 1638 and out the first opening 1640 in the front surface 1632 of the body 1616, where it could be grasped and pulled by a user.

Figure 80:
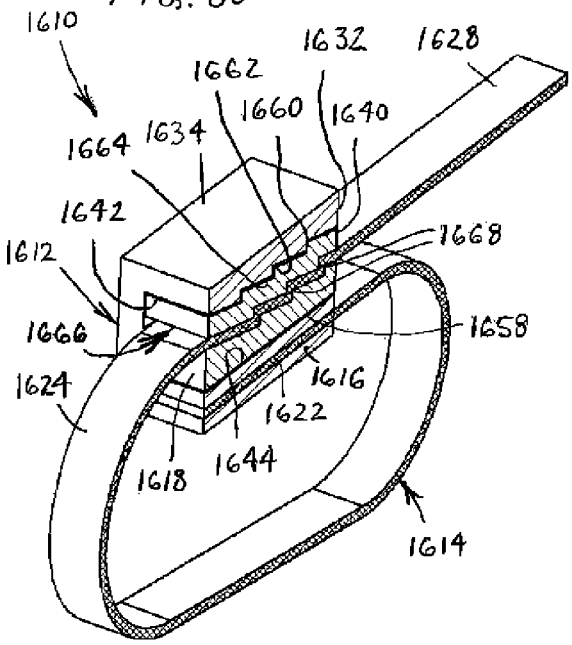
FIG. 80 is a perspective sectioned view of cable lacing tie device of FIG. 77, in the position shown in FIG. 79 and with the device being sectioned parallel to the lacing direction.
Figure 79:
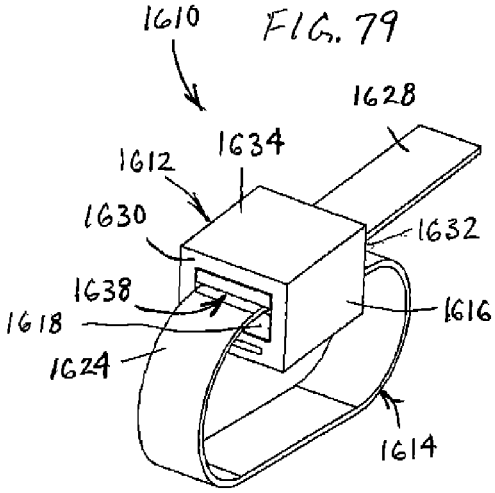
FIG. 79 is a perspective view of the cable lacing tie device of FIG. 77, after the second portion of the cable lacing tape has been grasped and pulled until the cable lacing tape would be tightened around a plurality of objects and the compression member or retainer has been moved to a locked position.

The retainer 1618 is configured to be a compression member for insertion into the passageway 1638 to compress the second portion 1624 of the cable lacing tape 1614 within the passageway 1666 through the retainer 1618. When the end 1628 of the second portion 1624 of the cable lacing tape 1614 is pulled, the slack is taken up throughout the cable lacing tape 1614 and the retainer 1618 may be manually moved from its unlocked position spaced apart along a length of the second portion 1624 from the body 1616 to a locked position located within the body 1616, where the locking extension 1660 engage the locking detents 1662. In the locked position, as shown in FIGS. 79-80, the second portion 1624 of the cable lacing tape 1614 is compressed within the retainer 1618. It will be appreciated that, similar to some of the prior examples disclosed herein, the locking extensions 1660 may be provided on a surface over which the second portion 1624 of the cable lacing tape 1614 will pass, so as to provide a locking feature, as well as a localized increase in the compressive force applied to the second portion 1624 of the cable lacing tape 1614 to improve its retention within the head assembly 1612.

Figure 81:
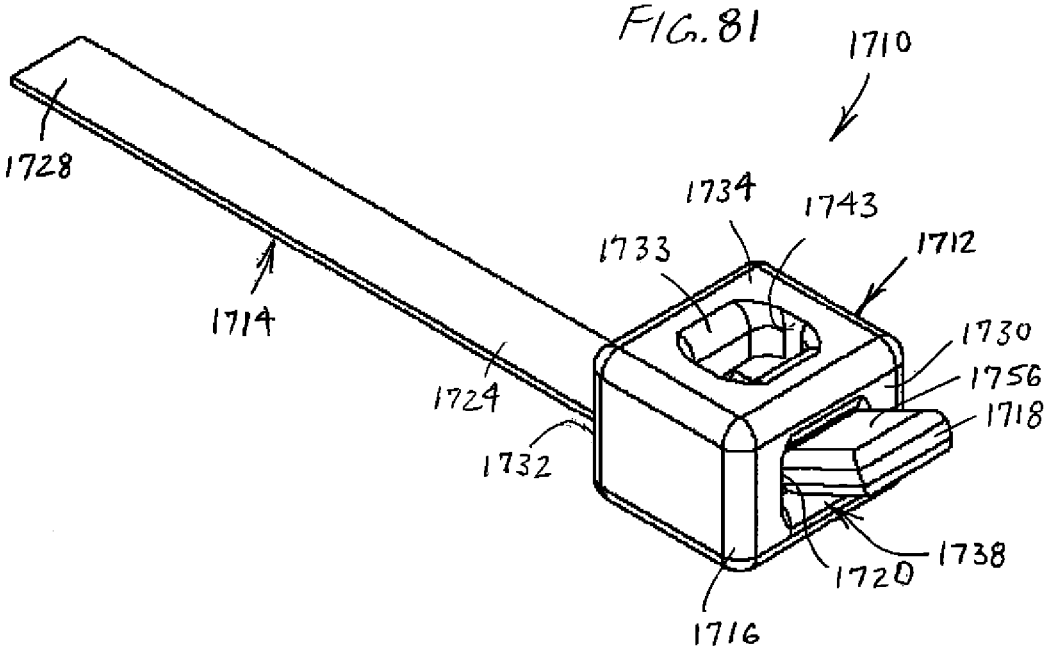
FIG. 81 is a perspective view of a nineteenth example cable lacing tie device that has a head assembly having a first portion of a cable lacing tape retained within the head assembly, a second portion of the cable lacing tape extending from the head assembly, a compression member or retainer extending from the head assembly in an unlocked, ready position, and with a simplified view of the cable lacing tape.
Figure 82:
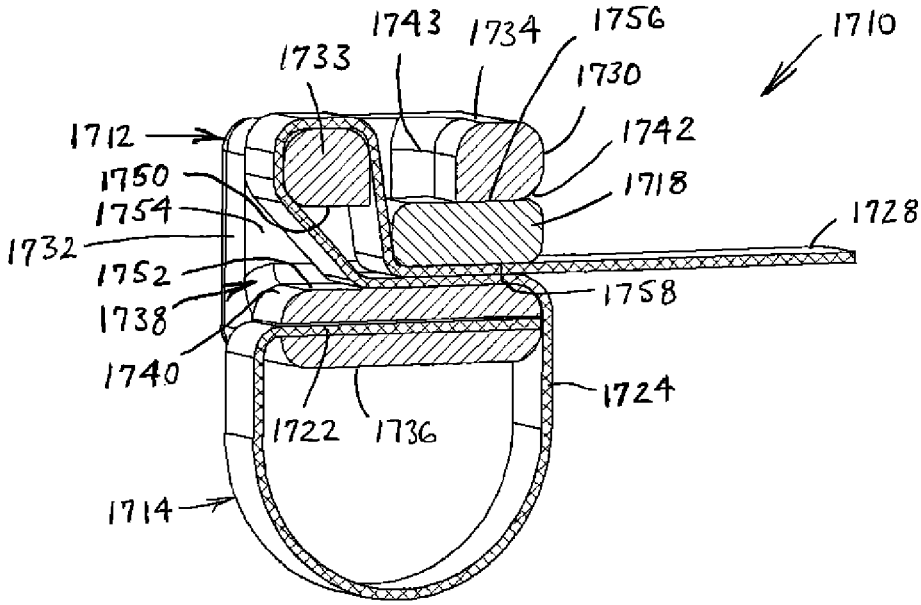
FIG. 82 is a perspective sectioned view of the cable lacing tie device of FIG. 81, after the second portion of the cable lacing tape has been looped as though around a plurality of objects and routed through the head assembly, and with a compression member or retainer having been moved to a locked position.

Turning to FIGS. 81-82, a nineteenth example cable lacing tie device 1710 is illustrated. This example cable lacing tie device 1710 may be constructed of similar materials and by using similar construction techniques as described with respect to the prior examples, and includes a head assembly 1712 and a length of cable lacing tape 1714. The head assembly 1712 includes a molded body 1716, and a retainer 1718 that also serves as a compression member, which will be referred to hereinafter as the retainer 1718. The retainer 1718 is shown in this example as having a shape that includes generally parallel opposed surfaces and being coupled to the body 1716 by being formed integrally with the body 1716 and having arms or other material connections on the sides of the retainer 1718 that connect it to the body 1716. The arms 1720 are constructed to hold the retainer 1718 in an unlocked, ready position, extending from the body 1716 until the cable lacing tie device 1710 is installed.

The head assembly 1712 has a rear surface 1730, a front surface 1732, a top surface 1734, a bottom surface 1736 and a passageway 1738 through the body 1716 of the head assembly 1712. The passageway 1738 has at least three openings, namely a first opening 1740 in the front surface 1732 for entering and exiting the passageway 1738, a second opening 1742 in the rear surface 1730 for exiting and looping the cable lacing tape 1714 around a lug 1733 along the rear surface 1730, and a third opening 1743 in the top surface 1734. In this example, a first portion 1722 of the cable lacing tape 1714 is retained in the body 1716 of the head assembly 1712, such as by insert-molding or by other methods of connection, as discussed with respect to prior examples. A second portion 1724 of the cable lacing tape 1714 extends outward from the front surface 1732 of the head assembly 1712, opposite the direction in which the retainer 1718 extends from the opening 1742 in the rear surface 1730 of the head assembly 1712 when in the unlocked position.

In this example, the passageway 1738 has an upper wall 1750 that is generally parallel to a lower wall 1752, and side walls 1754. The retainer 1718 has an upper surface 1756 and a lower surface 1758, which generally are parallel and flat, but may include locking protrusions or roughened areas to increase the grip against the cable lacing tape 1716. It will be appreciated that, as in any of the other examples, the retainer may include locking protrusions or extensions and the body may include corresponding locking recesses or detents, and that such locking structures could be located with respect to any of the respective opposed outer surfaces of the compression member or retainer, or the inner surfaces of the passageway through the body. Such structures also may be configured so as to have a single, or at least one locking extension and detent, or a plurality of such locking structures. Thus, each of the retainer and the body may include at least one complementary locking member that is engaged when the retainer is moved to the locked position.

The arms 1720 are configured to hold the retainer 1718 to permit easy installation of the cable lacing tie device 1710. It further will be appreciated that in any of the examples having such arm structures, the arms could be located with respect to any of the corresponding outer surfaces of the retainer or inner surfaces of the passageway through the body that are opposed to each other, and may be integrally molded with the body and retainer, as is shown in this example, or the body and retainer could be separately formed and then joined in a head assembly, as is shown and described below in connection with the example of FIGS. 58-62. These alternatives also could be utilized with respect to any of the other examples that include a retainer that can be moved from an unlocked position at least partially extending from a body of a head assembly to a locked position advanced further into the body.

When desiring to use the cable lacing tie device 1710 to hold together a plurality of objects, the head assembly 1712 is moved to a position at or near a plurality of objects and along the bottom surface 1736 of the head assembly 1712. The free end 1728 of the second portion 1724 of the cable lacing tape 1714 is moved to be looped around the plurality of objects and passed through the second opening 1742 in the rear surface 1730, and then through the passageway 1738 and out the first opening 1740 in the front surface 1732. The end 1728 then is routed up and over the lug 1733, down through the third opening 1743 in the top surface 1734, and then back out the second opening 1742 in the rear surface of the body 1716 of the head assembly 1712. With this routing, the second portion 1724 of the cable lacing tape 1714 passes over itself, so as to present two layers of cable lacing tape engaging each other, and being routed in opposite directions. The end 1728 then extends rearward from the second opening 1742 where it can be grasped and pulled by the user.

When the end 1728 of the cable lacing tape 1714 is pulled, any slack is taken up as the second portion 1724 of the cable lacing tape 1714 moves through the head assembly 1712. The cable lacing tape 1714 is tightened in this manner until a desired level of tension is achieved, and then the retainer 1718 is manually moved into a locked position within the body 1716, such as by pushing the retainer 1716 until the force exceeds the strength of the arms 1720 that connect the sides of the retainer 1718 to the body 1716. The arms 1720 are constructed so as to then break and permit the retainer 1718 to advance to the locked position, as shown in FIG. 82. However, it will be appreciated that the head assembly 1712 and routing of the cable lacing tape 1714 alternatively may be configured to permit pulling of the end 1728 to ultimately drive the retainer 1718 into the body 1716 to achieve a locked position. In the locked position, the retainer 1718 compresses the two layers of the second portion 1724 against each other and against the lower wall 1752 of the passageway 1738. Beyond the fact that the compression will tend to lock the second portion 1724 of the cable lacing tape 1714 in place, given that the two layers engage each other and are routed in opposite directions, they also will tend to resist movement of the cable lacing tape 1714.

As with many of the preceding examples, having the retainer 1718 held in the unlocked position, spaced from the lower wall 1752 of the passageway 1738, reduces the need for a molded tip on the end 1728, because the free end 1728 may easily be threaded through the head assembly 1712. Further, although a molded tip may be provided, as described with respect to some of the prior examples, it is not required to avoid unraveling if the end 1728 is trimmed to a shorter length after the retainer 1718 has reached a locked position, because the cable lacing tape 1714 would not be able to unravel while compressed within the head assembly 1712. Indeed, once in the locked position, the compression and routing in opposite directions of the two layers of the cable lacing tape 1714 within the head assembly 1712 will tend to provide secure retention of the cable lacing tape 1714 in the head assembly 1712.

It will be appreciated that the first portion of the cable lacing tape alternatively may not be retained initially within the head assembly, but only after being passed through a passageway in the head assembly and after a retainer has been manipulated or moved into a locked position. Also, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

Figure 83:
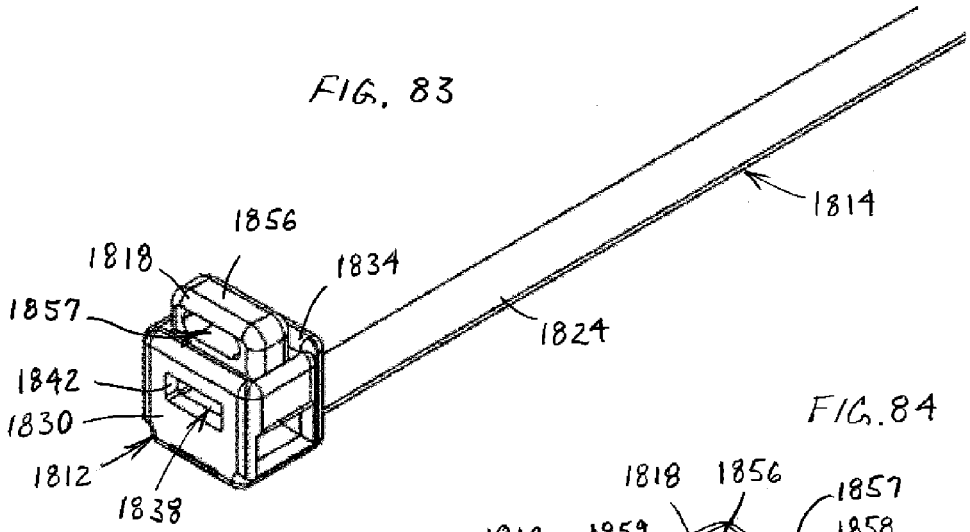
FIG. 83 is a perspective view of a twentieth example cable lacing tie device that has a head assembly having a first portion of a cable lacing tape retained within the head assembly, a second portion of the cable lacing tape extending from the head assembly, a compression member or retainer extending from the head assembly in an unlocked, ready position, and with a simplified view of the cable lacing tape.
Figure 84:
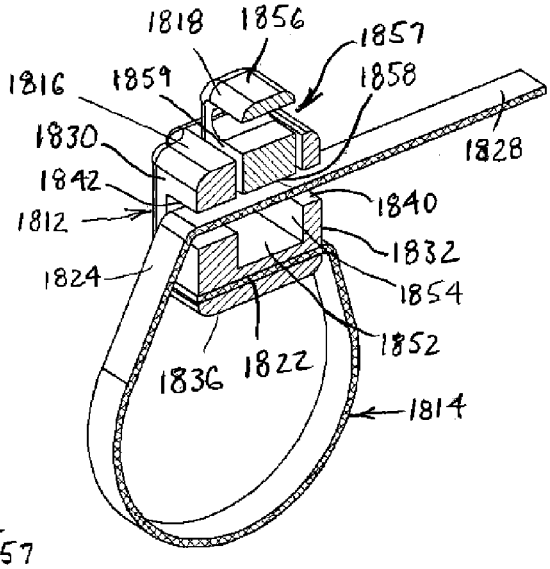
FIG. 84 is a perspective sectioned view of cable lacing tie device of FIG. 83, after the second portion of the cable lacing tape has been passed through the head assembly in a first direction and the retainer is still in the unlocked position, with the device being sectioned parallel to the lacing direction.
Figure 85:
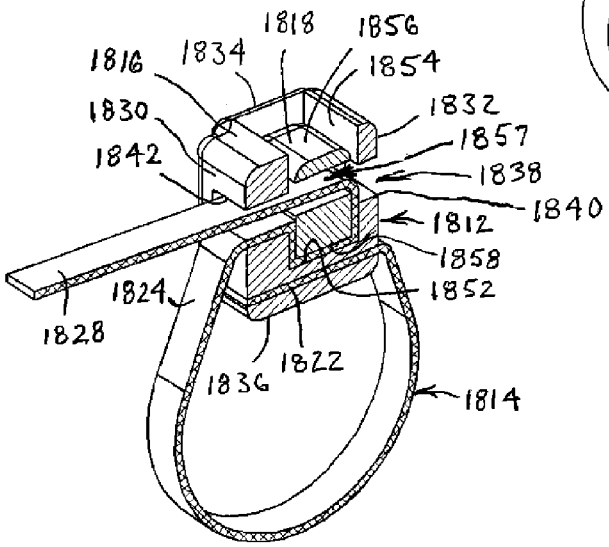
FIG. 85 is a perspective sectioned view of the cable lacing tie device of FIG. 83, after the second portion of the cable lacing tape has been looped as though around a plurality of objects and routed through the head assembly, and with a compression member or retainer having been moved to a locked position in which the cable lacing tape passes through the retainer.

A twentieth example cable lacing tie device 1810 is illustrated in FIGS. 83-85. This example cable lacing tie device 1810 may be constructed of similar materials and by using similar construction techniques as described with respect to the prior examples, and includes a head assembly 1812 and a length of cable lacing tape 1814. The head assembly 1812 includes a molded body 1816, and a retainer 1818 that also serves as a compression member, which will be referred to hereinafter as the retainer 1818. The retainer 1818 is shown in this example as having a shape that is generally rectangular in cross-section and being coupled to the body 1816 by having protrusions that engage detents (not shown) on the interior side walls 1854 of the body 1816. The protrusions and detents are constructed to hold the retainer 1818 in an unlocked, ready position, extending upward from the body 1816 until the cable lacing tie device 1810 is installed.

The head assembly 1812 has a rear surface 1830, a front surface 1832, a top surface 1834, a bottom surface 1836 and a passageway 1838 through the body 1816 of the head assembly 1812. The passageway 1838 has a first openings opening 1840 in the front surface 1832 to permit the cable lacing tape 1814 to exit and reenter the passageway 1838, and a second opening 1842 in the rear surface 1830 to allow the cable lacing tape 1814 to enter and exit the head assembly 1812. In this example, a first portion 1822 of the cable lacing tape 1814 is retained in the body 1816 of the head assembly 1812, such as by insert-molding or by other methods of connection, as discussed with respect to prior examples. A second portion 1824 of the cable lacing tape 1814 initially extends outward from the front surface 1832 of the head assembly 1812, and after routing the cable lacing tape 1814 for installation of the cable lacing tie device 1810, an end 1828 also extends outward from the front surface 1832 of the head assembly 1812.

In this example, the passageway 1838 has a lower wall 1852, and side walls 1854. The retainer 1818 has an upper surface 1856, a lower surface 1858, and side surfaces 1859, which generally are flat. The retainer 1818 also includes a passageway 1857 extending in the direction from the front to the rear of the head assembly 1812, and being configured to be aligned with the passageway 1838 when the retainer 1818 is in a lower or locked position. It will be appreciated that, as in any of the other examples, the retainer may include locking protrusions or extensions and the body may include corresponding locking recesses or detents, and that such locking structures could be located with respect to any of the respective opposed outer surfaces of the compression member or retainer, or the inner surfaces of the passageway through the body. Such structures also may be configured so as to have a single, or at least one locking extension and detent, or a plurality of such locking structures. Thus, each of the retainer and the body may include at least one complementary locking member that is engaged when the retainer is moved to the locked position.

As noted above, the retainer 1818 may initially be coupled to the body 1816 by protrusions that engage corresponding detents, to permit easy installation of the cable lacing tie device 1810. It further will be appreciated that in any of the examples having such arm structures, there may be arms or other structures that could be located with respect to any of the corresponding outer surfaces of the retainer or inner surfaces of the passageway or interior surfaces of the body that are opposed to each other, or the components may be integrally molded with each other. These alternatives also could be utilized with respect to any of the other examples that include a retainer that can be moved from an unlocked position at least partially extending from a body of a head assembly to a locked position advanced further into the body.

When desiring to use the cable lacing tie device 1810 to hold together a plurality of objects, the head assembly 1812 is moved to a position at or near a plurality of objects and along the bottom surface 1836 of the head assembly 1812. The free end 1828 of the second portion 1824 of the cable lacing tape 1814 is moved to be looped around the plurality of objects and passed through the second opening 1842 in the rear surface 1830, and then through the passageway 1838 and out the first opening 1840 in the front surface 1832. The free end 1828 is then pulled by the user to remove any slack throughout the cable lacing tape 1814. The retainer 1818 then is manually pushed downward by the user to a lower position. In doing so, the side surfaces 1859 and lower surface 1858 of the retainer 1818 press the second portion of the cable lacing tape 1824 that was passed through the passageway 1838 against the opposed side walls 1854 and lower wall 1852 of the passageway 1838, further tensioning the cable lacing tape 1814 that extends around the plurality of objects and compressing the second portion 1824. With the retainer 1818 moved to its downward position, the passageway 1857 through the retainer 1818 is aligned with the passageway 1838 through the body 1816, while the second portion 1824 and free end 1828 continue to extend forward from first opening 1840 in the front surface 1832. The free end 1828 then is passed back through the aligned passageways 1838, 1857, until it extends rearward from the second opening 1842 in the rear surface 1830, thereby achieving a locked position. In the locked position, the second portion 1824 that extends rearward toward the free end 1828 forms a stop that resists upward movement of the retainer 1818 toward an unlocked position, due to the additional shearing force or compression that would have to be applied to the cable lacing tape 1814 during upward movement of the retainer 1818.

It will be appreciated that, while the retainer 1818 could be initially held in the unlocked position by protrusions or extensions interacting with recesses or detents within the body 1816, the interior dimensions of the body 1816 could be configured alternatively to hold the retainer 1818 by a friction fit when in the upward, unlocked position shown in FIGS. 83-84, while having slightly more space available around the retainer 1818 in when in the lower position, so as to accommodate the presence of the cable lacing tape 1814 therebetween. Such a design also would increase the resistance of the retainer 1818 to move upward after it has achieved the locked position shown in FIG. 85, due to the increase in the force necessary to shear or compress the cable lacing tape 1814 if the retainer 1818 was trying to move back upward to a more tight-fitting portion within the body 1816. It also will be appreciated that the head assembly 1812 and routing of the cable lacing tape 1814 alternatively may be configured to permit pulling of the end 1828 of the cable lacing tape 1814 to drive the retainer 1818 into the body 1816 to achieve a lower, locked position.

As with many of the preceding examples, having the retainer 1818 held in the unlocked position, spaced from the lower wall 1852 of the passageway 1838, reduces the need for a molded tip on the end 1828, because the free end 1828 may easily be threaded through the body 1816 and retainer 1818 of the head assembly 1812. Further, although a molded tip may be provided, as described with respect to some of the prior examples, it is not required to avoid unraveling if the end 1828 is trimmed to a shorter length after the retainer 1818 has reached a locked position, because the cable lacing tape 1814 would not be able to unravel while compressed between the body 1816 and the retainer 1818 within the head assembly 1812. Indeed, once in the locked position, the compression and routing of the cable lacing tape 1814 within the head assembly 1812 will tend to provide secure retention of the cable lacing tape 1814 in the head assembly 1812.

It will be appreciated that the first portion of the cable lacing tape alternatively may not be retained initially within the head assembly, but only after being passed through a passageway in the head assembly and after a retainer has been manipulated or moved into a lower position and the cable lacing tape is passed back through the aligned passageways to achieve a locked position. Also, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

Figure 86:
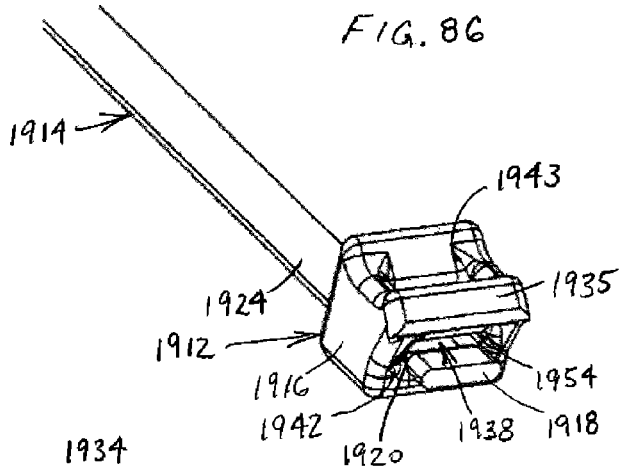
FIG. 86 is a perspective view of a twenty-first example cable lacing tie device that has a head assembly having a first portion of a cable lacing tape retained within the head assembly, a second portion of the cable lacing tape extending from the head assembly, a compression member or retainer extending from the head assembly in an unlocked, ready position, and with a simplified view of the cable lacing tape.
Figure 87:
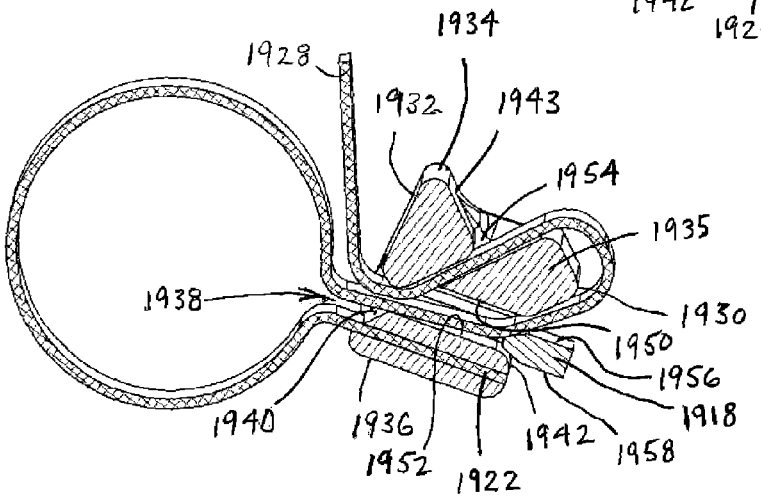
FIG. 87 is a perspective sectioned view of cable lacing tie device of FIG. 86, after the second portion of the cable lacing tape has been looped as though around a plurality of objects and routed through at least three openings of the passageway in the head assembly and with the compression member or retainer still in the unlocked position.
Figure 88:
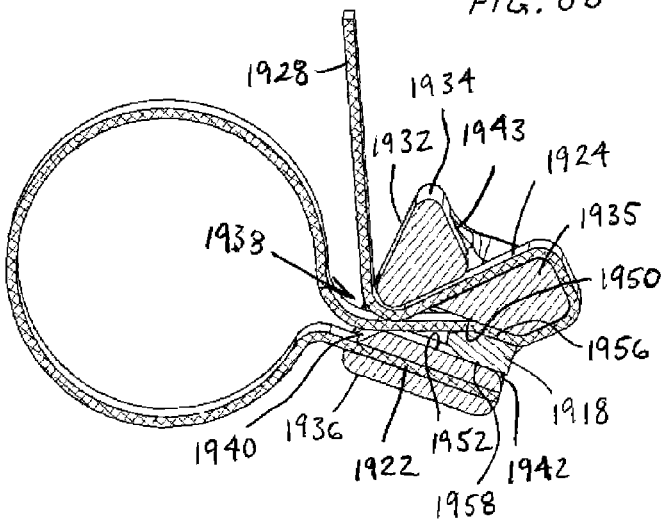
FIG. 88 is a perspective sectioned view of the cable lacing tie device of FIG. 86, after the position shown in FIG. 87 and with the second portion of the cable lacing tape having been pulled through to remove any slack, and with the retainer moved to a locked position.

Turning to FIGS. 86-88, a twenty-first example cable lacing tie device 1910 is illustrated. This example cable lacing tie device 1910 may be constructed of similar materials and by using similar construction techniques as described with respect to the prior examples, and includes a head assembly 1912 and a length of cable lacing tape 1914. The head assembly 1912 includes a molded body 1916, and a retainer 1918 that also serves as a compression member, which will be referred to hereinafter as the retainer 1918. The retainer 1918 is shown in this example as having a shape that includes generally parallel opposed surfaces and being coupled to the body 1916 by being formed integrally with the body 1916 and having arms or other material connections on the sides of the retainer 1918 that connect it to the body 1916. The arms 1920 are constructed to hold the retainer 1918 in an unlocked, ready position, extending from the body 1916 until the cable lacing tie device 1910 is installed.

The head assembly 1912 has a rear surface 1930, a front surface 1932, a top surface 1934, a bottom surface 1936 and a passageway 1938 through the body 1916 of the head assembly 1912. The passageway 1938 has at least three openings, namely a first opening 1940 in the front surface 1932 for entering and exiting the passageway 1938, a second opening 1942 in the rear surface 1930 for exiting and looping the cable lacing tape 1914 up and around a lug 1933 along the rear surface 1930, and a third opening 1943 in the top surface 1934. In this example, a first portion 1922 of the cable lacing tape 1914 is retained in the body 1916 of the head assembly 1912, such as by insert-molding or by other methods of connection, as discussed with respect to prior examples. A second portion 1924 of the cable lacing tape 1914 extends outward from the front surface 1932 of the head assembly 1912, opposite the direction in which the retainer 1918 extends from the opening 1942 in the rear surface 1930 of the head assembly 1912 when in the unlocked position.

In this example, the passageway 1938 has an upper wall 1950 that is generally parallel to a lower wall 1952, and side walls 1954. The retainer 1918 has an upper surface 1956 and a lower surface 1958, which generally are parallel and flat, but may include locking protrusions or roughened areas to increase the grip against the cable lacing tape 1916. It will be appreciated that, as in any of the other examples, the retainer may include locking protrusions or extensions and the body may include corresponding locking recesses or detents, and that such locking structures could be located with respect to any of the respective opposed outer surfaces of the compression member or retainer, or the inner surfaces of the passageway through the body. Such structures also may be configured so as to have a single, or at least one locking extension and detent, or a plurality of such locking structures. Thus, each of the retainer and the body may include at least one complementary locking member that is engaged when the retainer is moved to the locked position.

The arms 1920 are configured to hold the retainer 1918 to permit easy installation of the cable lacing tie device 1910. It further will be appreciated that in any of the examples having such arm structures, the arms could be located with respect to any of the corresponding outer surfaces of the retainer or inner surfaces of the passageway through the body that are opposed to each other, and may be integrally molded with the body and retainer, as is shown in this example, or the body and retainer could be separately formed and then joined in a head assembly, as is shown and described below in connection with the example of FIGS. 58-62. These alternatives also could be utilized with respect to any of the other examples that include a retainer that can be moved from an unlocked position at least partially extending from a body of a head assembly to a locked position advanced further into the body.

When desiring to use the cable lacing tie device 1910 to hold together a plurality of objects, the head assembly 1912 is moved to a position at or near a plurality of objects and along the front surface 1932 of the head assembly 1912. The free end 1928 of the second portion 1924 of the cable lacing tape 1914 is moved to be looped around the plurality of objects and passed through the first opening 1940 in the front surface 1932, and then through the passageway 1938 and out the second opening 1942 in the rear surface 1930. The end 1928 then is routed up and over the lug 1935, down through the third opening 1943 in the top surface 1934, and then back out the first opening 1940 in the front surface of the body 1916 of the head assembly 1912. With this routing, the second portion 1924 of the cable lacing tape 1914 passes over itself, so as to present two layers of cable lacing tape engaging each other, and being routed in opposite directions. The end 1928 then extends forward from the first opening 1940 where it can be grasped and pulled by the user.

When the end 1928 of the cable lacing tape 1914 is pulled, any slack is taken up as the second portion 1924 of the cable lacing tape 1914 moves through the head assembly 1912. The cable lacing tape 1914 is tightened in this manner until a desired level of tension is achieved, and then the retainer 1918 is manually moved into a locked position within the body 1916, such as by pushing the retainer 1916 until the force exceeds the strength of the arms 1920 that connect the sides of the retainer 1918 to the body 1916. The arms 1920 are constructed so as to then break and permit the retainer 1918 to advance to the locked position, as shown in FIG. 88. However, it will be appreciated that the head assembly 1912 and routing of the cable lacing tape 1914 alternatively may be configured to permit pulling of the end 1928 to ultimately drive the retainer into the body 1916 to achieve a locked position. In the locked position for the present example, the retainer 1918 compresses the second portion 1924 against the upper wall 1950 of the passageway 1938. Beyond the fact that the compression will tend to lock the second portion 1924 of the cable lacing tape 1914 in place, given that the two layers of the cable lacing tape 1914 engage each other and are routed in opposite directions, they also will tend to resist movement of the cable lacing tape 1914.

As with many of the preceding examples, having the retainer 1918 held in the unlocked position, spaced from the upper walls 1950 of the passageway 1938, reduces the need for a molded tip on the end 1928, because the free end 1928 may easily be threaded through the head assembly 1912. Further, although a molded tip may be provided, as described with respect to some of the prior examples, it is not required to avoid unraveling if the end 1928 is trimmed to a shorter length after the retainer 1918 has reached a locked position, because the cable lacing tape 1914 would not be able to unravel while compressed within the head assembly 1912. Indeed, once in the locked position, the compression and routing in opposite directions of the two layers of the cable lacing tape 1914 within the head assembly 1912 will tend to provide secure retention of the cable lacing tape 1914 in the head assembly 1912.

As previously noted with respect to other examples herein, it will be appreciated that the first portion of the cable lacing tape alternatively may not be retained initially within the head assembly, but only after being passed through a passageway in the head assembly and after a retainer has been manipulated or moved into a locked position. Also, with respect to any of the example embodiments herein that have a first portion of a cable lacing tape retained in a head assembly in a fixed manner prior to passing a second portion of the cable lacing tape through the head assembly, it will be understood that such devices may be configured to have the second portion of the cable lacing tape extend from the head assembly from the same surface through which the second portion will be routed to pass through the head assembly, or may extend from other than the surface through which the second portion will be routed to pass through the head assembly.

It will be appreciated that various modifications may be made to the structures described or required within a cable lacing tie device, while still falling within the spirit and scope of the claimed subject matter. For example, while the protrusions are shown extending from retainers that do not impart compression, they could extend instead from retainers that also serve as a compression member. Similarly, while the third example shows a pair of oppositely facing head assemblies, it will be appreciated that two head assemblies could be stacked, or could be integrated to share components, such as a single retainer plate having protrusions extending upward and downward.

Thus, one may construct a cable lacing tie device comprising a head assembly and a cable lacing tape, the head assembly retaining a first portion of the cable lacing tape, and having a length of the cable lacing tape extending from the head assembly, and the head assembly further comprising a compression member or retainer adapted to retain a second portion of the length of cable lacing tape extending from the head assembly. The first portion of the cable lacing tape may be retained in the head assembly in advance of installation of the cable lacing tie device, or may become retained within the head assembly while the cable lacing tie device is being installed, and either prior to or simultaneously with retaining the second portion of the cable lacing tape in the head assembly.

The present disclosure relates in another aspect to the device disclosed above, wherein when the cable lacing tie device is installed, the first portion of the cable lacing tape that is retained within the head assembly extends in a first general direction and a second portion of the cable lacing tape is retained within the head assembly and extends in a second general direction, wherein the first and second general directions are substantially parallel or substantially perpendicular.

The present disclosure relates in a further aspect to the device disclosed above, wherein the cable lacing tape further comprises a braided filament structure.

The present disclosure relates in yet another aspect to the device disclosed above, wherein the cable lacing tape includes at least one molded tip.

The present disclosure relates in a further aspect to the device disclosed above, wherein the cable lacing tape includes at least one molded segment positioned along the length of the cable lacing tape.

The present disclosure relates in another aspect to the device disclosed above, wherein the retainer is disposed within a recess in the head assembly.

The present disclosure relates in yet another aspect to the device disclosed above, wherein the retainer is integrally molded as part of the head assembly.

The present disclosure relates in a further aspect to the device disclosed above, wherein the retainer is positioned in the head assembly above and below the cable lacing tape.

The present disclosure relates in another aspect to the device disclosed above, wherein the compression member or retainer is pivotable or slidable.

The present disclosure relates in another aspect to the device disclosed above, wherein the head assembly further comprises a compression member.

The present disclosure relates in a further aspect to the device disclosed above, wherein the compression member is disposed within the head assembly and configured to be movable from a ready position that does not obstruct movement of the cable lacing tape to a locked position that engages the cable lacing tape.

The present disclosure relates in another aspect to the device disclosed above, wherein the compression member is configured to be inserted into a wedge shaped passageway within the head assembly.

The present disclosure relates in a further aspect to the device disclosed above, wherein the head assembly further comprises a body and the compression member or retainer is configured to be inserted into the body.

Additionally, one may construct a cable lacing tie device comprising a head assembly, a cable lacing tape, and a retainer adapted to urge a portion of the cable lacing tape into a retained position within the head assembly.

Thus, although the present disclosure describes particular example embodiments, it is to be understood that the disclosure is not to be interpreted as limiting. Various alterations and modifications will become apparent to those skilled in the art after having read the above disclosure. Accordingly, it is intended that the appended claims be interpreted as covering all alterations and modifications that fall within the true spirit and scope of the invention.

We claim:

1. A cable lacing tie device comprising:

a head assembly and a cable lacing tape;

the cable lacing tape comprising braided or woven filaments;

a first portion of the cable lacing tape retained within the head assembly;

the head assembly comprising a body having a passageway therethrough;

a retainer being movable from an unlocked position to a locked position;

at least one arm integrally formed with the head assembly and the retainer, the arm being breakable via a breaking force; and a second portion of the cable lacing tape having an end and the end being routed through the passageway in the head assembly in a path wherein the arm is broken and the retainer is moved from the unlocked position to the locked position when the end of the second portion of the cable lacing tape is pulled to cause a force on the arm exceeding the breaking force necessary to break the arm.

2. The cable lacing tie device of claim 1, wherein the retainer and the body comprise at least one complementary locking member that is engaged when the retainer is moved to the locked position.

3. The cable lacing tie device of claim 1, wherein the second portion of the cable lacing tape is compressed between the retainer and the body when the retainer is moved to the locked position.

4. The cable lacing tie device of claim 3, wherein the first and second portions of the cable lacing tape are compressed against each other between the retainer and the body of the head assembly when the retainer is moved to the locked position.

5. The cable lacing tie device of claim 4, wherein the first and second portions of the cable lacing tape are routed through the same path through the passageway in the head assembly.

6. The cable lacing tie device of claim 1, wherein the body further comprises arms that extend between the retainer and the body.

7. The cable lacing tie device of claim 6, wherein the arms are constructed to hold the retainer in the unlocked position whereby the end of the second portion of the cable lacing tape can be routed through the body and pulled to take up slack in the second portion of the cable lacing tape before the retainer is moved to the locked position.

8. A cable lacing tie device comprising:

a head assembly, and a cable lacing tape;

the cable lacing tape comprising braided or woven filaments and having a length and two ends;

the head assembly comprising a body retaining a first portion of the cable lacing tape that is spaced from the two ends of the cable lacing tape;

wherein a second portion of the cable lacing tape extends from the body and is routed through a passageway in the body;

the head assembly further comprising a retainer that engages the body, the retainer comprising at least one arm integrally formed with the retainer and the body, the arm preventing relative movement between the retainer and the body until broken by a breaking force, wherein the retainer is movable relative to the body between an unlocked position and a locked position; and wherein when the second portion is positioned through the passageway in the body and the second portion is operated to cause a force on the arm exceeding the breaking force necessary to break the arm, the retainer may be moved from the unlocked position to the locked position to retain the second portion of the cable lacing tape within the head assembly.

9. A cable lacing tie device comprising:

a head assembly and a cable lacing tape;

the cable lacing tape comprising braided or woven filaments;

a first portion of the cable lacing tape retained within the head assembly;

the head assembly comprising a body having a passageway therethrough;

a second portion of the cable lacing tape extending from the body;

a retainer having a passageway therethrough and being positioned along the second portion of the cable lacing tape, the retainer comprising at least one arm being integrally formed with the retainer and the head assembly to prevent relative movement between the retainer and the head assembly until the arm is broken by a breaking force; and once the arm is broken, the retainer being slidable along the second portion of the cable lacing tape and movable from an unlocked position spaced apart along the length of the second portion of the cable lacing tape from the body to a locked position located within the body.

* * * * *